US006702424B2

(12) United States Patent
Takahashi

(10) Patent No.: US 6,702,424 B2
(45) Date of Patent: Mar. 9, 2004

(54) HEAD JETTING PROPERTY MAINTENANCE DEVICE AND RECORDING APPARATUS WITH THE SAME

(75) Inventor: Nobuhito Takahashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/122,406

(22) Filed: Apr. 16, 2002

(65) Prior Publication Data

US 2003/0020779 A1 Jan. 30, 2003

(30) Foreign Application Priority Data

Apr. 17, 2001 (JP) ..... P2001-118743
Apr. 17, 2001 (JP) ..... P2001-118745
Apr. 17, 2001 (JP) ..... P2001-118746

(51) Int. Cl.[7] ..... B41J 2/165
(52) U.S. Cl. ..... 347/33; 347/29; 347/30
(58) Field of Search ..... 347/33, 30, 29, 347/32, 23, 35; 15/256.5

(56) References Cited

U.S. PATENT DOCUMENTS 4,825,231 A * 4/1989 Nozaki ..... 347/30
5,440,331 A * 8/1995 Grange ..... 347/32
6,402,289 B2 * 6/2002 Nitta ..... 347/30
6,536,864 B2 * 3/2003 Kan ..... 347/22

FOREIGN PATENT DOCUMENTS

EP 0 526 209 A2 * 2/1993
EP 0 785 084 A2 * 7/1997
JP 11-138830 5/1999

* cited by examiner

*Primary Examiner*—Shih-Wen Hsieh
(74) *Attorney, Agent, or Firm*—Sughrue Mion, PLLC

(57) ABSTRACT

A head jetting property maintenance device includes a wiping device for wiping a recording head, a capping device for sealing the recording head, and a driving device including two planet gears for transmitting a drive force to the wiping device and the capping device and one rotary device for rotating the planet gears, and the driving device is able to drive the wiping device and the capping device in either of normal and reverse directions of the rotary device by switching the engagement of one of the planet gears to the engagement of the other of the planet gears and vice versa. With such a mechanical arrangement, there is no need that providing flags to detect the initializing positions of the cap and wiper are provided on cams for driving the cap and the wiper thereby effecting sensing them. Accordingly, the assembling and adjustment of the device are simplified, and the cost to manufacture the device is decreased.

26 Claims, 80 Drawing Sheets

HEAD JETTING PROPERTY MAINTENANCE DEVICE AND RECORDING APPARATUS WITH THE SAME

This application is based on Japanese Patent Applications Nos. 2001-118743, 2001-118745, and 2001-118746, the contents of which are incorporated herein by reference.

BACKGROUND OF THE INVENTION

The present invention relates to a head jetting property maintenance device for maintaining an ink jetting property of a recording head for jetting ink droplets to a recording medium inconstant performance and a recording apparatus with the head jetting property maintenance device.

Generally, an ink jet printer as one form of the recording apparatus is constructed with a printing head mounted on a carriage, which reciprocates in the main scan direction, and a recording medium feeding device for intermittently feeding the recording medium, such as a printing sheet of paper, step by step at a predetermined amount in the sub-scan direction. In operation, the printer moves the printing head in the main scan direction while feeding the recording medium in the sub-scan direction. At the same time, the printer jets ink droplets from the printing head to the recording medium.

Normally, in the mono-color ink jet printer, one printing head is mounted on the carriage. As for the full color ink jet printers, some are provided with a black printing head for jetting black ink and a plurality of color printing heads for jetting color inks of necessary colors, such as yellow, cyan, and magenta, mounted on the carriage, and the others are provided with one printing head capable of jetting color inks of necessary colors, such as black, yellow, cyan and magenta, mounted on the carriage.

The printing head of the ink jet printer thus constructed includes pressure generating chambers and nozzle orifices communicating to the pressure generating chambers. By pressurizing the pressure generating chamber where ink is stored at a predetermined pressure, an ink droplet of controlled size is jetted to the recording medium from the nozzle orifice associated with the pressurized chamber. Accordingly, when the ink jetting property of the printing head at the nozzle orifice varies, the property variation greatly affects the quality of the recorded or printed image. To avoid this, it is essential to maintain the ink jetting property in constant performance.

The ink jetting property is varied by various causes: viscosity increase of ink due to evaporation and drying of the ink component at the nozzle orifices, clogging of the nozzle orifices by solid matters, dust sticking, air bubble entering, and others. To cope with this, the ink jet printer is equipped with a head jetting property maintenance device which removes the factors for causing the property variation to maintain the ink jetting property in constant performance.

The head jetting property maintenance device includes a capping device, a suction pump and a wiping device. The capping device is configured so as to seal the nozzle forming surface of the printing head in a non-print mode of the printer to isolate the nozzle orifices from outside. The capping device has functions to suppress the evaporation and drying of the ink and thus to suppress the viscosity increase and solidification of the ink. While the nozzle forming surface is sealed with the capping device, it is impossible to completely prevent the clogging of the nozzle orifices by solid materials and the entering of air bubbles into the ink passage. Accordingly, to completely remove the clogging and bubble entering problems, the suction pump is provided.

The suction pump applies a negative pressure to the nozzle orifices in a state that the capping device seals the nozzle forming surface. Under the negative pressure applied, ink is forcibly discharged from the nozzle orifices thereby removing solid materials and air bubbles. Usually, the operation of forcibly sucking and discharging the ink by the suction pump is carried out when the ink jet printer is stopped for a long time and is operated again, and when the user finds the quality deterioration of the printed image, and operates a dedicated switch on the operation panel.

When the discharging operation by forcible suction of the suction pump is carried out, ink often sticks to the nozzle forming surface of the print head, and the turbulence of the meniscus often occurs. Further, foreign materials tend to stick to the nozzle forming surface of the printing head with time. To remove the foreign materials, the wiping device is provided to wipe the nozzle forming surface according to the necessity.

The wiping device includes a wiping member which is formed with an elastic plate made of rubber or the like, and is clamped at the base end with a holder. The wiping device is configured so that the edge part of the top end of the wiping member is elastically pressed against and reciprocatively moved on the nozzle forming surface, thereby cleaning the nozzle forming surface. The wiping device has a function to regulate the meniscuses of ink at the nozzle orifices, viz., to stabilize the same, in addition to the function of wiping off the ink and the foreign materials sticking to the nozzle forming surface.

In a conventional head jetting property maintenance device, as described in Japanese patent Publication No. JP-A-11-138830, the driving of the capping device and the wiping device is switched to and from the driving of the suction pump depending on the rotational direction of a motor as a drive source, by use of one planet gear.

FIG. 80 is a side view showing another conventional head jetting property maintenance device. As illustrated by (a) of the figure, in the head jetting property maintenance device, the capping device 1 and the wiping device 2 are mounted on a supporting part 3 which is rotatable and vertically movable, while being disposed angularly spaced by 90°. A partially toothless gear 4 is fastened to the supporting part 3, and the supporting part 3 is disposed such that the partially toothless gear 4 comes in contact with the partially toothless cam 5. The head jetting property maintenance device is provided with a suction pump (not shown).

With such a construction, in a non-print mode of the printer, to seal the nozzle forming surface of the printing head and to isolate it from outside, the head jetting property maintenance device, as shown in (a) of the figure, is set such that the supporting part 3 is positioned at the top part in a state that the capping device 1 is directed upward, by means of the partially toothless cam 5.

When the nozzle forming surface is wiped after the printing in a manner that the edge part of the top end of the wiping member is elastically pressed against the nozzle forming surface and reciprocatively moved thereon, the partially toothless cam 5 is turned to bring the teeth 5*a* of the partially toothless cam 5 into engagement with the teeth 4*a*, and turns the supporting part 3 together with the partially toothless gear 4. Finally, as shown in (c) of the figure, the supporting part 3 is set such that the supporting part 3 is positioned at the lower-most part in a state that the wiping device 2 is directed upward, by means of the partially toothless cam 5.

In the former related art, the vertical movement of the cap and the reciprocal movement of the wiper are performed based on the unidirectional rotation of the motor. Accordingly, it is impossible to initialize the positions of the cap and the wiper. For this reason, it is necessary that flags to detect the initializing positions of the cap and wiper are provided on cams for driving the cap and the wiper thereby effecting sensing them. Accordingly, the sensors are essentially needed, and the assembling and adjustment of the device are complicated. The cost to manufacture the device is increased.

Further, the pump is also driven to turn in only one direction. Therefore, particularly when the tube pump is used, it is impossible to release the pulley from the tube. There is a fear that the pulley is left pressing the tube. To avoid this, it is necessary to move the carriage and lock the planet gear, and then to release the pulley. Accordingly, a mechanism which leaves the printing head capped even when the carriage is moved is needed. As a result, the assembling and adjustment of the device are complicated, the cost to manufacture the device is increased, and the device size becomes large.

The above conventional head jetting property maintenance device may be constructed in a simple mechanism, and hence is useful. In a state that the capping device 1 or the wiping device 2 is in a setting state, viz., the supporting part 3 is positioned at the upper-most or lower-most part, the teeth 5*a* of the partially toothless cam 5 is not in mesh with the teeth 4*a* of the partially toothless gear 4. The supporting part 3 is in a free state.

Additionally, as the head jetting property maintenance device must be rotated as a whole, a broad space is needed therearound. This leads to size increase of the ink jet printer into which the printing head is incorporated. Further, the position accuracy of the capping device 1 and the printing head is apt to be deteriorated possibly causing imperfect capping.

In a state that the capping device 1 or the wiping device 2 is in a setting state, viz., the supporting part 3 is positioned at the upper-most part or the lower-most part, the teeth 5*a* of the partially toothless cam 5 is not in mesh with the teeth 4*a* of the partially toothless gear 4. And the supporting part 3 is in a free state.

Accordingly, there is a chance that the user touches the supporting part 3 to turn the supporting part 3. In that case, it could be difficult to return the capping device 1 or the wiping device 2 to a predetermined position. The tips of the teeth could collide with each other and be possibly broken, when the teeth 5*a* of the partially toothless cam 5 fits together with the teeth 4*a* of the partially toothless gear 4. Furthermore, in assembling the head jetting property maintenance device, an exact phase adjustment between the partially toothless cam 5 and the partially toothless gear 4 is required, and this phase adjustment work is troublesome work.

SUMMARY OF THE INVENTION

Accordingly, an object of the present invention is to provide a head jetting property maintenance device which is capable of always stably performing the capping, wiping and the pump driving operations with a simple construction, and a recording apparatus provided with the head jetting property maintenance device.

1) To accomplish the above object, there is provided a head jetting property maintenance device for maintaining an ink jetting property of a recording head for jetting ink droplets to a recording medium, the head jetting property maintenance device comprising: a wiping device for wiping the recording head; a capping device for sealing the recording head; and a driving device including two planet gears for transmitting a drive force to the wiping device and the capping device and a rotary device for rotating the planet gears, wherein the driving device is able to drive the wiping device and the capping device in either of normal and reverse directions of the rotary device by switching an engagement of one of the planet gears to an engagement of the other of the planet gears.

2) In the head jetting property maintenance device 1) above, the driving device includes a sun gear being coupled to the rotary device and in mesh with the planet gears, and a partially toothless gear being coupled to the wiping device and the capping device and in mesh with the planet gears, and the driving device is disconnected from the wiping device and the capping device after driving the wiping device and the capping device.

In the head jetting property maintenance device thus characteristically featured, the cap of the capping device and the wiper of the wiping device are moved bidirectionally, viz., forwardly and reversely. Accordingly, the positions of the cap and wiper may be initialized easily. Therefore, in the invention, unlike the conventional device, there is no need to provide flags to detect the initializing positions of the cap and wiper provided on cams for driving the cap to effect sensing them. Accordingly, the assembling and adjustment of the device are simplified, and the cost to manufacture the device is decreased. Further, the cap and the wiper are reliably set at predetermined positions by merely rotating the partially toothless gear to a partially toothless part by a predetermined angle.

3) The head jetting property maintenance device 1) or 2) may further comprise a suction device for sucking a space within a cap of the capping device sealing the recording head, the suction device being driven by the driving device after the wiping device and the capping device have been driven. With this feature, the suction device is also rotatable bidirectionally. In particular, when the tube pump is used, it is possible to release the pulley from the tube. It is prevented that the pulley is left pressing the tube, without using any special mechanism. The recording head may be capped without driving the pump. Therefore, there is no fear that the pump tube is pressed at the time of opening and closing the cap.

4) In the head jetting property maintenance device 2) or 3), the partially toothless gear is formed of a gear train including four partially toothless gears, which are in mesh with a wiper gear for driving the wiping device, a cap gear for driving the capping device, and the planet gears, respectively. With this feature, the rotations of the planet gears, respectively, may be transmitted to the wiper gear and the cap gear reliably. As a result, a positioning accuracy of the cap and the wiper may be improved, and the capping device and the wiping device may be operated independently.

5) In the head jetting property maintenance device 4) above, the wiper gear includes a lever and a cam mechanism for horizontally moving the wiping device to the recording head, and the cap gear includes a cam mechanism for vertically moving the capping device with respect to the recording head. With this feature, the invention may be applied to the conventional wiping device and the capping device, each having the lever and the cam mechanism. Accordingly, troublesome design work, such as design modification, may be simplified.

6) To accomplish the object of the invention, there is provided a head jetting property maintenance device for maintaining an ink jetting property of a recording head for jetting ink droplets to a recording medium, the head jetting property maintenance device having a wiping device for wiping the recording head, a capping device for sealing the recording head, and a driving device for positioning the wiping device and the capping device at predetermined positions, wherein a guiding/fixing device for guiding, at the time of positioning of the wiping device, the positioning operation of the wiping device, and for positioning and fixing the wiping device; and a guiding/fixing device for guiding, at the time of positioning of the capping device, the positioning operation of the capping device, and for positioning and fixing the capping device.

With this feature, the wiping device and the capping device maybe held at a fixed position. Therefore, if the user touches the wiping device and the capping device, there is no chance that the wiping device and the capping device are displaced. Accordingly, there is no need for the work to return the wiping device and the capping device to predetermined positions. Further, there is no chance that parts forming the wiping device and the capping device collide with each other. In this respect, the maintenance work is easy. The wiping device and the capping device are always positioned highly accurately. Further, there is no need of making the phase adjustment of the parts forming the wiping device and the capping device in assembling the head jetting property maintenance device. Accordingly, the cost to manufacture the head jetting property maintenance device is reduced.

7) In the head jetting property maintenance device 6) above, when the wiping device wipes the recording head, the driving device turns the wiping device upward, while moving downward and positioning the capping device, and when the capping device seals the recording head and sucks ink from the recording head, the driving device turns downward the wiping device, while moving upward and positioning the wiping device.

With this feature, when the wiping device is operated in place of the capping device, only the wiping device is rotated, and there is no need of rotating the capping device. Therefore, the head jetting property maintenance device may be constructed in a simple mechanism. Accordingly, the cost of manufacturing the head jetting property maintenance device is reduced.

8) The head jetting property maintenance device 6) or 7) above further comprises a suction device for sucking inside the cap of the capping device, and wherein aid driving device drives the suction device. With this feature, the wiping device, the capping device and the suction device may be operated by a single driving device. Thus, the capping device and the suction device may be operated by a single driving device. As a result, the head jetting property maintenance device per se may be reduced in size.

9) In any of the head jetting property maintenance devices 6) to 8), the driving device drives the respective devices independently. With this, the load imposed on the driving device is reduced. Therefore, the power consumption by the ink jet printer is reduced.

10) In any of the head jetting property maintenance devices 6) to 9) above, the wiping device and the capping device are able to return to their initial positions from any positions without use of sensing devices. With this feature, even when the plug is mistakenly pulled out of the electrical outlet or unexpected power failure occurs, and the head jetting property maintenance device stops its operation, it may be reset from its state.

11) In any of the head jetting property maintenance devices 6) to 10), a driving side and a driven side of the wiping device in the driving device are provided with partially toothless gears, respectively. A driving device, which is capable of solely driving the wiping device, the capping device and the suction device, can be realized with a simple structure.

12) In any of the head jetting property maintenance devices 7) to 11), the wiping device is rotatably mounted on the capping device. Therefore, the device for vertically moving the capping device and the device for rotating the wiping device may easily be constructed with the same mechanism. This feature makes the head jetting property maintenance device compact.

13) In any of the head jetting property maintenance devices 7) to 12), the wiping device includes a rotatable wiper for wiping the recording head, and a wiper cleaner for wiping out materials sticking onto the wiper in a manner that the wiper cleaner rubs with the wiper when the wiper rotates. Therefore, the wiper may be constructed to be maintenance free, so that the maintenance of the head jetting property maintenance device is easy.

14) In any of the head jetting property maintenance devices 7) to 13), the driving device includes a cam provided with a gear for transmitting a drive force for the wiping device, and transmitting a drive force for moving the capping device vertically. Therefore, the device for vertically moving the capping device and the device for rotating the wiping device may be constructed using simple mechanical parts. This results in improvement of the positioning accuracy of those devices, and reduction of maintenance and manufacturing cost.

15) In the head jetting property maintenance device 14), the driving device includes a normal rotation gear for normal rotation and a reverse rotation gear for reverse rotation, which alternately come into engagement with a came with the partially toothless gear. This feature enables the normal rotation gear and the reverse rotation gear rotation to be separately constructed. As a result, a more reliable positioning and fixing is ensured when the wiping device is used and when the capping device is used.

16) To accomplish the object of the invention, there is provided a head jetting property maintenance device for maintaining an ink jetting property of a recording head for jetting ink droplets to a recording medium, the head jetting property maintenance device having a wiping device for wiping the recording head; a capping device for sealing the recording head; and a driving device operating such that when the wiping device wipes the recording head, the driving device turns the wiping device upward and moves downward and positions the capping device, and when the capping device seals the recording head to suck ink therefrom, the driving device turns downward the wiping device and moves upward and positions the capping device. The head jetting property maintenance device thus constructed is improved such that the driving device includes a friction clutch mechanism transmits a drive force when the wiping device is driven to start its turn, and releases the drive force when the wiping device is stopped in turn.

Accordingly, there is no need of rotating the capping device, and therefore of providing a space allowing the device to rotate around the device. The result is to realize the size reduction of the ink jet printer into which the head jetting property maintenance device is incorporated, and maintain the position precision of the capping device and the recording head in high level. After the wiping device is rotated upward or downward, the friction clutch mechanism may be made to run idle. Therefore, the wiping device may always be positioned at a fixed position. Accordingly, the initializing and assembling of the wiping device are easy.

17) The head jetting property maintenance device 16) above further comprising a suction device for sucking inside the cap of the capping device, and wherein aid driving device drives the suction device. With provision of the suction device, ink droplets sticking to the nozzles of the recording head may be sucked, so that it is possible to maintain the print accuracy in high level.

18) In the head jetting property maintenance device 16) or 17), a gear drive mechanism using a partially toothless gear is used for an intermediate power transmission mechanism of the friction clutch mechanism. Accordingly, the friction clutch mechanism, which may be driven even if a load in excess of a friction force is imparted to the intermediate power transmission mechanism, is realized with a simple structure.

19) In any of the head jetting property maintenance devices 16) to 18), the wiping device and the capping device are able to return to their initial positions from any positions without use of sensing devices. With this feature, even when the plug is mistakenly pulled out of the electrical outlet or unexpected power failure occurs, and the head jetting property maintenance device stops its operation, it may be reset from its state.

20) In any of the head jetting property maintenance devices 16) to 18), the friction clutch mechanism includes two drive force transmission devices, and a pressing device for pressing the drive force transmission devices with each other, and the drive force transmission devices are integrally coupled to the wiping device. With this, a friction force is generated between the two drive forces transmission devices, thereby forming a friction clutch mechanism.

21) In any of the head jetting property maintenance device 20), the pressing means is a compression gear for pressing the normal gear against the partially toothless gear and vice versa. Therefore, the friction clutch mechanism may be constructed in a simple mechanism. The cost to manufacture the head jetting property maintenance device may be reduced.

22) In any of the head jetting property maintenance devices 16) to 21), the wiping device is rotatably mounted on the capping device. Therefore, the device for vertically moving the capping device and the device for rotating the wiping device may easily be constructed with the same mechanism. This feature makes the head jetting property maintenance device compact.

23) In any of the head jetting property maintenance device 16) to 22), the driving device includes a cam having a partially toothless gear which transmits, a drive force during the rotation of the wiping device through the two drive force transmission devices, and transmits a drive force when the capping device vertically moves. Therefore, the device for vertically moving the capping device and the device for rotating the wiping device may be constructed using simple mechanical parts. This results in improvement of the positioning accuracy of those devices, and reduction of maintenance and manufacturing cost.

24) According to an additional aspect of the invention, there is provided an ink jet printer having a recording head for jetting ink droplets to a recording medium, which the printer being characterized by a head jetting property maintenance device defined in any of the head jetting property maintenance devices 1) to 23). Accordingly, the ink jet printer having the operation and effects as mentioned above is provided.

DETAILED DESCRIPTION OF THE PREFERRED EMBODIMENTS

The preferred embodiments of the invention will be described with reference to accompany drawings.

Figure 1:
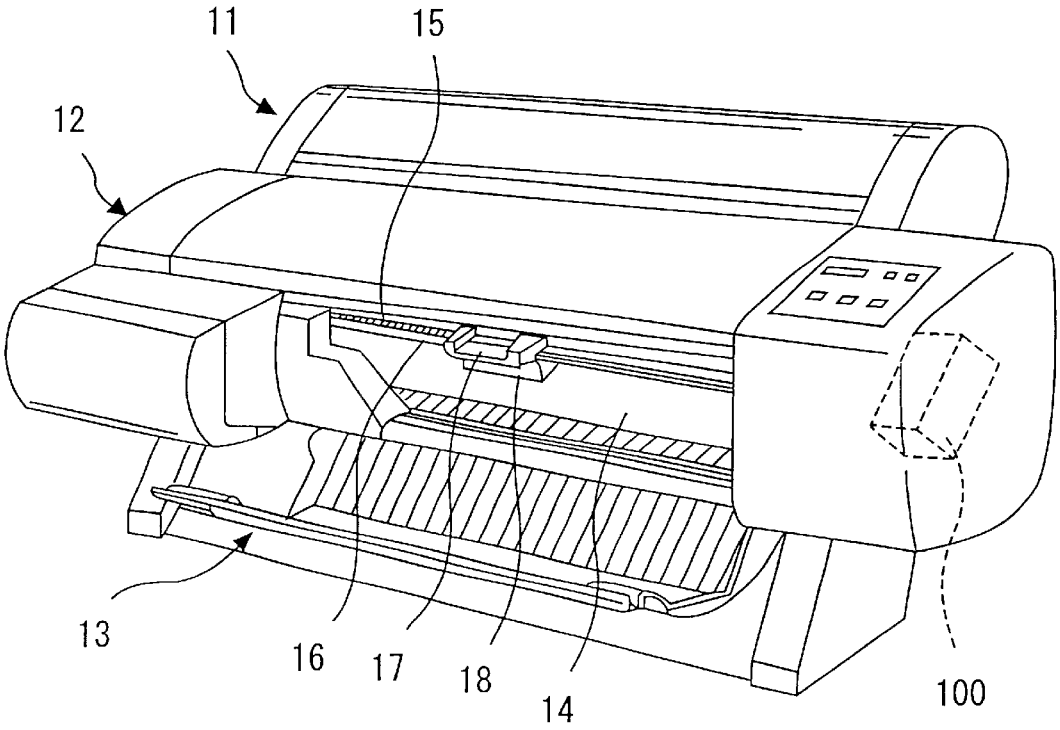
FIG. 1 is a perspective view showing an ink jet printer, which is one form of the recording apparatus according to an embodiment of the invention.
Figure 2:
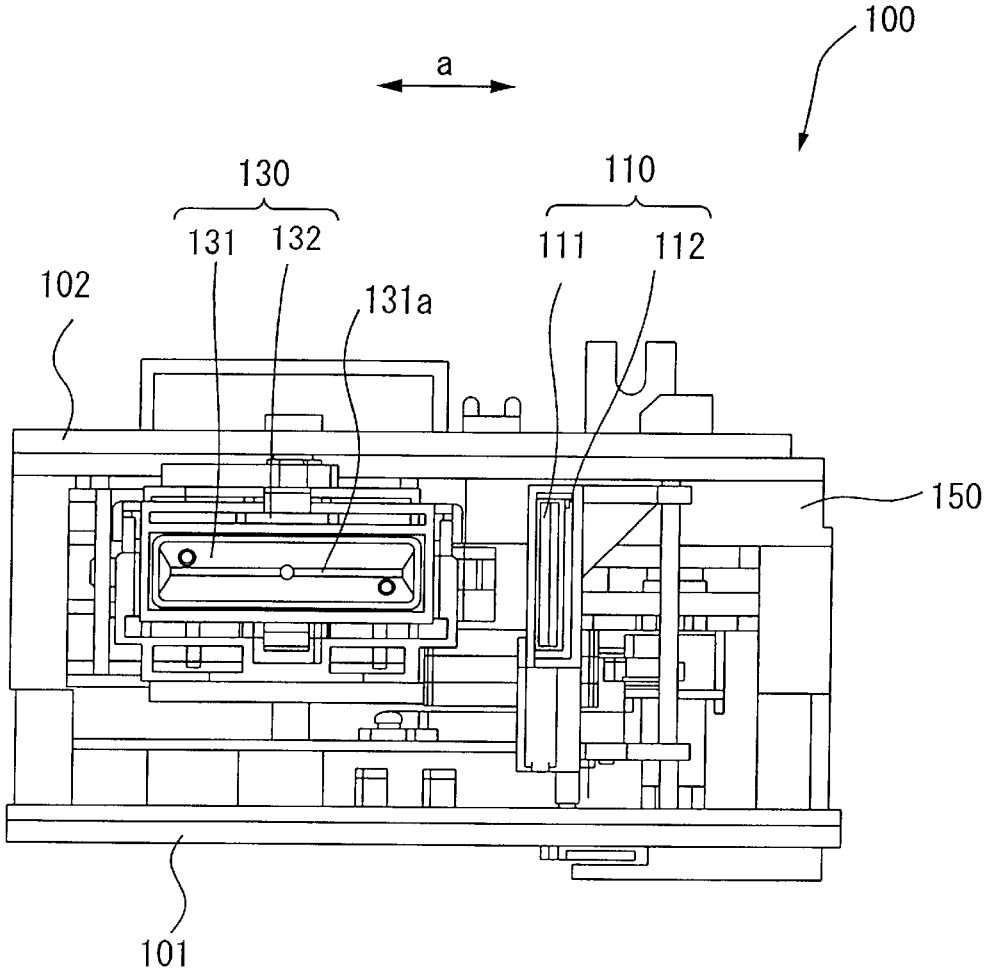
FIG. 2 is a plan view showing a head jetting property maintenance device being assembled into a unit, which is a first embodiment of the invention.

FIG. 1 is a perspective view showing an ink jet printer, which is one form of the recording apparatus according to an embodiment of the invention. FIG. 2 is a plan view showing a head jetting property maintenance device being assembled into a unit, which is a first embodiment of the invention.

Figure 3:
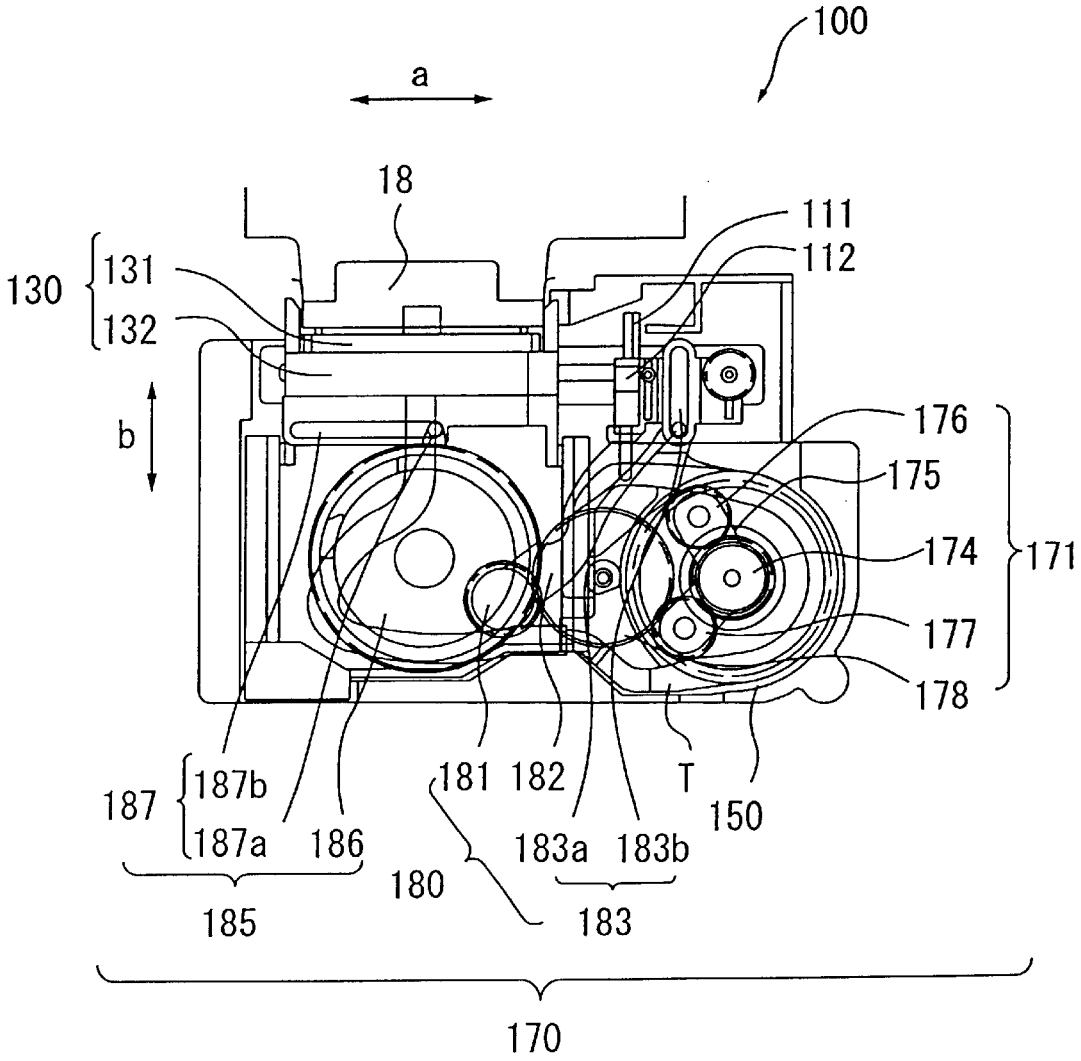
FIG. 3 is a side view showing the FIG. 2 head jetting property maintenance device.

FIG. 3 is a side view showing the FIG. 1 head jetting property maintenance device. The ink jet printer shown in FIG. 1, is a large type printer capable of printing on a printing sheet which is relatively large in size, such as a sheet of 594 mm width (A1 size in JIS standard) or a sheet of 728 mm width (B1 size in JIS standard).

In the ink jet printer, a sheet supply part 11, a recording part 12 and a sheet discharge part 13 are disposed from upper part thereof obliquely downwards to the front part of the printer, in this order. A printing sheet is subjected to a predetermined printing operation during its traveling from the sheet supply part 11 through the recording part 12 to the sheet discharge part 13 and discharged outside. A sheet transporting path 14 located in an area in which the printing operation is performed is slanted off the horizontal plane, e.g., by 65°. A nozzle forming surface of a printing head (recording head) 18 mounted on a carriage 17 which is reciprocatively moved in the main scan direction with the aid of a driving belt 15 is also slanted off the horizontal plane, e.g., by 65° so as to be in parallel with the sheet transporting path 14.

A head jetting property maintenance device 100 for maintaining an ink jetting property of the printing head 18 is disposed at a position being used as a home position of the carriage 17. A process for maintaining the ink jetting property of the printing head 18 is carried out by the head jetting property device 100 when the carriage 17 is in the home position.

The head jetting property maintenance device 100, as shown in FIGS. 2 and 3, is constituted by a wiping device 110, which wipes the nozzle forming surface according to the necessity in the longitudinal direction, i.e., the sub-scan direction as indicated by an arrow "a" in the figure; a capping device 130, which is pressed against the nozzle forming surface of the printing head 18 to seal the nozzle orifices in a non-print mode; a sucking device 150, which forcibly sucks ink and discharges it to remove the clogging of the nozzle orifices and air bubbles having entered into the ink; and a driving device 170 which is provided for driving the wiping device 110, the capping device 130 and the sucking device 150. These devices are disposed between two side frames 101 and 102 and assembled into a unit shaped like a box.

The wiping device 110 and the capping device 130 are disposed side by side in the sub-scan direction of the printing head 18. The sucking device 150 is disposed substantially under the wiping device 110. The driving device 170 is disposed so as to allow the wiping device 110, the capping device 130 and the sucking device 150 to operate in an interlocking manner. Specifically, the driving device 170 moves the wiping device 110 in the longitudinal direction as indicated by the arrow "a" in FIGS. 2 and 3, and moves the capping device 130 in the vertical direction as indicated by an arrow "b" in FIG. 3 to thereby operate the sucking device 150.

The wiping device 110 includes a wiper 111 and a wiper holder 112 as shown in FIGS. 2 and 3. The wiper 111 is made of rubber and takes a shape of a substantially rectangular and flat plate. The tip end of the wiper rubs the nozzle forming surface of the printing head 18. With this arrangement, the wiper 111 wipes out ink attached to the nozzle forming surface. The wiper 111 may be made of felt or plastic depending on the kind of the ink used.

The wiper holder 112 is made of plastic and takes a substantially rectangular and flat plate shape. The wiper holder 112 holds the wiper 111 in a state that the tip end of the wiper protrudes from the upper end of the wiper holder. In this state, the wiper holder is moved in the longitudinal direction as indicated by the arrow "a" in FIGS. 2 and 3, by a wiper moving device 180 which forms the driving device 170 to be described later.

The capping device 130 includes a cap 131 and a cap holder 132 as shown in FIGS. 2 and 3. The cap 131 is made of rubber and is substantially rectangular parallelepiped in shape. A recess 131*a* formed in an upper part of the cap is pressed against the nozzle forming surface of the printing head 18. With this mechanical arrangement, the capping device 130 seals the nozzle orifices.

The cap holder 132 is made of plastic and is substantially rectangular parallelepiped in shape. The cap holder 132 holds the cap 131 in a state that the upper edge of the cap protrudes from the upper surface of the cap holder. In this state, the cap holder 132 is moved in the vertical direction as indicated by the arrow "b" in FIG. 3, by a cap moving device 185 which forms the driving device 170 to be described later.

The sucking device 150 is a normal pulsation pump, and successively presses over a predetermined range a tube T connected to the cap 131, by a plurality of rollers arrayed at fixed intervals in a rotational direction thereof to thereby force the air out of the tube. In this way, the sucking device forcibly sucks the ink in the printing head 18 and discharges it outside. By so doing, the sucking device 150 removes the clogging of the nozzle orifices and air bubbles having entered into the ink.

Figure 4:
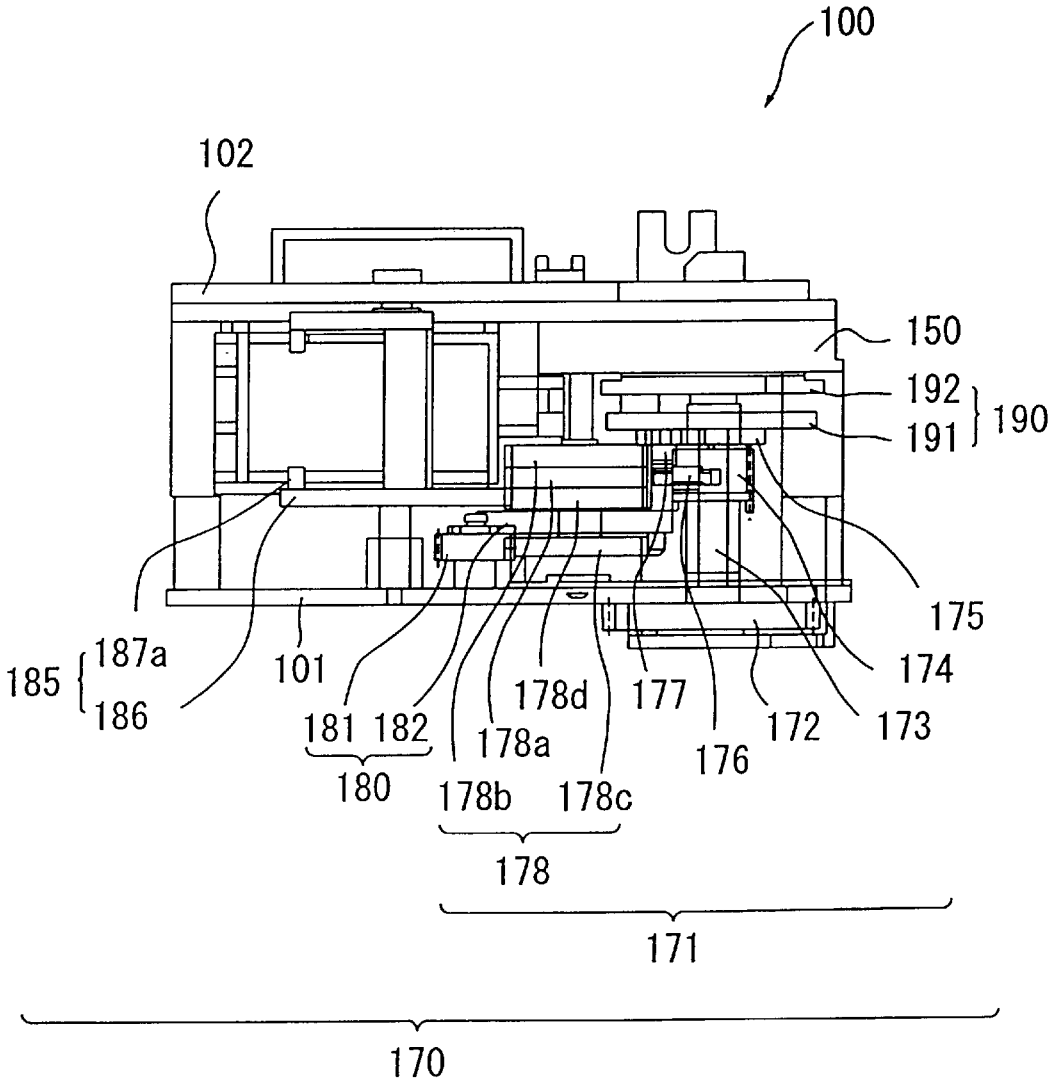
FIG. 4 is a plan view showing the FIG. 2 head jetting property maintenance device 100 in a state that a wiping device and a capping device are removed.

The driving device 170 includes a normal/reverse rotation switching device 171, the wiper moving device 180, the cap moving device 185 and a pump driving device 190, as shown in FIG. 3 and FIG. 4 which are illustrated in a state that the wiping device 110 and the capping device 130 are removed. The normal/reverse rotation switching device 171 includes a drive force transmission gear 172 disposed protruding from the side frame 101, a sun gear 174 disposed coaxially with a shaft 173 of the drive force transmission gear 172, a normal turn planet gear 176 and a reverse turn planet gear 177, which are mounted on a planetary lever 175, shaped like L, so as to mesh with the sun gear 174, and partially toothless gears 178 that may be in mesh with the planet gears 176 and 177.

The partially toothless gears 178 constitutes a gear train consisting of first to fourth partially toothless gears 178*a*, 178*b*, 178*c* and 178*d*. Those toothless gears respectively mesh with the normal turn planet gear 176, the reverse turn planet gear 177, a wiper gear 181 forming a wiper moving device 180 to be described later, and a cap gear 186 forming the cap moving device 185.

The drive force transmission gear 172 transmits a rotational force of a motor as a rotating device (not shown) Either the normal turn planet gear 176 or the reverse turn planet gear 177 fits together with the first partially toothless gear 178*a* or the second partially toothless gear 178*b* through the planetary gear 175, depending on the rotational direction of the drive force transmission gear 172, i.e., the rotational direction of the motor, thereby transmitting the rotational force through the sun gear 174.

The wiper moving device 180 includes the wiper gear 181, a lever 182 and a cam mechanism 183. The wiper gear 181 is disposed so as to mesh with the third partially toothless gear 178*c*. The cam mechanism 183 is made up of a pin 183*a* integrally formed on one end of the lever 182 and a groove 183*b* formed in the wiper holder 112. The one end of the lever 182 is engaged and stopped when the pin 183*a* is inserted into the groove 183*b*, and the other end of the same is disposed coaxially with the wiper gear 181.

The cap moving device 185 includes the cap gear 186 and a cam mechanism 187. The cap gear 186 is disposed so as to mesh with the fourth partially toothless gear 178*d*. The cam mechanism 187 is made up of a pin 187*a* integrally formed on an outer peripheral surface of the cap gear 186 and a groove 187*b* formed in the cap holder 132, into which the pin 187*a* is inserted.

The pump driving device 190 includes a pump transmission wheel 191 disposed coaxially with the shaft 173 of the drive force transmission gear 172 and a pump wheel 192. The pump transmission wheel 191 turns the pump wheel 192 after a time lag is set up in operation among the sucking device 150, the wiping device 110 and the capping device 130.

With this mechanical arrangement, the drive force of the motor is transmitted from the drive force transmission gear 172 through the sun gear 174 to the first partially toothless gear 178*a* or the second partially toothless gear 178*b*, via the normal turn planet gear 176 or the reverse turn planet gear 177, which will mesh with the sun gear through the turning of the planetary gear 175. Further, the drive force is transmitted through the third partially toothless gear 178*c* and the fourth partially toothless gear 178*d* to the wiper gear 181 and the cap gear 186, and transmitted through the pump transmission wheel 191 to the pump wheel 192. As a result, the wiping device 110 is moved in the longitudinal direction, the capping device 130 is moved in the vertical direction, and the sucking device 150 is operated.

The overall operation of the thus constructed head jetting property maintenance device 100, which includes the wiping device 110, the capping device 130, the sucking device 150 and the driving device 170, will be described with reference to FIGS. 5 through 17. Of those figures, FIG. 5 is a time chart exemplarily showing an operation of the head jetting property maintenance device 100, FIGS. 6 through 11 are diagrams showing the operation of the same when the motor rotates in the normal direction, FIGS. 12 through 17 are diagrams showing the operation when the motor turns in the reverse direction.

Figure 5:
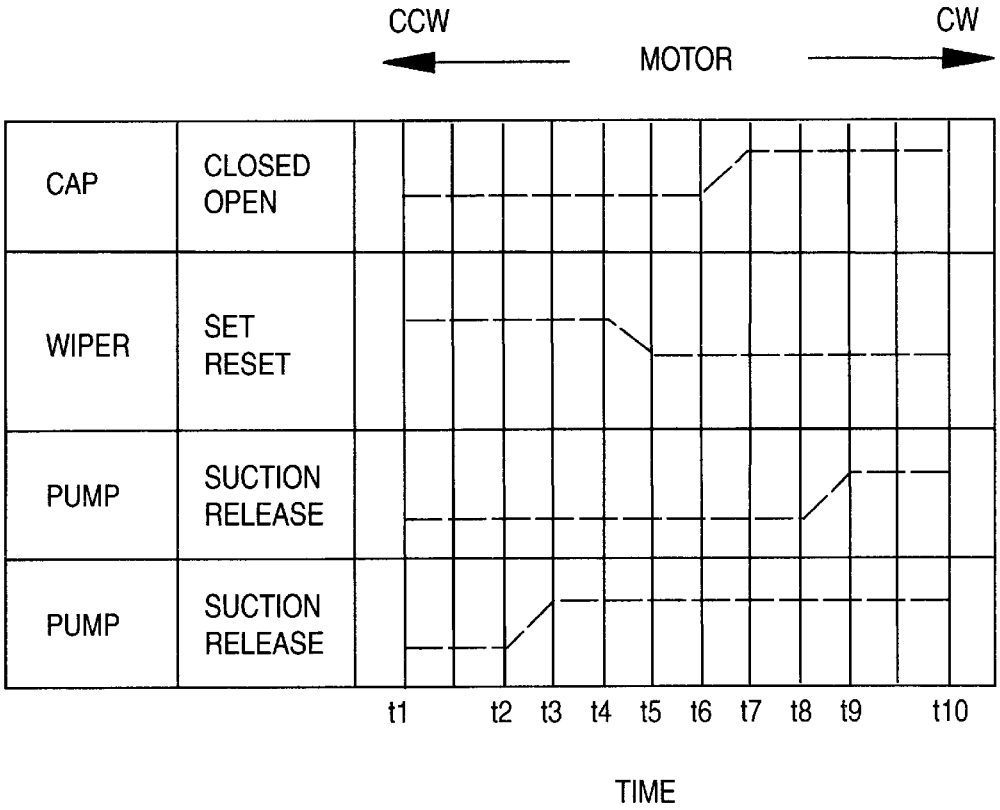
FIG. 5 is a time chart showing an operation of the FIG. 2 head jetting property maintenance device.
Figure 6:
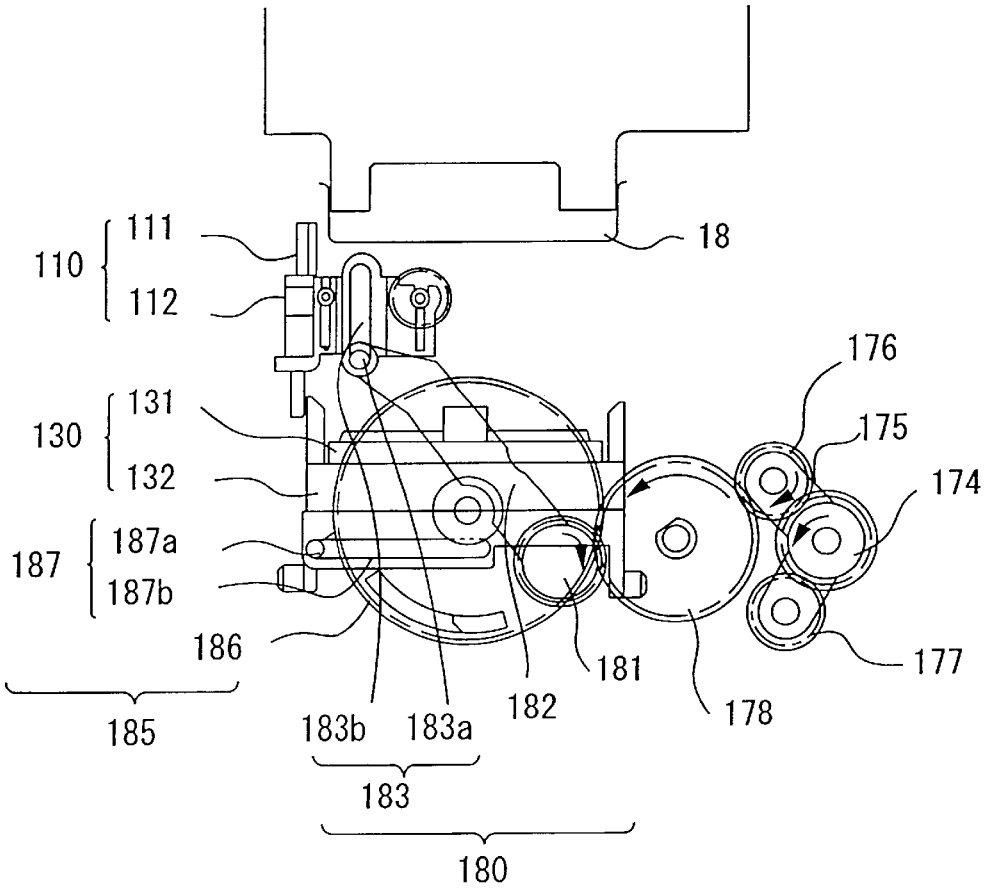
FIG. 6 is a first diagram showing the operation of the FIG. 2 head jetting property maintenance device.
Figure 7:
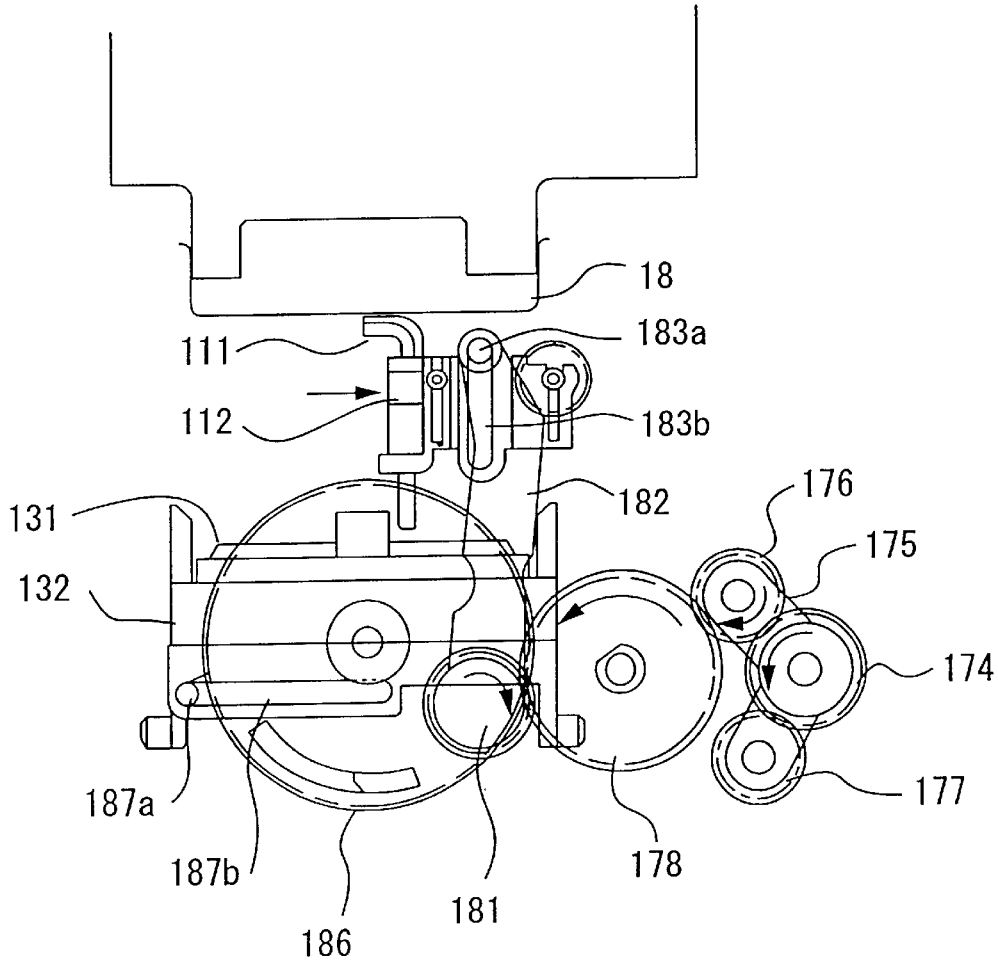
FIG. 7 is a second diagram showing the operation of the FIG. 2 head jetting property maintenance device.

In the normal rotation in FIG. 5, the capping device 130 is located at the bottom end position as shown in FIG. 6, and the cap 131 is in an "open" state, viz., the printing head is not sealed with the cap. Also in this state, the wiping device 110 is located at the left-most end position in the figure, and the wiper 111 is in a "set" state, viz., the wiper may perform the wiping operation to the right direction in the figure. The roller of the pump as the sucking device 150 is in a "release" state in connection with the tube, viz., the sucking operation is not being performed (start time point t1).

From this state, the motor rotates in the normal rotation direction to thereby turn the planetary gear 175, and the normal turn planet gear 176 fits together with the first partially toothless gear 178*a*. In turn, the rotational force of the sun gear 174 is transmitted from the normal turn planet gear 176 to the first partially toothless gear 178*a*, and further transmitted from the third partially toothless gear 178*c* to the wiper gear 181. As a result, the lever 182 is turned and the wiper holder 112 starts to move to the right direction in the figure (time point t4). And, the wiper 111 wipes the nozzle forming surface of the printing head 18.

Figure 8:
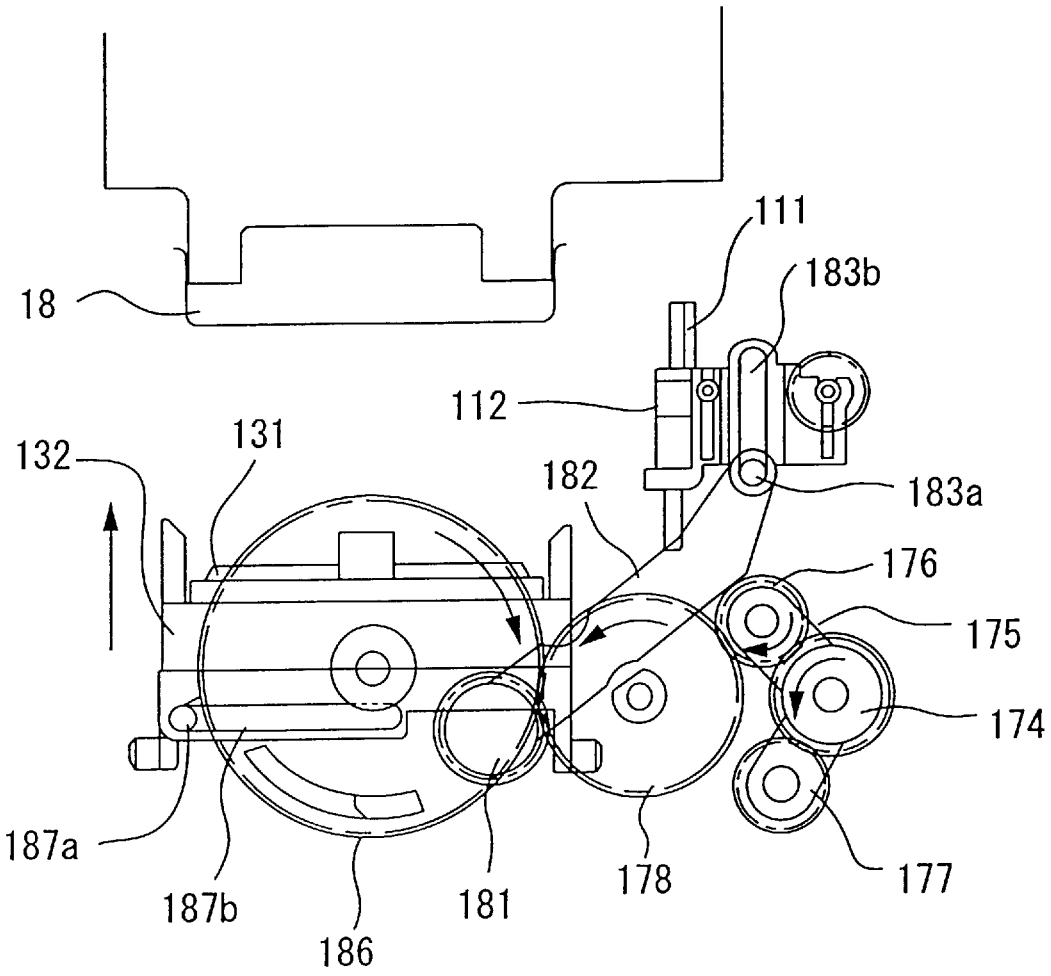
FIG. 8 is a third diagram showing the operation of the FIG. 2 head jetting property maintenance device.

Further, the wiper gear 181 reaches a toothless part of the third partially toothless gear 178*c* and is disengaged therefrom, and the wiper gear 181 runs idle. As a result, the wiper holder 112 stops its movement as shown in FIG. 8. In this state, the wiping device 110 is positioned at the right-most end position in the figure, and the wiper 111 is in a "reset" state, viz., the wiping operation to the right direction in the figure ends (time point t5).

During the time period t1 to t5, the fourth partially toothless gear 178*d* is also turned; however, the drive force is not transmitted to the cap gear 186 because of the presence of the toothless part of the fourth toothless gear. Accordingly, the cap 131 remains at the lower end position.

Figure 9:
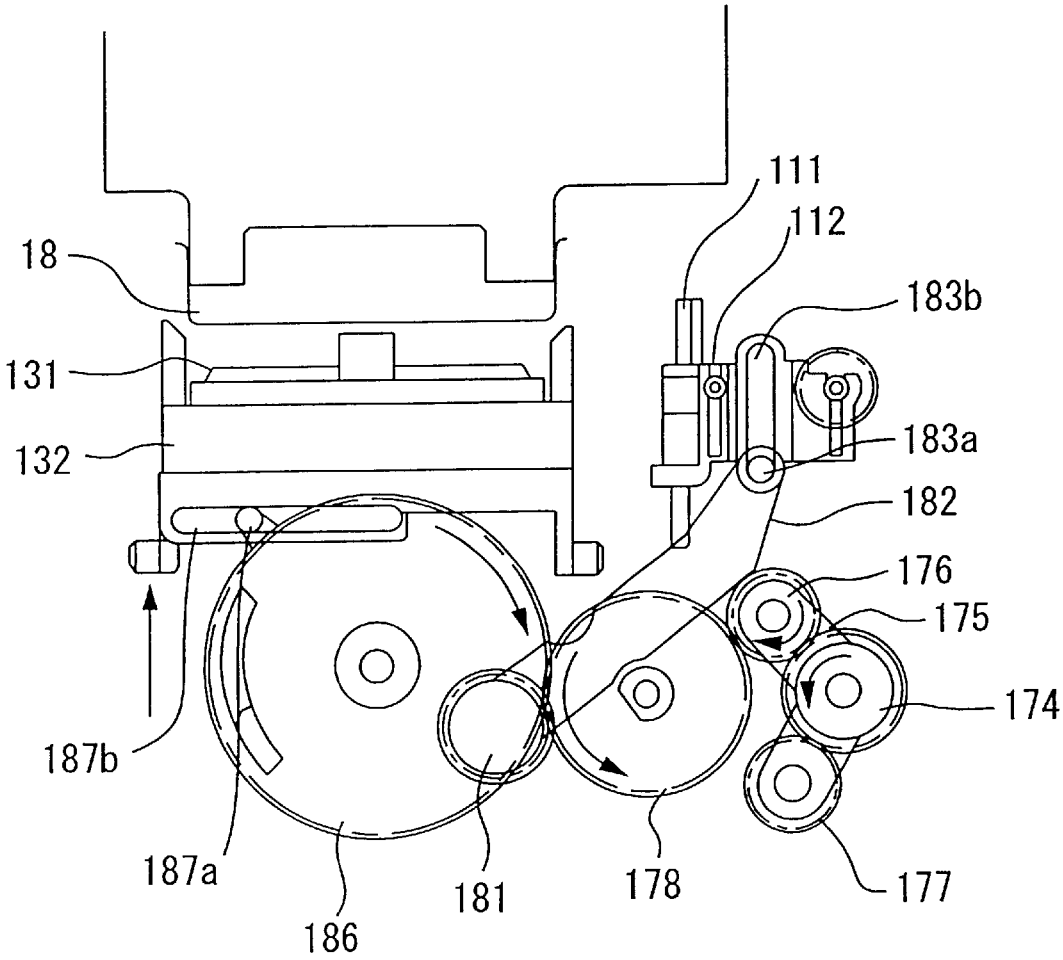
FIG. 9 is a fourth diagram showing the operation of the FIG. 2 head jetting property maintenance device.
Figure 10:
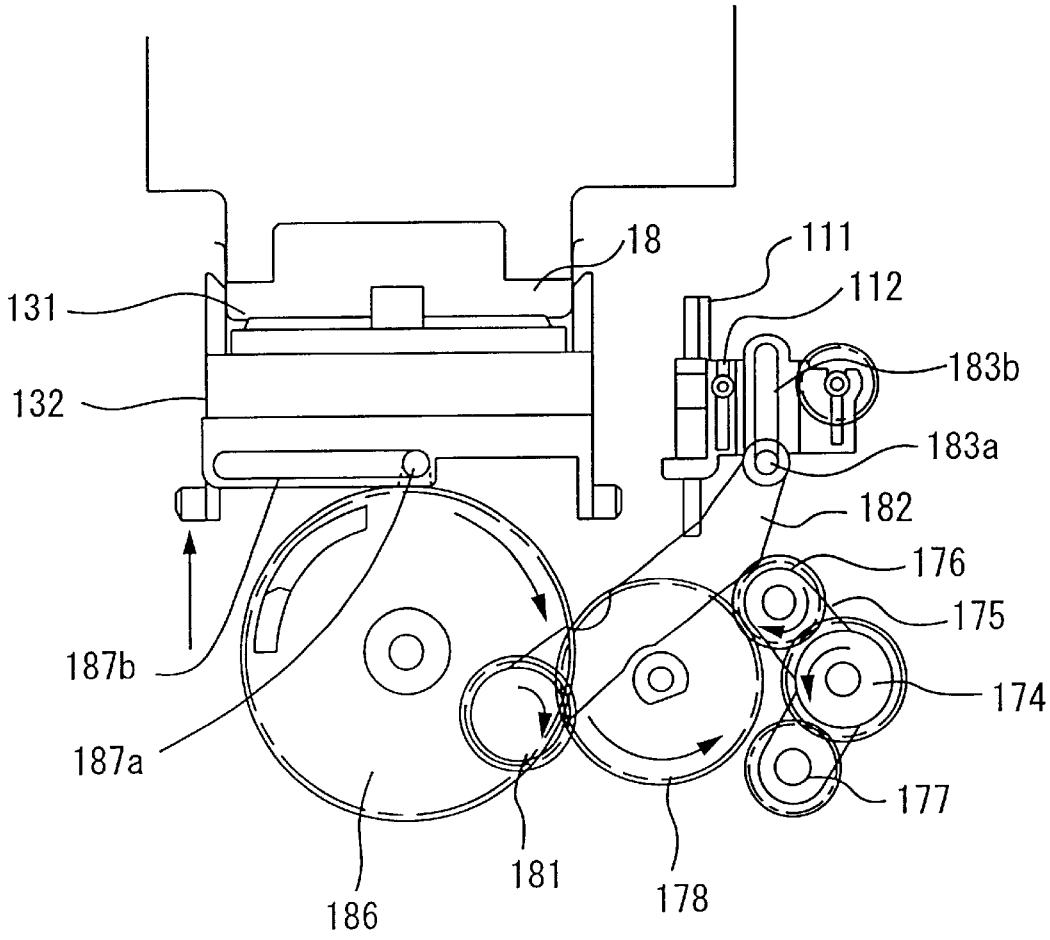
FIG. 10 is a fifth diagram showing the operation of the FIG. 2 head jetting property maintenance device.

Further, the motor rotates in the normal rotation direction and the drive force transmission gear 172 is turned, and the rotational force of the sun gear 174 is transmitted from the normal turn planet gear 176 to the first partially toothless gear 178*a*, and further transmitted from the fourth partially toothless gear 178*d* to the cap gear 186, whereby the cap holder 132 starts to move upwards (time point t6), as shown in FIG. 8. The cap 131 makes an approach to the printing head 18 as shown in FIG. 9, and then the cap 131 seals the nozzle forming surface of the printing head 18 as shown in FIG. 10.

Figure 11:
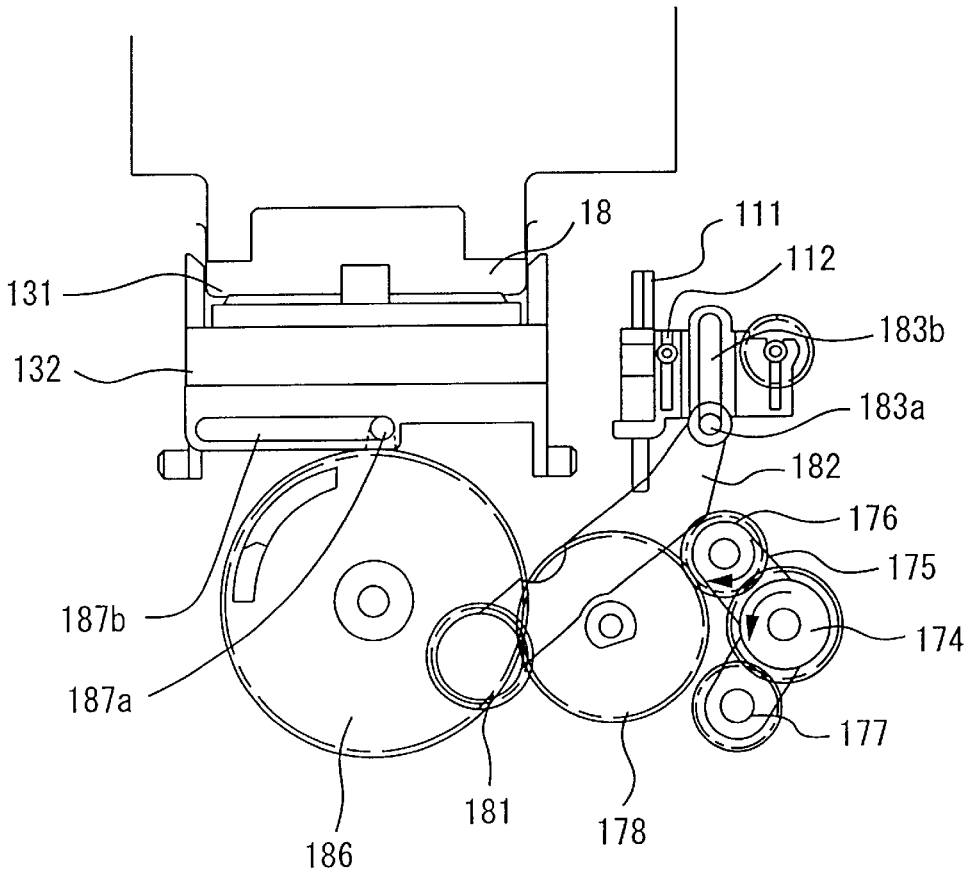
FIG. 11 is a sixth diagram showing the operation of the FIG. 2 head jetting property maintenance device.

Then, the cap gear 186 reaches a toothless part of the fourth partially toothless gear 178*d* and is disengaged therefrom, and the cap gear 186 runs idle. As a result, the cap holder 132 stops its rising as shown in FIG. 11. At this time, the capping device 130 is positioned at the top end position, and the cap 131 is in a "close" state, viz., capping state (time point t7).

From this state, the motor is further in the normal rotation direction and the drive force transmission gear 172 is turned, and then the pump wheel 192 starts to turn with the aid of the pump transmission wheel 191, and the sucking device 150 is operated. At this time, the roller of the pump is in a "pinching" state in connection with the tube, viz., the sucking operation is being performed (time points t8 and t9) As seen from above, the drive force is not transmitted to the pump when the wiping device 110 and the capping device 130 are in operation.

Figure 12:
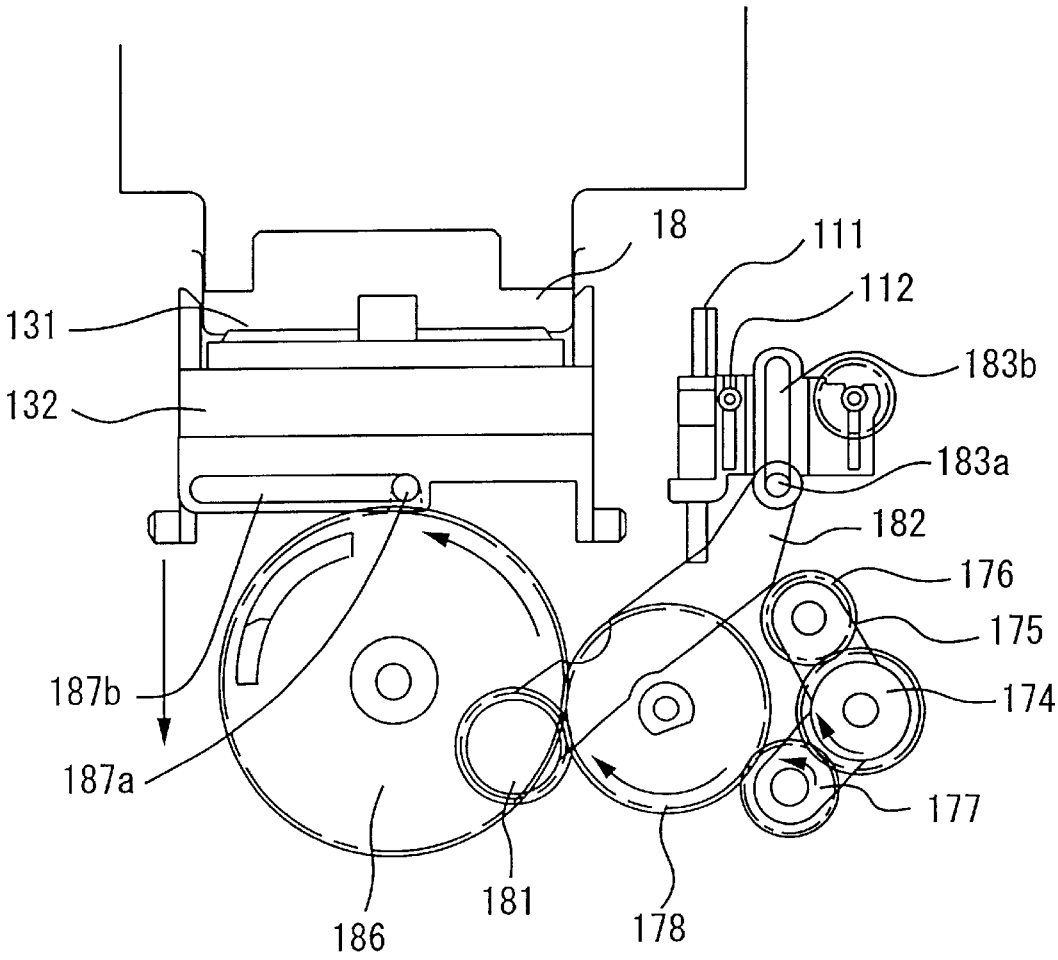
FIG. 12 is a seventh diagram showing the operation of the FIG. 2 head jetting property maintenance device.

In the "reverse rotation" in FIG. 5, the capping device 130 is located at the top end position as shown in FIG. 12, and the cap 131 is in a "close" state, viz., the cap is capping the printing head. The wiping device 110 is positioned at the right-most end position in the figure, and the wiper 111 is in a "reset" state, viz., the wiper may perform the wiping operation to the left direction in the figure. The roller of the pump as the sucking device 150 is in the "pinching" state in connection with the tube, viz., the sucking operation is being performed (time point 10).

Figure 13:
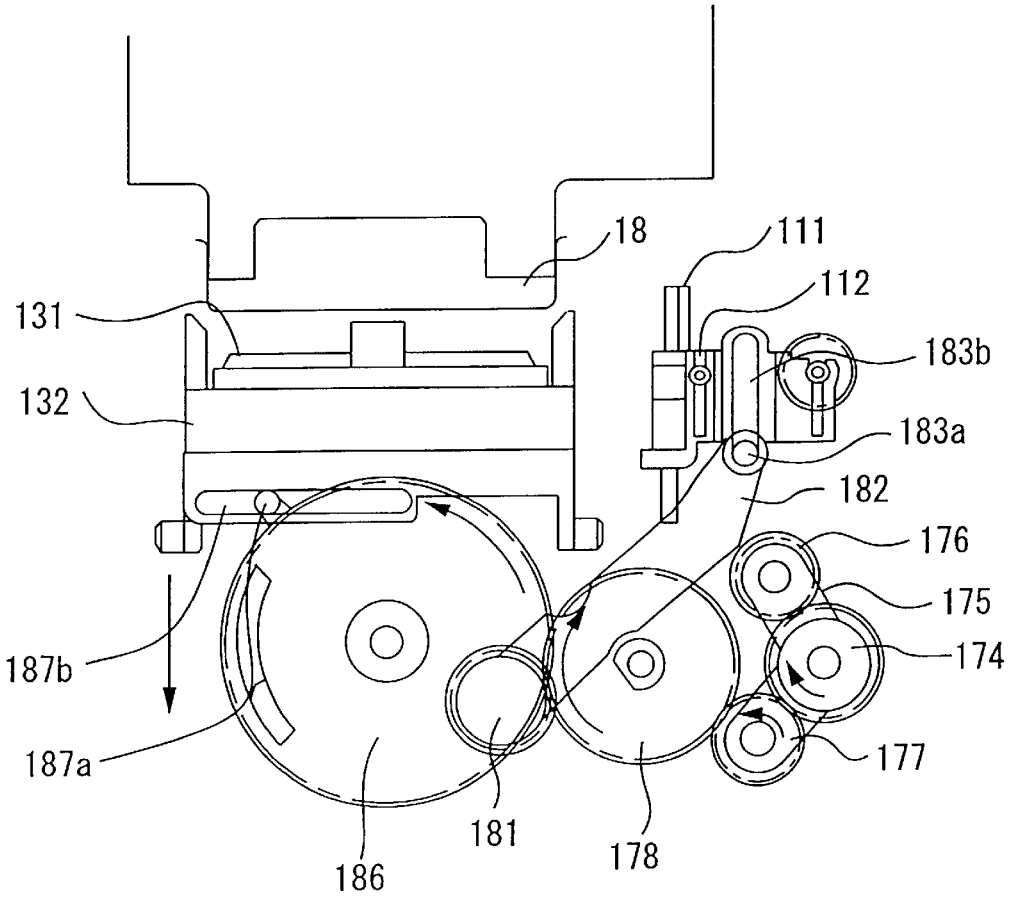
FIG. 13 is an eighth diagram showing the operation of the FIG. 2 head jetting property maintenance device.
Figure 14:
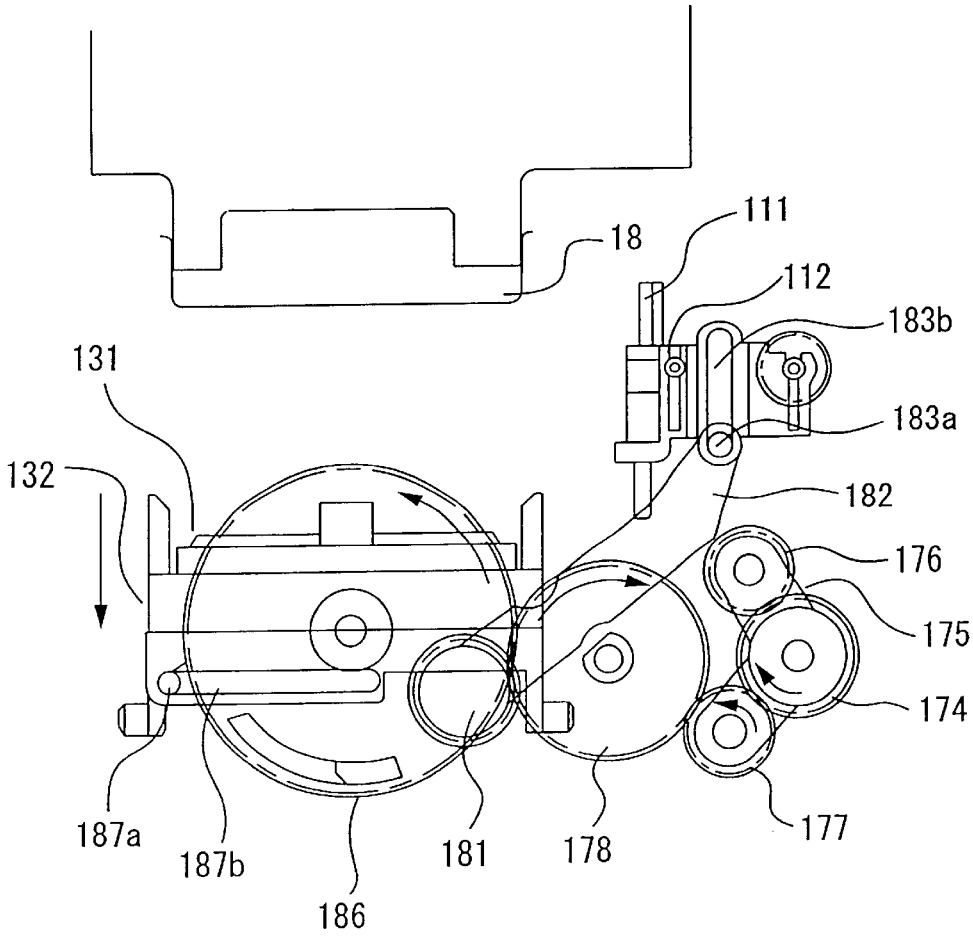
FIG. 14 is a ninth diagram showing the operation of the FIG. 2 head jetting property maintenance device.

From this state, the motor rotates in the reverse rotation direction to thereby turn the planetary gear 175, and then the reverse turn planet gear 177 fits together with the second partially toothless gear 178*b*, as shown in FIG. 12. The rotational force of the sun gear 174 is transmitted from the reverse turn planet gear 177 to the second partially toothless gear 178*b*, and further transmitted from the fourth partially toothless gear 178*d* to the cap gear 186. And, the cap holder 132 starts to move downwards by the cam mechanism 187 (time point t7). Then, the cap 131 gradually moves away from the nozzle forming surface of the printing head 18, as shown in FIGS. 13 and 14.

Figure 15:
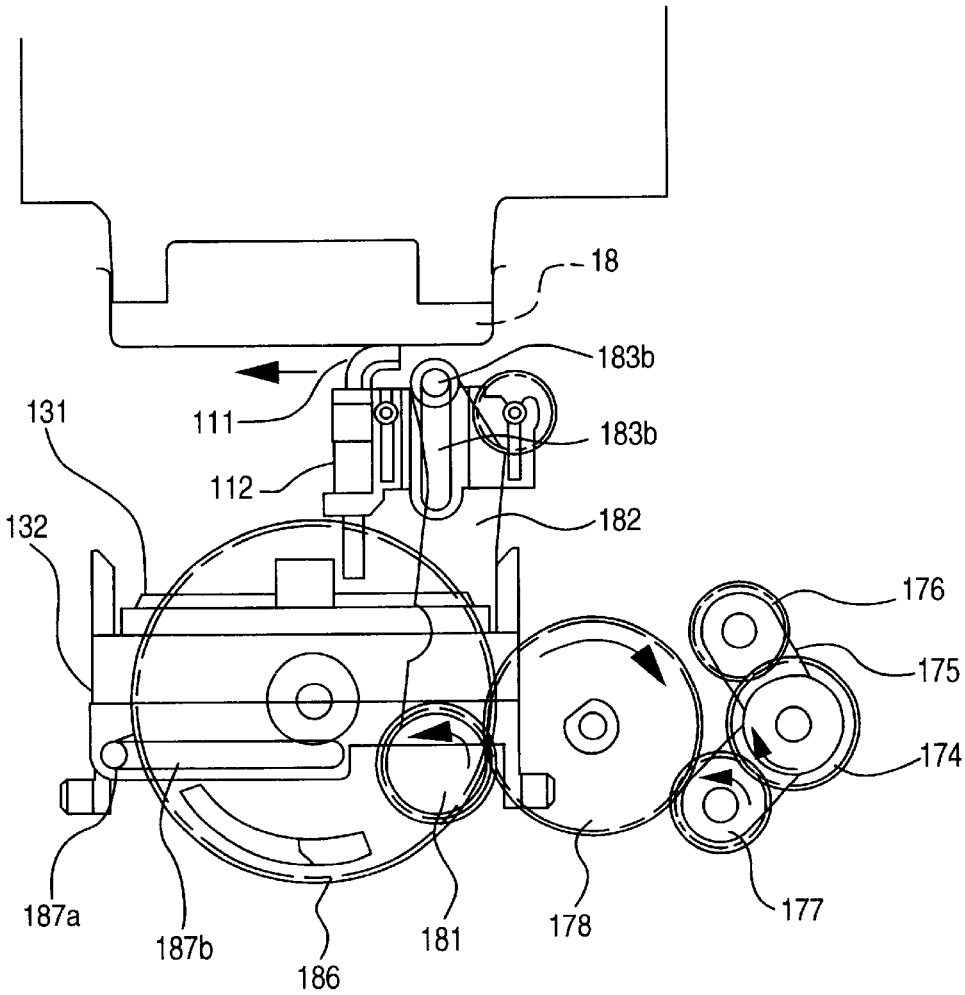
FIG. 15 is a tenth diagram showing the operation of the FIG. 2 head jetting property maintenance device.

When the cap gear 186 reaches the toothless part of the fourth partially toothless gear 178*d* and is disengaged from the toothless gear, the cap gear 186 runs idle, and the cap holder 132 stops its moving downwards as shown in FIG. 15. At this time, the capping device 130 is at the bottom end position, and the cap 131 is in the "open" state, viz., the cap is not sealing the printing head (time point t6).

Figure 16:
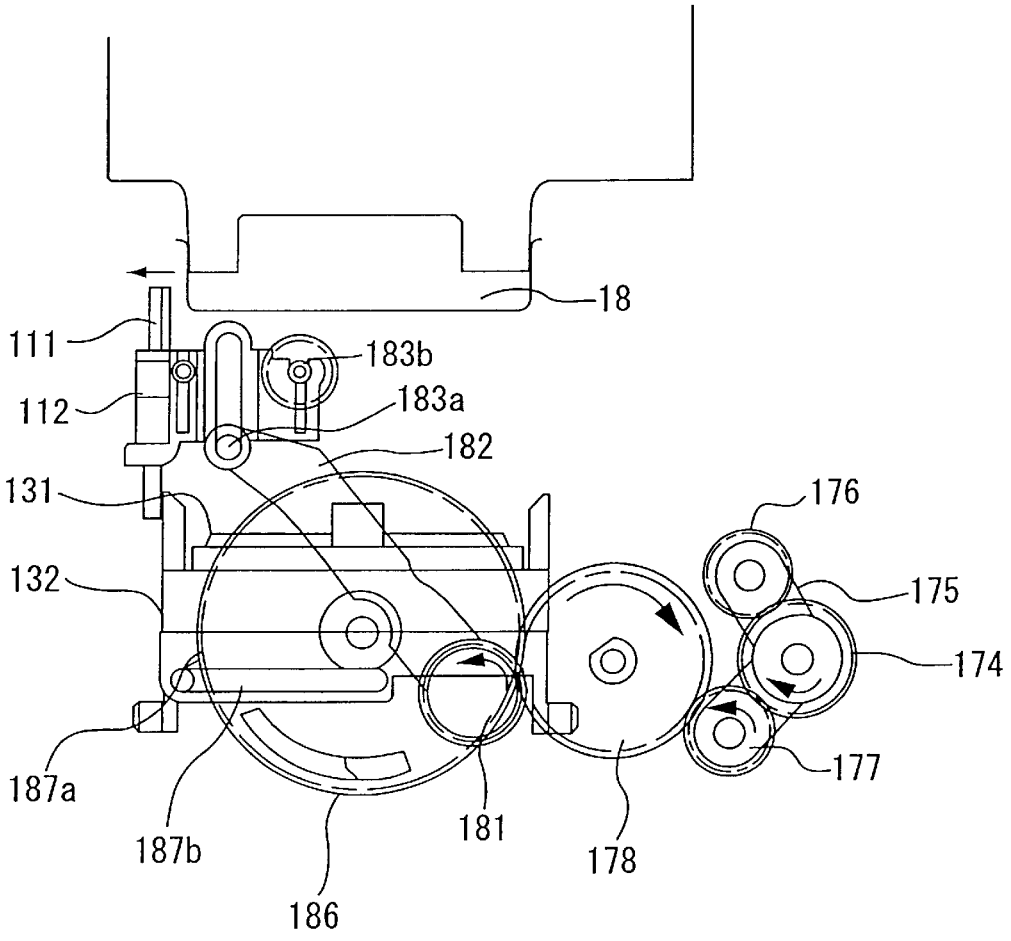
FIG. 16 is an eleventh diagram showing the operation of the FIG. 2 head jetting property maintenance device.

Further, when the motor rotates in the reverse rotation direction and the drive force transmission gear 172 is turned, the rotational force of the sun gear 174 is transmitted from the reverse turn planet gear 177 to the second partially toothless gear 178*b*, and further transmitted from the third partially toothless gear 178*c* to the wiper gear 181. And, the lever 182 is turned and the wiper holder 112 starts to move to the left direction in the figure by the cam mechanism 183 (time point 5), as shown in FIGS. 15 and 16. In this way, the wiper 111 wipes out the nozzle forming surface of the printing head 18.

Figure 17:
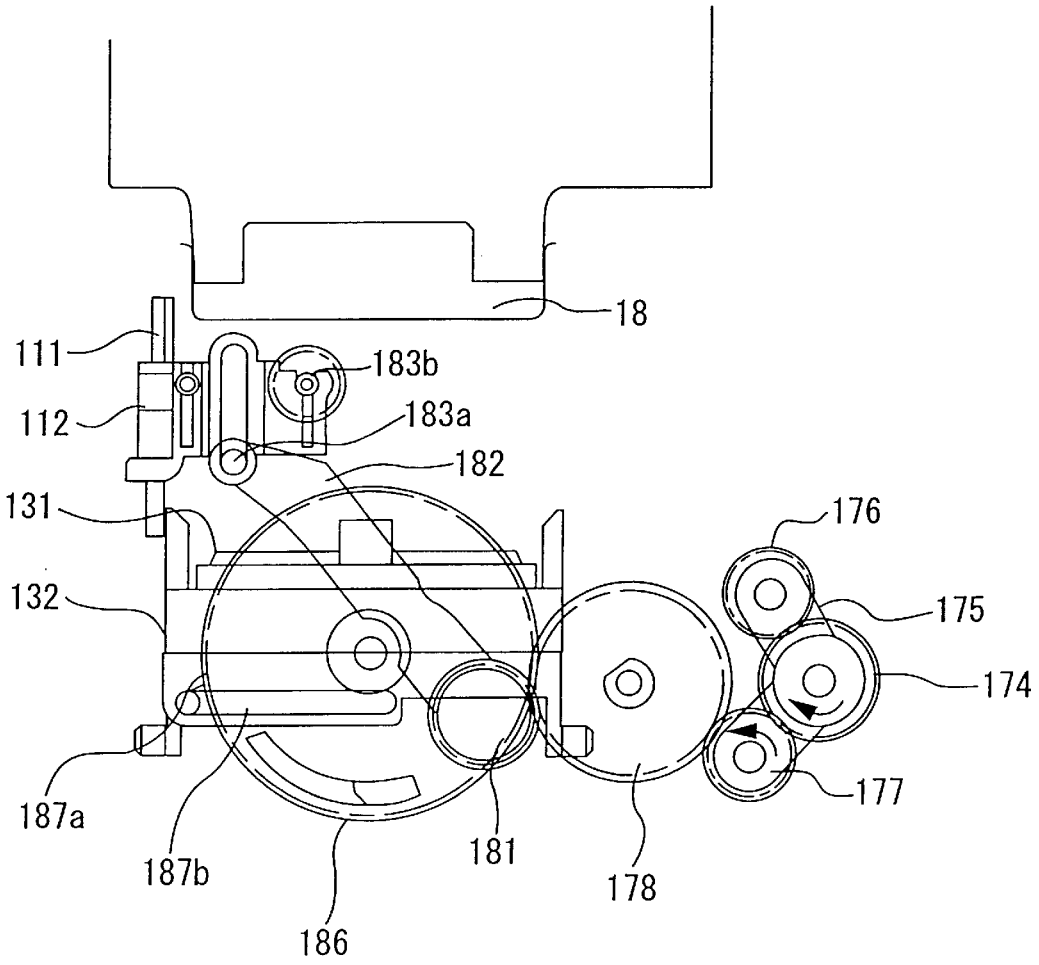
FIG. 17 is a twelfth diagram showing the operation of the FIG. 2 head jetting property maintenance device.

Further, the wiper gear 181 reaches the toothless part of the third partially toothless gear 178*c* and is disengaged from the toothless gear, and then the wiper gear 181 runs idle, and the wiper holder 112 stops moving, as shown in FIG. 17. In this state, the wiping device 110 is positioned at the left-most end position in the figure, and the wiper 111 is in the "reset" state, viz., the wiping operation to the left direction in the figure ends (time point t4).

From this state, the motor further rotates in the reverse rotation direction and the drive force transmission gear 172 is turned, and then the pump wheel 192 starts to turn with the aid of the pump transmission wheel 191, and the roller of the pump is in the "release" state with respect to the tube, viz., the sucking operation is not being performed, and the motor stops its rotating operation (time point t3 and t2). Thus, the drive force is not transmitted to the pump when the wiping device 110 and the capping device 130 are in operation.

In the above embodiment, the description has been made on the head jetting property maintenance device 100 having one capping device 130 and one sucking device 150. It should be understood that the invention is not limited to such, but may be applied to a head jetting property maintenance device having, for example, two capping devices 130 and two sucking devices 150. If so constructed, similar useful effects are also produced.

Further, the above embodiment has been described using the printer. However, it should be understood that the invention may be applied to devices each having a recording medium transporting/guiding part, such as facsimile machines and copying machines.

As seen from the foregoing description, in the head jetting property maintenance device of the first embodiment and the recording apparatus with the same, the cap of the capping device and the wiper of the wiping device are moved bidirectionally, viz., forwardly and reversely. Accordingly, the positions of the cap and wiper may be initialized easily. With this feature, the positions of the cap and the wiper are easily initialized. Therefore, in the invention, unlike the conventional device, there is no need that flags to detect the initializing positions of the cap and wiper are provided on cams for driving the cap and the wiper thereby effecting sensing them. Accordingly, the assembling and adjustment of the device are simplified, and the cost to manufacture the device is decreased.

Figure 18:
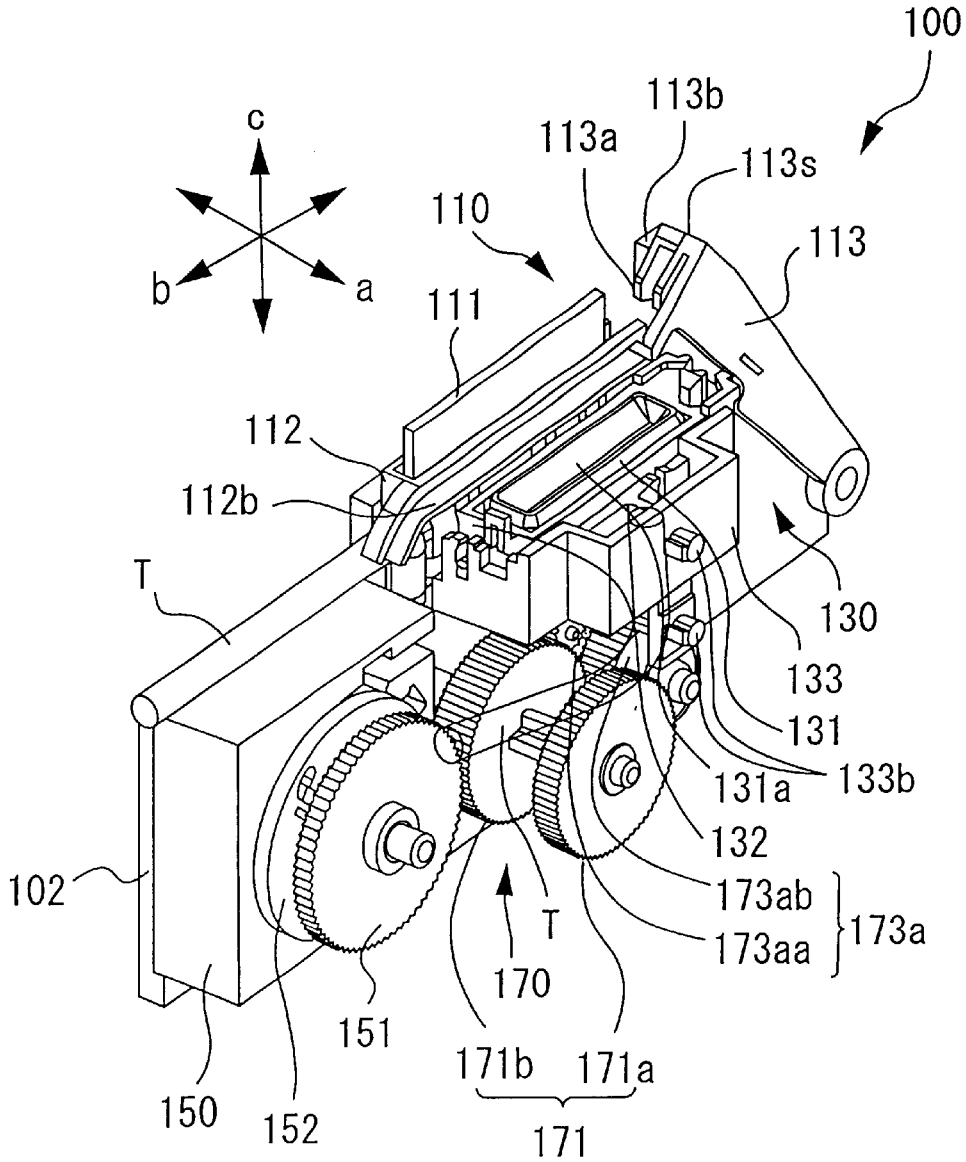
FIG. 18 is a perspective view showing a head jetting property maintenance device being assembled into a unit, which is a second embodiment of the invention.
Figure 19:
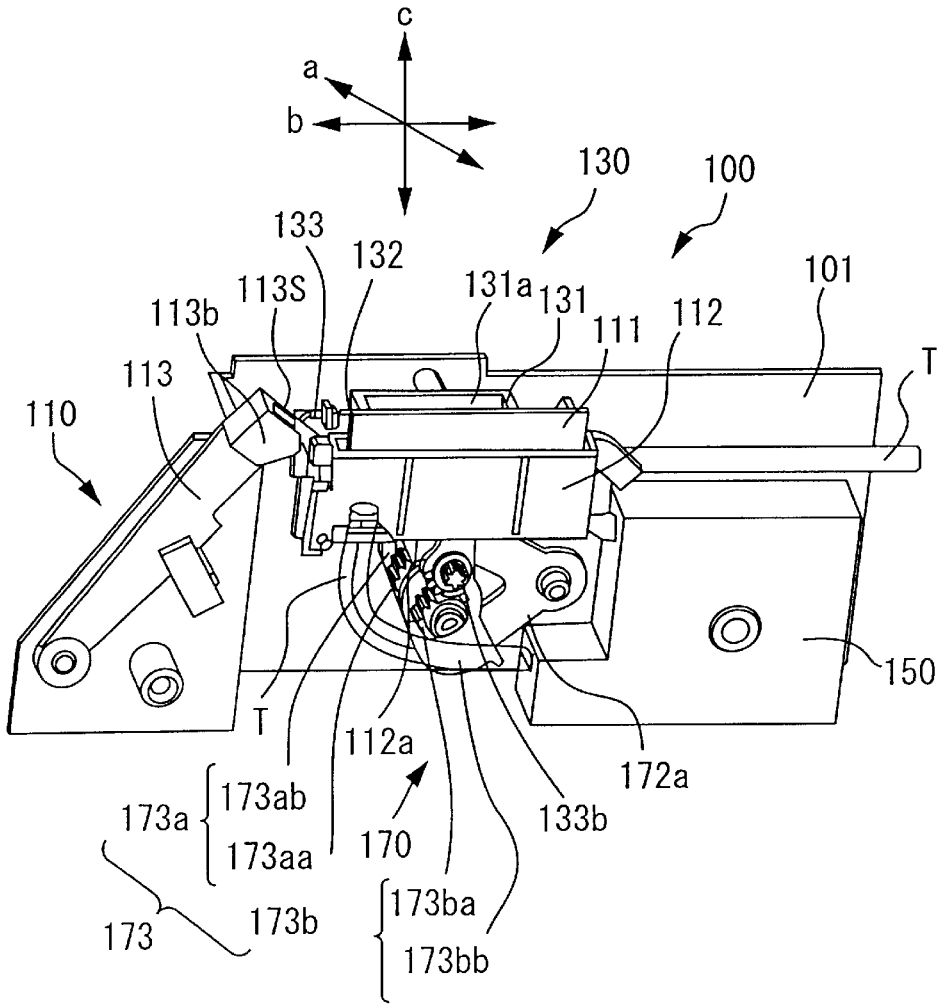
FIG. 19 is a perspective view showing the FIG. 18 head jetting property maintenance device as viewed from the direction opposite to that in FIG. 18.
Figure 20:
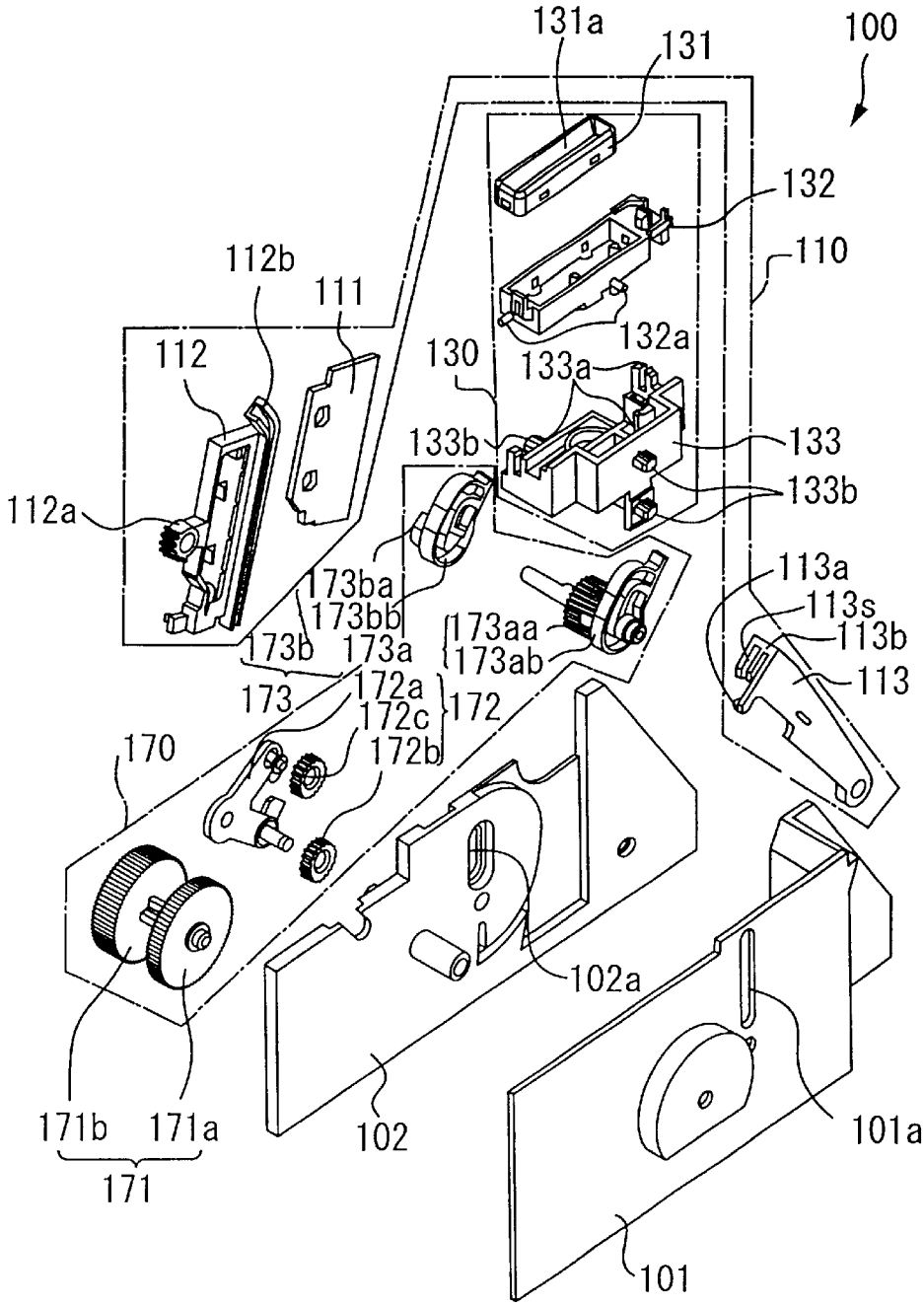
FIG. 20 is an exploded, perspective view showing the FIG. 18 head jetting property maintenance device.

FIG. 18 is a perspective view showing a construction of a head jetting property maintenance device being assembled into a unit, which is a second embodiment of the invention. FIG. 19 is a perspective view showing the FIG. 18 head jetting property maintenance device as viewed from the opposite side. FIG. 20 is an exploded, perspective view showing the FIG. 18 head jetting property maintenance device.

The head jetting property maintenance device 100 includes the wiping device 110, the capping device 130, sucking device 150 and the driving device 170 for driving those devices, as shown in FIGS. 18 to 20. In FIG. 18, one side frame 101 shown in FIG. 20 is omitted from the illustration to show an internal structure of the device. In FIG. 19, the other side frame 102 shown in FIG. 20 is omitted from the illustration to show the internal structure thereof. In FIG. 20, the sucking device 150 is omitted therefrom for the simplicity of the illustration.

The head jetting property maintenance device 100 is constituted by the wiping device 110, which wipes the nozzle forming surface according to the necessity in the main scan direction, i.e., lateral direction, of the printing head 18 as indicated by an arrow "a" in FIGS. 18 and 19; the capping device 130, which is pressed against the nozzle forming surface of the printing head 18 to seal the nozzle orifices in a non-print mode, the sucking device 150, which forcibly sucks ink and discharges it to remove the clogging of the nozzle orifices and air bubbles having entered into the ink; and the driving device 170 is provided for driving the wiping device 110 and the capping device 130 so as to position those devices at predetermined positions, and driving the sucking device 150. These are disposed between two side frames 101 and 102 and assembled into a unit like a box.

The wiping device 110 and the capping device 130 are disposed side by side in the main scan direction of the printing bead 18. The sucking device 150 is disposed on the side of the wiping device 110 and the capping device 130 as viewed in the sub-scan direction as indicated by an arrow "b" in FIGS. 18 and 19. The driving device 170 is disposed so as to allow the wiping device 110, the capping device 130 and the sucking device 150 to operate in an interlocking manner. Specifically, the driving device 170 turns the wiping device 110 in the sub-scan direction, and moves the capping device 130 together with the wiping device 110 in the vertical direction as indicated by an arrow "c" in FIGS. 18 and 19 to thereby operate the sucking device 150.

The wiping device 110 includes the wiper 111, the wiper holder 112 and a wiper cleaner 113 as shown in FIGS. 18 to 20. The wiper 111 is made of rubber and takes a shape of a substantially rectangular and flat plate. The tip end of the wiper rubs the nozzle forming surface of the printing head 18. With this arrangement, the wiper 111 wipes out ink attached to the nozzle forming surface. The wiper 111 may be made of felt or plastic depending on the kind of the ink used.

The wiper holder 112 is made of plastic and takes a substantially rectangular and flat plate shape. The wiper holder 112 holds the wiper 111 in a state that the tip end of the wiper protrudes from the upper end of the wiper holder. In this state, the wiper holder turns about a partially toothless gear 112*a* provided at the lower end thereof and rotatably supported by a second cap holder 133 of the capping device 130 to be described later, in the sub-scan direction. With this mechanical arrangement, the wiper holder 112 may put the wiper 111 at an upper position when it is used, and may put the same at a lower position when it is not used.

The wiper cleaner 113 is made of plastic and shaped like a blade. A wiper cleaner operates in a manner that a guide pin 113*a* provided at one end of the wiper cleaner 113 is guided by a guide groove 112*b* formed in the wiper holder 112, and the wiper cleaner 113 turns about the other end thereof rotatably supported by the side frame 101, and an ink scriber 113*b*, shaped like "U" in cross section, and provided on the one end thereof, rubs the wiper 111 while holding the wiper therebetween. Thus, the wiper cleaner 113 removes the ink attaching to the wiper 111.

The capping device 130 includes the cap 131, a first cap holder 132 and the second cap holder 133, as shown in FIGS. 18 to 20. The cap 131 is made of rubber and is substantially rectangular parallelepiped in shape. The recess 131*a* formed in an upper part of the cap is pressed against the nozzle forming surface of the printing head 18. With this mechanical arrangement, the capping device 130 seals the nozzle orifices.

The first cap holder 132 is made of plastic and is substantially rectangular parallelepiped in shape. The first cap holder 132 holds the cap 131 in a state that the upper edge of the cap 131 protrudes from the upper surface of the cap holder 132. A spring (not shown) is interposed between the first cap holder 132 and the second cap holder 133. Projections 132*a* provided on the side surfaces of the first cap holder 132 are engaged with the pawls 133*a* of the second cap holder 133 and stopped. In this state, the first cap holder 132 is minutely movable in all directions. With this mechanical arrangement, the first cap holder 132 is able to press the cap 131 against the nozzle forming surface of the printing head 18 such that the upper edge of the cap is aligned with the nozzle forming surface. As a result, those are made to be in close contact with each other.

The second cap holder 133 is made of plastic and is substantially rectangular parallelepiped in shape. The second cap holder 133 operates such that it holds the first cap holder 132 on the upper end face thereof, guide pins 133*b* provided on the side faces of the second cap holder are guided by guide grooves 101*a* and 102*a* respectively formed in the side frames 101 and 102, and the second cap holder 133 moves together with the wiper 111 and the wiper holder 112 in the vertical direction. With this arrangement, the cap 131 is positioned and fixed at an upper position when it is in use, and positioned and fixed at a lower position when it is not in use with the movement of the second cap holder 133.

The sucking device 150 is a normal pulsation pump, and successively presses over a predetermined range of a tube T connected to the cap 131, by a plurality of rollers arrayed at fixed intervals in a rotational direction thereof to thereby force the air out of the tube. In this way, the sucking device 150 forcibly sucks the ink in the printing head 18 and discharges it outside. By so doing, the sucking device 150 removes the clogging of the nozzle orifices and air bubbles having entered into the ink.

The driving device 170 includes the drive force transmission device 171, the normal/reverse rotation switching device 172 and a rotation/vertical-movement device 173. The drive force transmission device 171 includes a first gear 171*a* disposed protruding from the side frame 101, and a second gear 171*b*, which is disposed coaxially with the first gear 171*a* and disposed between the side frames 101 and 102. The first gear 171*a* is coupled to a motor (not shown) disposed outside the side frame 101. The second gear 171*b* is in mesh with a gear 151 of the sucking device 150 shown in FIG. 2.

The normal/reverse rotation switching device 172 includes a switch arm 172*a* shaped like "L", a normal rotation gear 172*b* and a reverse rotation gear 172*c* rotatably mounted on both the ends of the switch arm 172*a*. The switch arm 172*a* is fit, at the central part, to the shaft of the second gear 171*b* and pressed against the second gear 171*b* by a spring (not shown). Either the normal rotation gear 172*b* or the reverse rotation gear 172*c* meshes with the second gear 171*b* depending on the rotational direction of the second gear 171*b*, and both the rotation gears alternately mesh with a toothless gear part 173*aa* of a gear cam 173*a* forming the rotation/vertical-movement device 173 to be further described.

The rotation/vertical-movement device 173 includes two gear cams 173*a* and 173*b*, which are respectively mounted on both ends of one shaft. The gear cams 173*a* and 173*b* are configured so that toothless gear parts 173*aa* and 173*ab* are integrated with cam parts 173*ab* and 173*bb*, respectively. The toothless gear part 173*aa*, as described above, is disposed so as to mesh alternately with the normal rotation gear 172*b* and the reverse rotation gear 172*c* of the normal/reverse rotation switching device 172. The toothless gear part 173*ba* is disposed so as to fit together with the partially toothless gear 112*a* of the wiper holder 112. The cam parts 173*ab* and 173*bb* are respectively disposed so as to be in contact with the lower parts of the two guide pins 133*b* provided on both sides of the lower part of the second cap holder 133.

The drive force of the motor is transmitted through the first gear 171*a*, the second gear 171*b*, and through the normal rotation gear 172*b* or the reverse rotation gear 172*c* by the turning of the switch arm 172*a*, the toothless gear part 173*aa* of the gear cam 173*a*, and the toothless gear part 173*ba* of the gear cam 173*b* to the wiping device 110. The drive force is further transmitted to the wiping device 110 and the capping device 130, through the cam part 173*ab* of the gear cam 173*a* and the cam part 173*bb* of the gear cam 173*b*. The drive force is also transmitted through the gear 151 to the sucking device 150. As a result, the wiping device 110 is turned, the capping device 130 is moved together with the wiping device 110 in the vertical direction, and the sucking device 150 is operated.

Figure 21:
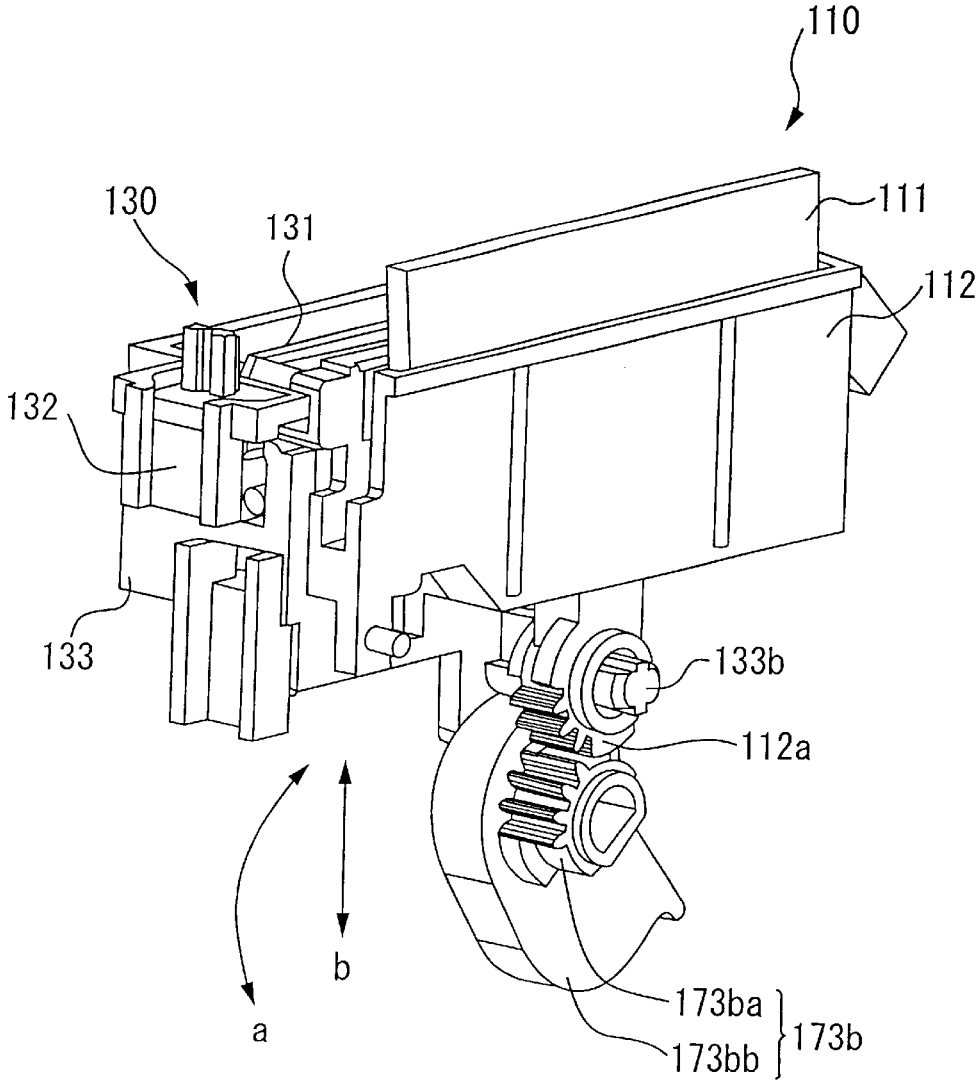
FIG. 21 is a perspective view showing a detailed mechanical arrangement of a key portion of the FIG. 18 head jetting property maintaining device, the capping device and the gear cam.

A disposing relationship between a key portion of the wiping device 110 thus constructed and the capping device 130 and the gear cam 173*b* will be described in detail with reference to FIG. 21. Subsequently, the operations of the devices 110 and 130 will be described with reference to FIGS. 22 through 37. As shown in FIG. 21, the guide pin 133*b* provided on the second cap holder 133 of the capping device 130 is inserted into a shaft hole of the partially toothless gear 112*a* provided on the wiper holder 112 of the wiping device 110.

Figure 26:
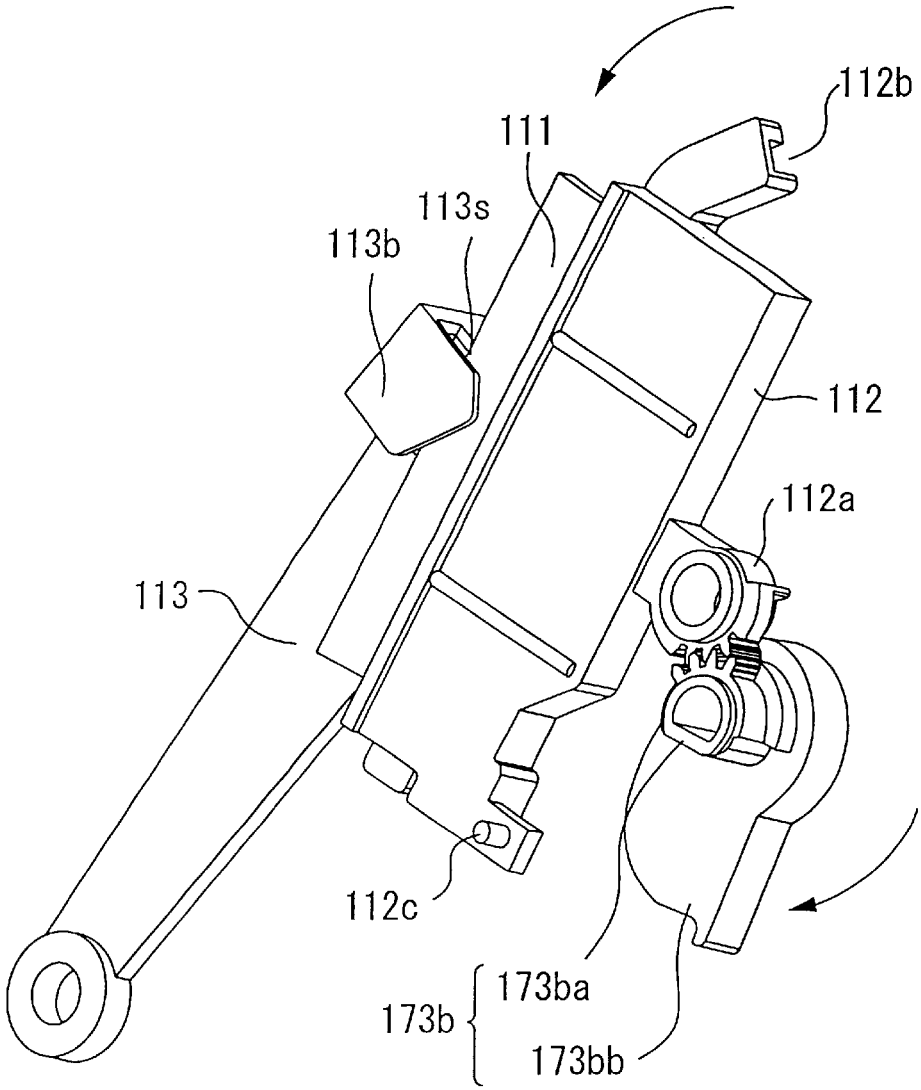
FIG. 26 is a fifth diagram showing the operation of the FIG. 21 wiping device.
Figure 27:
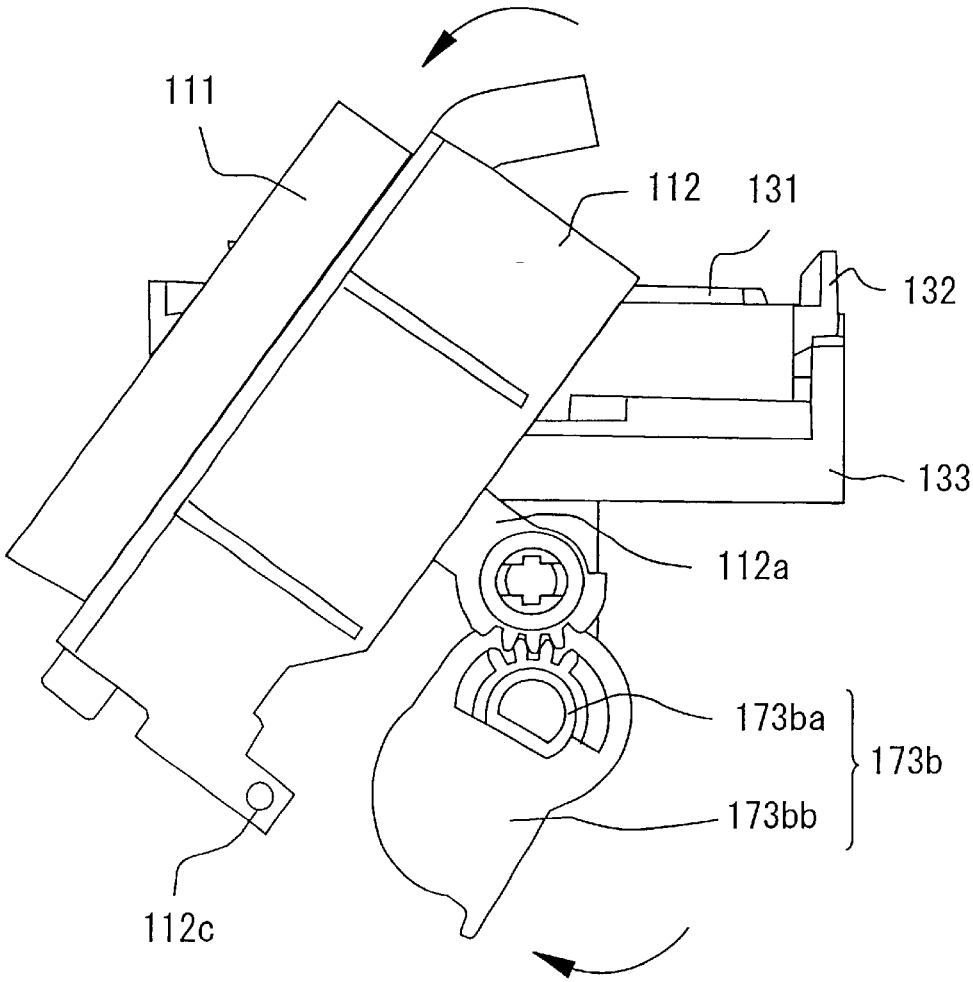
FIG. 27 is a sixth diagram showing the operation of the FIG. 21 wiping device.
Figure 28:
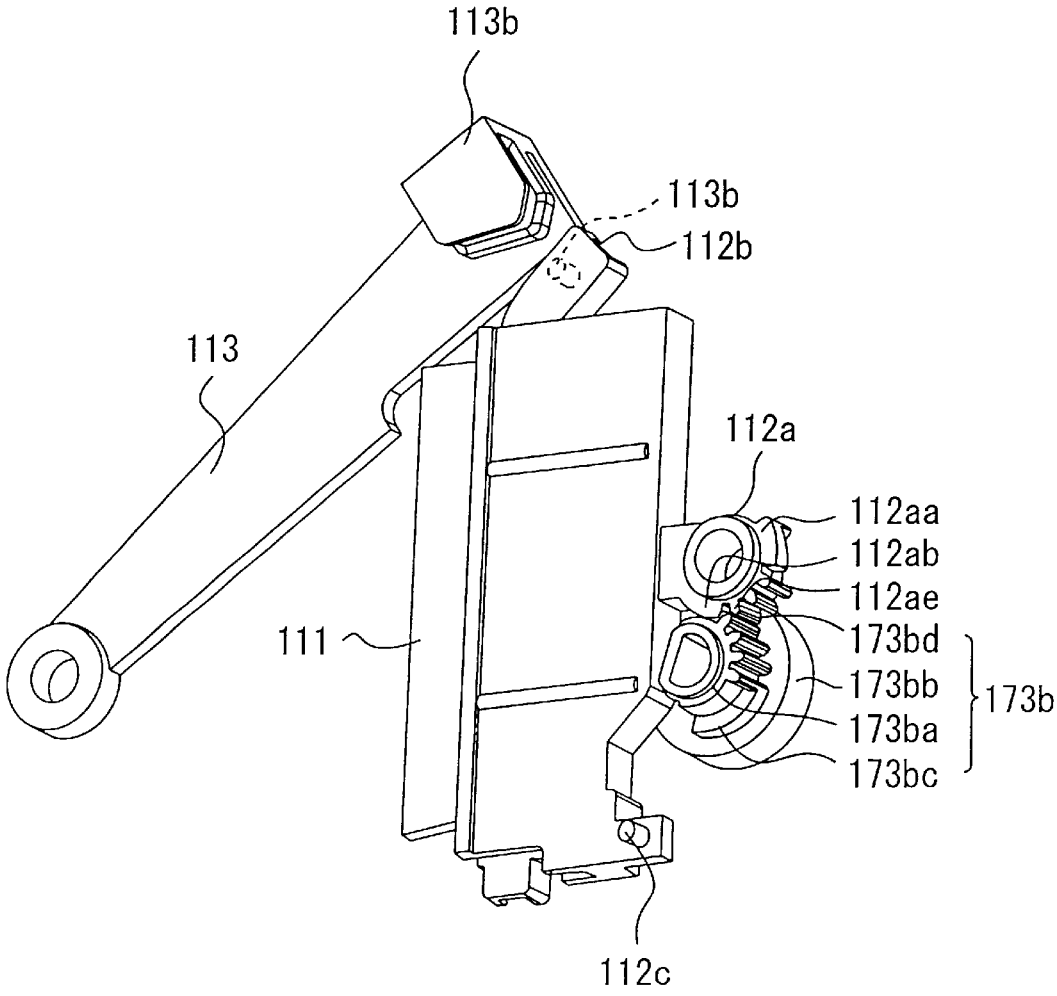
FIG. 28 is a seventh diagram showing the operation of the FIG. 21 wiping device.
Figure 29:
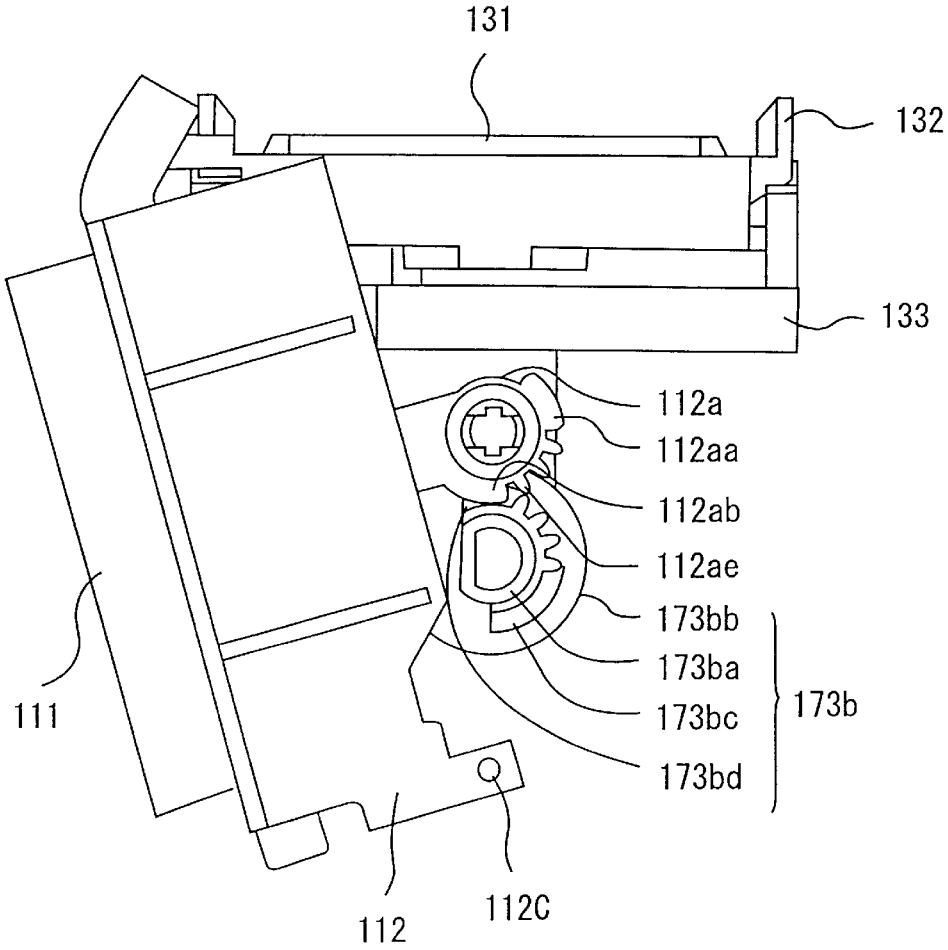
FIG. 29 is an eighth diagram showing the operation of the FIG. 21 wiping device.
Figure 30:
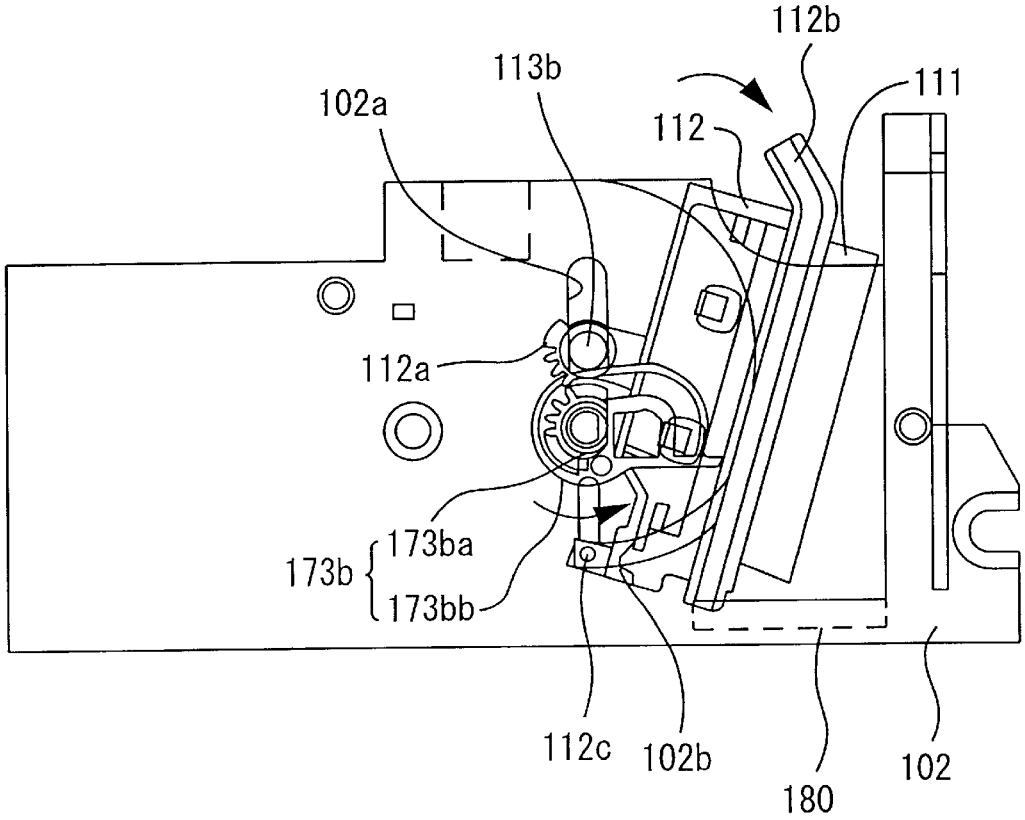
FIG. 30 is a ninth diagram showing the operation of the FIG. 21 wiping device.
Figure 31:
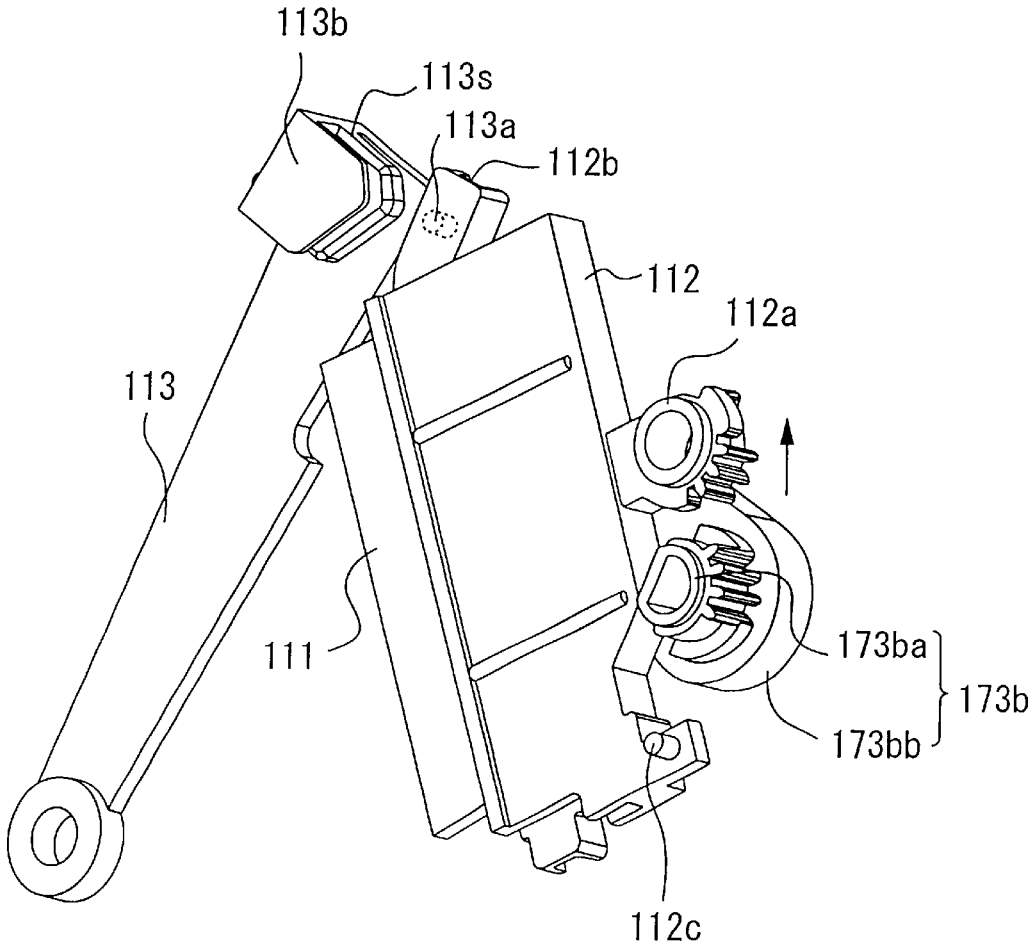
FIG. 31 is a tenth diagram showing the operation of the FIG. 21 wiping device.
Figure 32:
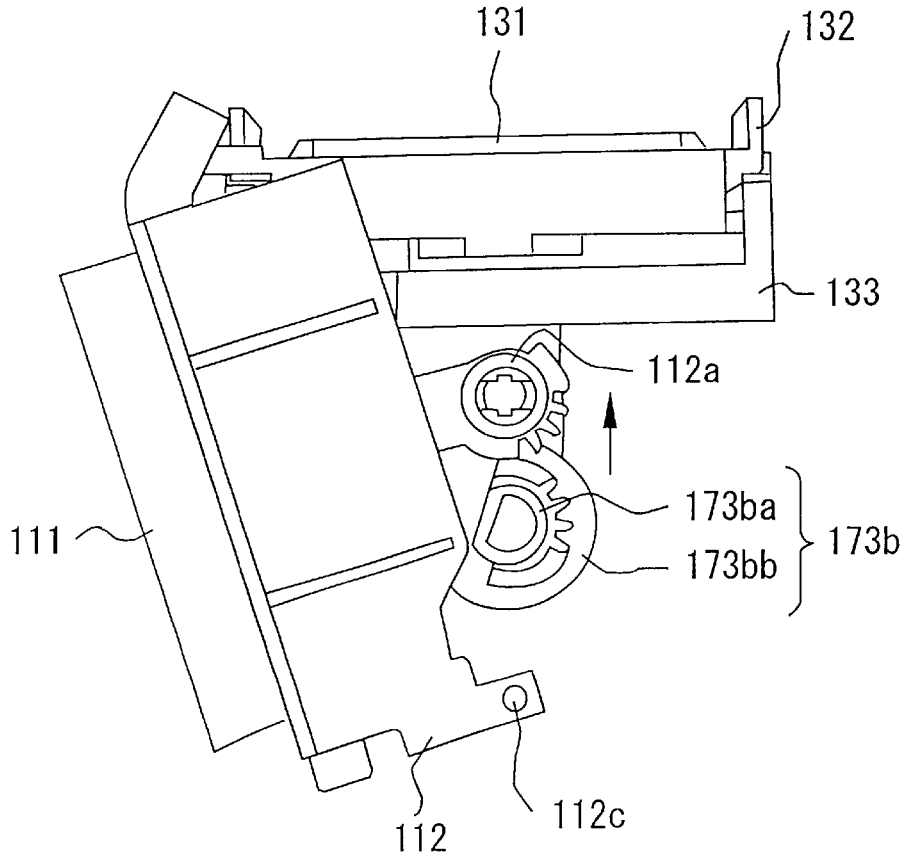
FIG. 32 is an eleventh diagram showing the operation of the FIG. 21 wiping device.
Figure 33:
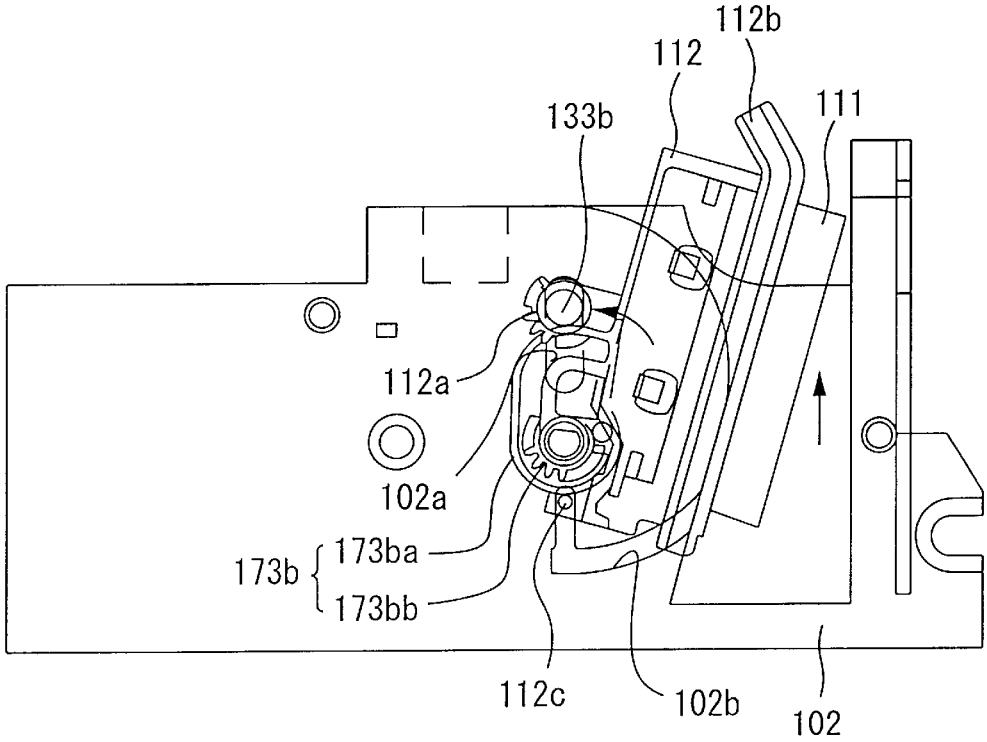
FIG. 33 is a twelfth diagram showing the operation of the FIG. 21 wiping device.

The gear cam 173*b* is disposed such that the toothless gear part 173*ba* meshes with the partially toothless gear 112*a* provided on the wiper holder 112, and the cam part 173*bb* meshes with the guide pin 133*b* formed on the second cap holder 133. With this arrangement, the wiping device 110 is turned in the direction of the arrow "a" in the figure, and the capping device 130 is vertically moved together with the wiping device 110 in the direction of the arrow "b" in the figure. The operation of the wiping device 110 will be described with reference to FIGS. 22 through 33. Of those figures, FIGS. 22 to 25, FIGS. 26 and 27, FIGS. 28 to 30 and FIGS. 31 to 33 respectively illustrate the same operation state from different points of views. Specifically, FIGS. 22 to 25 show a state allowing the wiper 111 to perform the wiping operation. FIGS. 26 and 27 show a state that the wiper 111 is on the way of being stored. FIGS. 28 to 30 show a state that the storing of the wiper 111 is completed. FIGS. 31 to 33 show a state that the wiping device 110 has risen together with the capping device 130.

Figure 22:
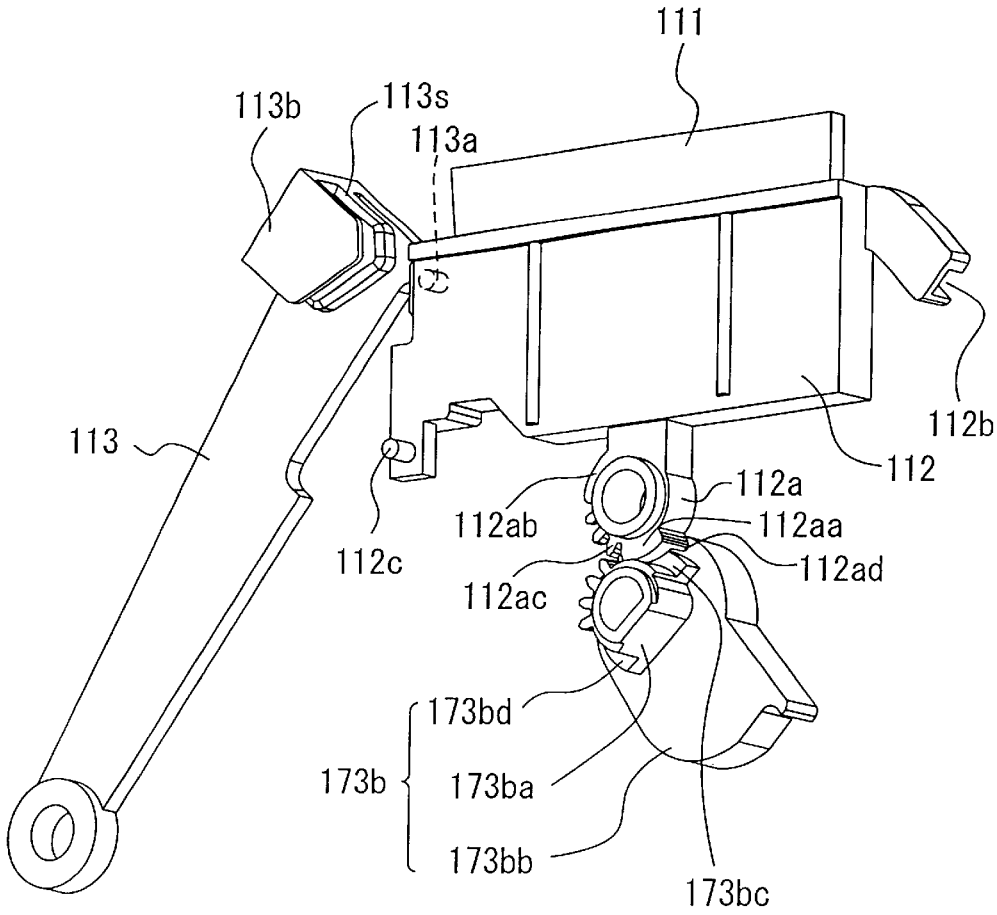
FIG. 22 is a first diagram showing the operation of the FIG. 21 wiping device.

To start with, in the state allowing the wiper 111 to perform the wiping operation, as shown in FIG. 22, the wiper 111 is positioned and fixed while being directed upward, and the wiper cleaner 113 is positioned and fixed at one end of the wiper holder 112. Those are positioned and fixed in the following way.

Figure 24:
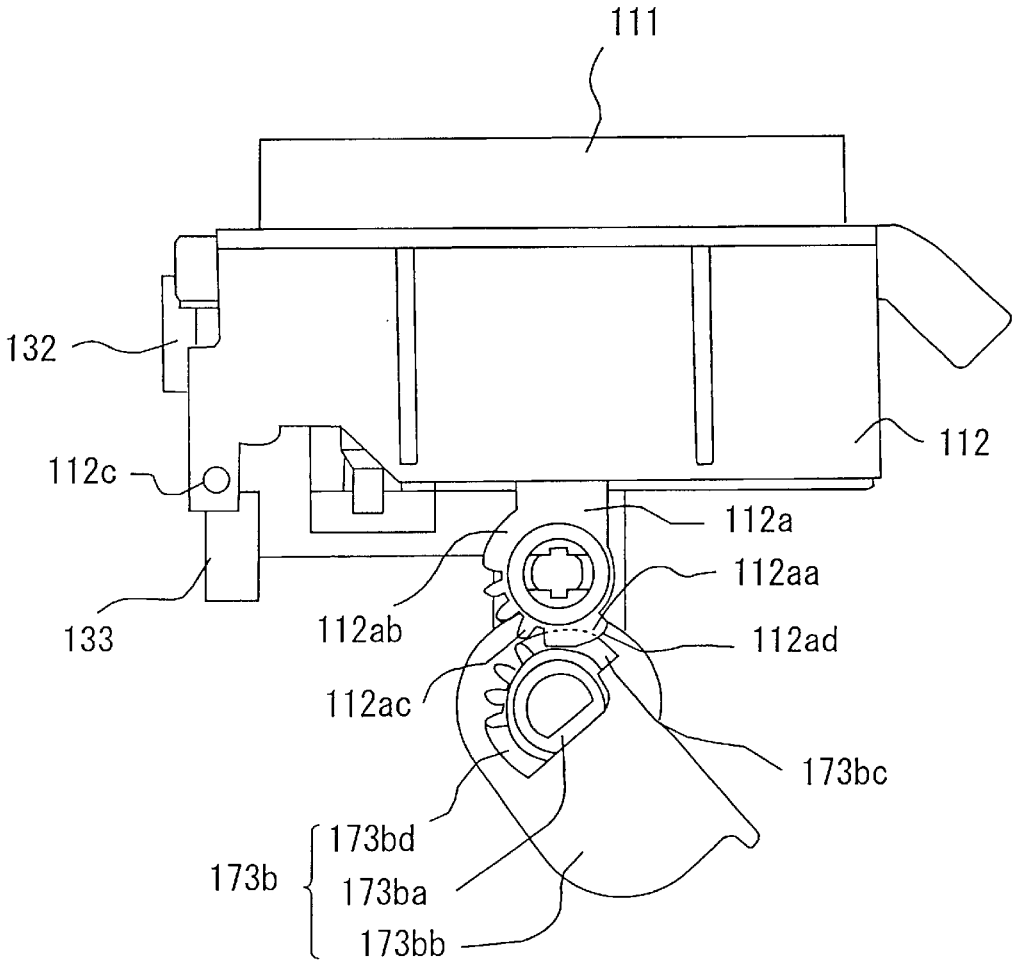
FIG. 24 is a third diagram showing the operation of the FIG. 21 wiping device.

As shown in FIGS. 22 and 24, parts extended from both sides of the teeth forming part of the partially toothless gear 112*a* formed on the wiper holder 112 are arcuate parts 112*aa* and 112*ab* each having a thickness of which is smaller than the half of the teeth thickness and a radius larger than the radius of the addendum circle. Parts extended from both sides of the teeth forming part of the partially toothless gear 173*ba* formed on the gear cam 173*b* are arcuate parts 173*bc* and 173*bd* each having a thickness of which is smaller than the half of the teeth thickness and a radius larger than the radius of the addendum circle, those arcuate parts being disposed on the opposite side to the arcuate parts 112*aa* and 112*ab*.

As shown in FIGS. 22 and 24, one arcuate part 112*aa* of the partially toothless gear 112*a* is brought into engagement with one arcuate part 173*bc* of the toothless gear part 173*ba*. As a result, the arcuate part 173*bc* is clamped by both ends of the arcuate part 112*aa*, i.e., a tooth 112*ac* of the end of the partially toothless gear 112*a* and a wall part 112*ad* of the arcuate part 112*aa*. Then, the wiper holder 112 is positioned to the gear cam 173*b*, and the wiper 111 is positioned and fixed while being directed upward.

Figure 23:
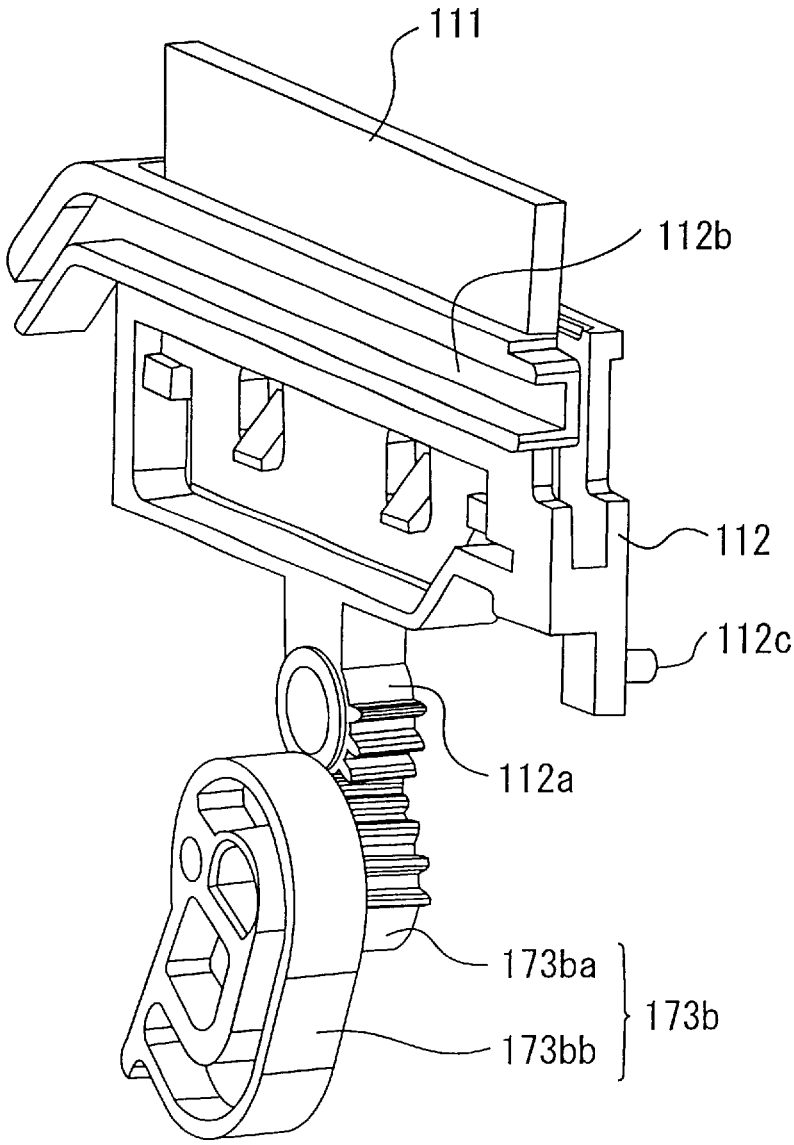
FIG. 23 is a second diagram showing the operation of the FIG. 21 wiping device.

As shown in FIG. 22, the guide pin 113*a* of the wiper cleaner 113 is inserted into the guide groove 112*b* formed in the wiper holder 112 shown in FIGS. 22 and 23. With this, the wiper cleaner 113 is positioned to the wiper holder 112, whereby the wiper cleaner 113 is positioned and fixed to the end side of the wiper holder 112.

Figure 25:
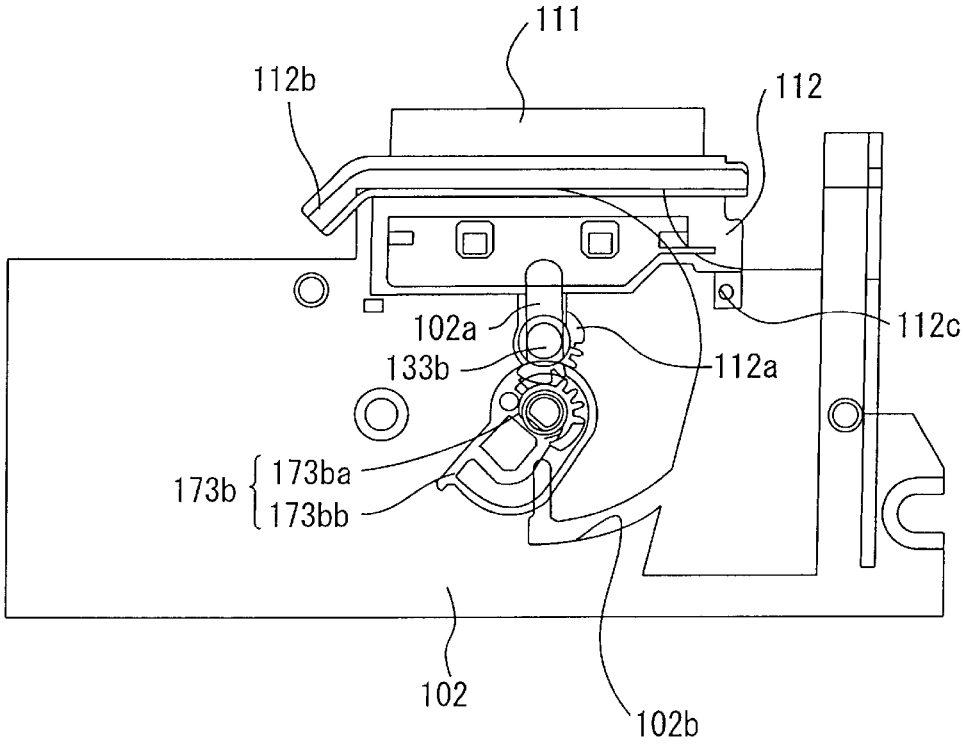
FIG. 25 is a fourth diagram showing the operation of the FIG. 21 wiping device.

FIG. 25 is a diagram showing a layout of a guide pin 112*c* formed on the wiper holder 112 serving as a guide when the wiper holder 112 rotates, and a guide groove 102*b* formed in the side frame 102. In this state, viz., a state that the wiping by the wiper 111 is allowed, those are separated from each other and are nonfunctional.

In the state that the wiper 111 is on the way of being stored, as shown in FIG. 26, the wiper holder 112 is inclined, and the wiper 111 is clamped between the ink scriber 113*b* of the wiper cleaner 113. This results from the fact that, as shown in FIGS. 26 and 27, when the gear cam 173*b* is turned, the toothless gear part 173*ba* of the gear cam 173*b* fits together with the partially toothless gear 112*a* of the wiper holder 112, whereby the wiper holder 112 per se is turned, and at the same time, the guide pin 113*a* of the wiper cleaner 113 is guided by the guide groove 112*b* of the wiper holder 112. In this state, the ink scriber 113*b* of the wiper cleaner 113 rubs the wiper 111 while holding the wiper therebetween. Accordingly, the wiper 111 is stored while scribing the ink sticking thereto.

In the state that the storing of the wiper 111 is completed, as shown in FIG. 28, the wiper 111 is positioned and fixed while being directed obliquely downwards, and the wiper cleaner 113 is positioned and fixed at the other end side of the wiper holder 112. This positioning and fixing operation is performed in the following way.

As shown in FIGS. 28 and 29, when one move the wiper 111 in a set direction, a tooth 112*ae* at the end of the partially toothless gear 112*a* is abutted against the other arcuate part 173*bd* of the toothless gear part 173*ba* forming the gear cam 173*b*. Accordingly, it is impossible to further move the wiper 111 in the set direction.

On other hand, as shown in FIG. 30, when one moves the wiper 111 in a reset direction, the guide pin 112*c* of the wiper holder 112 hits the left wall of a guide groove 102*a* in the side frame 102. Accordingly, it is impossible to further move the wiper 111 in the reset direction. As a result, the wiper holder 112 is positioned to the gear cam 173*b* and the side frame 102, and the wiper 111 may be positioned and fixed while being directed obliquely downwards.

As shown in FIG. 28, the guide pin 113*a* of the wiper cleaner 113 has relatively moved to the other end of the wiper holder 112 along the guide groove 112*b* of the wiper holder 112. As a result, the wiper cleaner 113 is positioned to the wiper holder 112, and accordingly, the wiper cleaner 113 may be positioned and fixed at a position close to the right-most end of the other end of the wiper holder 112.

Finally, in the state that the wiping device 110 has risen together with the capping device 130, as shown in FIGS. 31 and 32, the wiper 111 separates from the gear cam 173*b* while being directed obliquely downward, and positioned and fixed, and the wiper cleaner 113 is positioned and fixed at the other end side of the wiper holder 112. This positioning and fixing operation is performed out by the following operation.

As shown in FIG. 33, when the gear cam 173*a* (173*b*) is turned, the cam part 173*ab* (173*bb*) of the gear cam 173*a* (173*b*) pushes upward the guide pin 133*b* of the second cap holder 133 along the guide groove 101*a* (102*a*) in the side frame 101 (102).

In addition, as shown in FIG. 33, the guide pin 112*c* of the wiper holder 112 is inserted into the vertical part of the guide groove 102*a* in the side frame 102. As a result, the wiper holder 112 is positioned to the gear cams 173*a* and 173*b* and the side frame 102. Accordingly, the wiper 111 separates from the gear cams 173*a* and 173*b* while being directed obliquely downwardly, and are positioned and fixed.

Further, as shown in FIG. 31, the guide pin 113*a* of the wiper cleaner 113 is relatively moved to a position close to the end-most part of the other end of the wiper holder 112 along the guide groove 112*b* of the wiper holder 112. As a result, the wiper cleaner 113 is positioned to the wiper holder 112, so that the wiper cleaner 113 may be positioned and fixed at a position close to the end-most part of the other end of the wiper holder 112.

Figure 34:
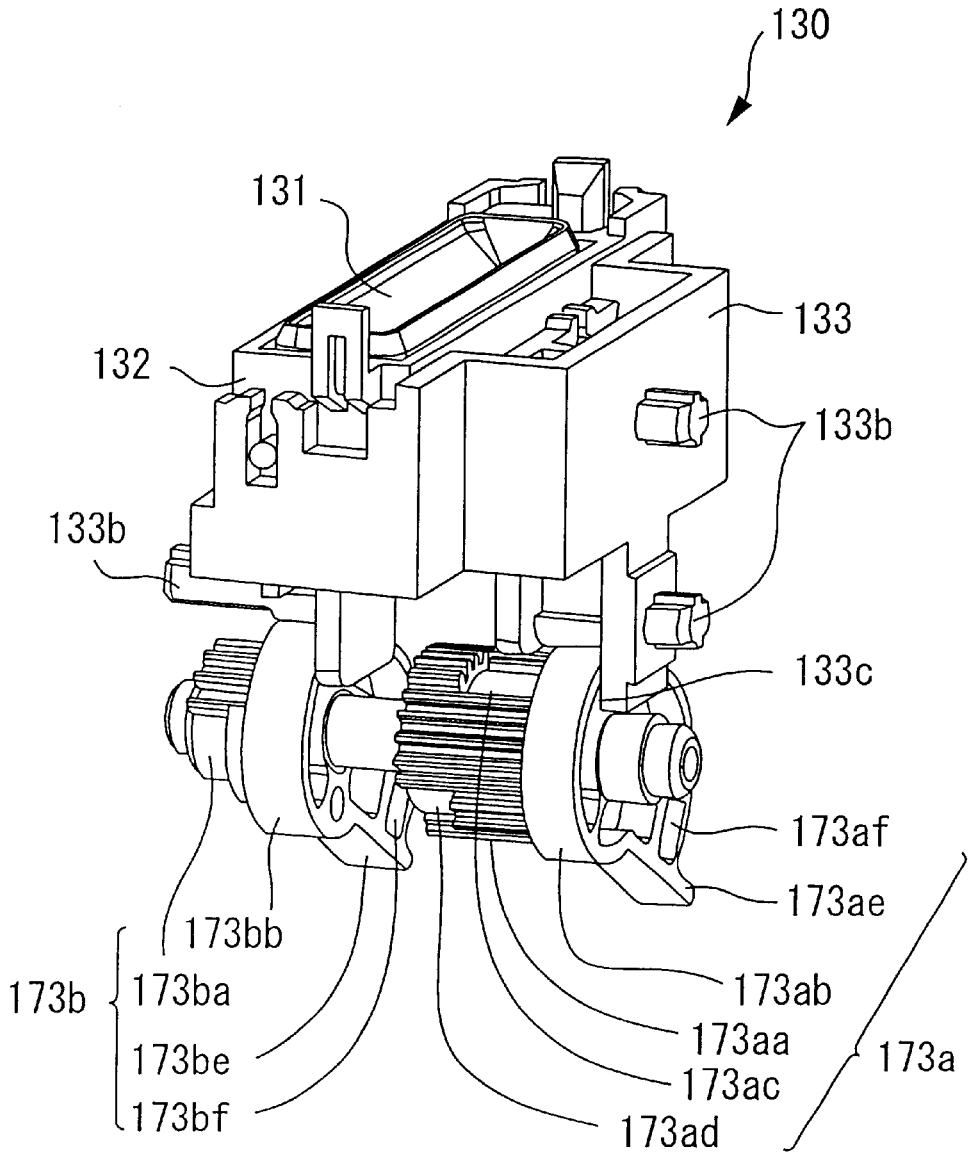
FIG. 34 is a first diagram showing the operation of the FIG. 21 capping device.
Figure 35:
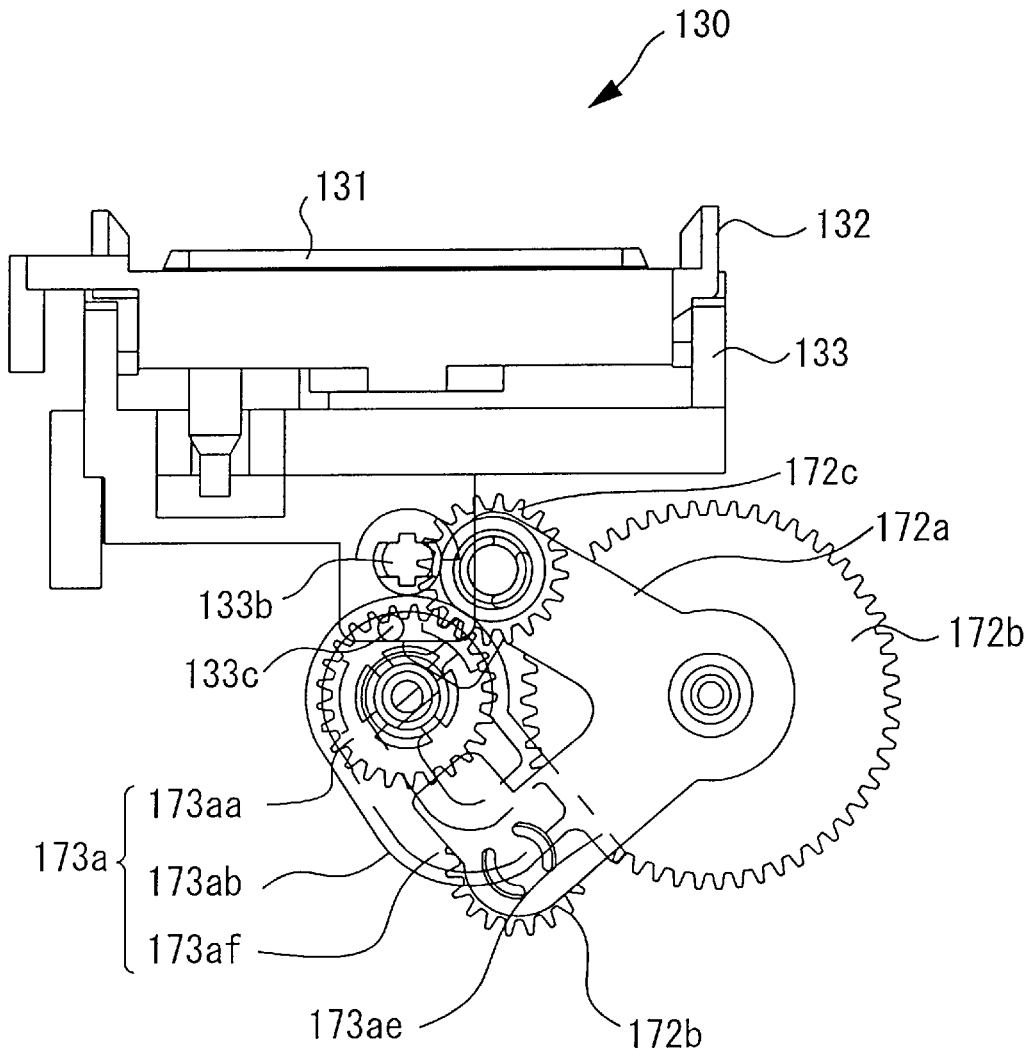
FIG. 35 is a second diagram showing the operation of the FIG. 21 capping device.
Figure 36:
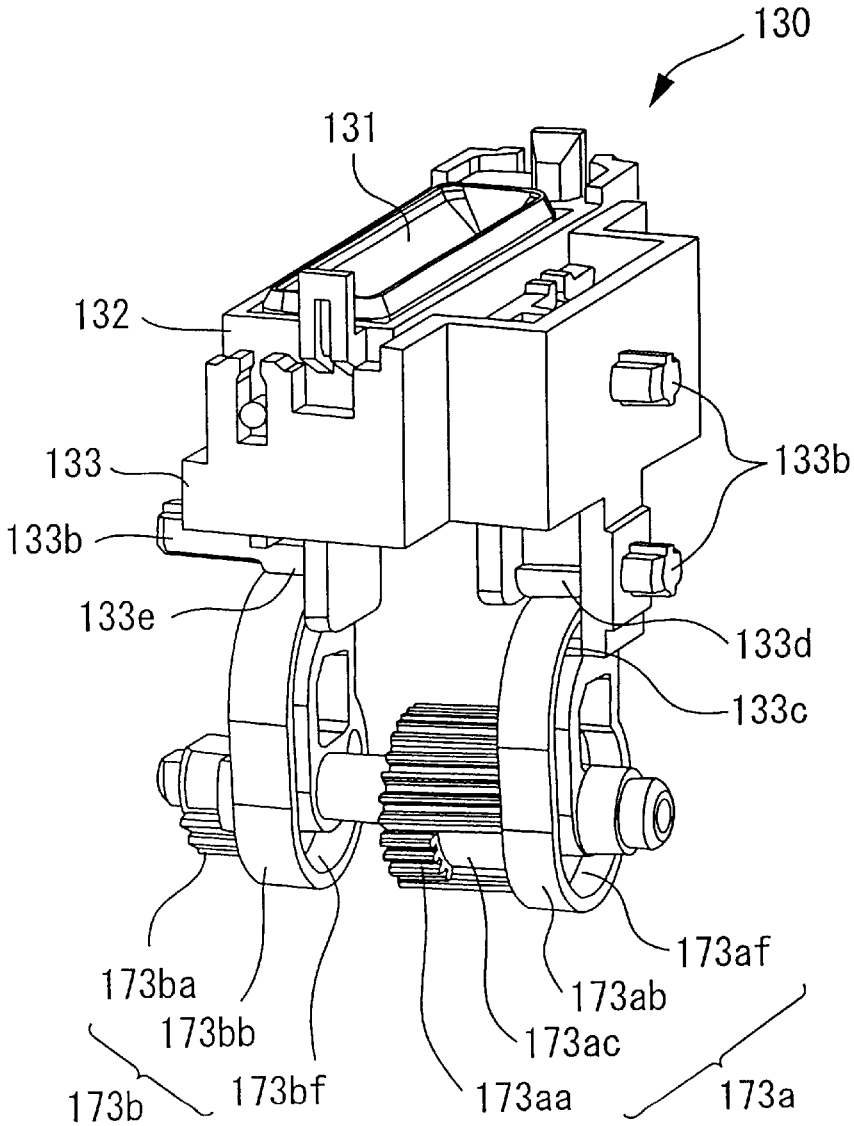
FIG. 36 is a third diagram showing the operation of the FIG. 21 capping device.
Figure 37:
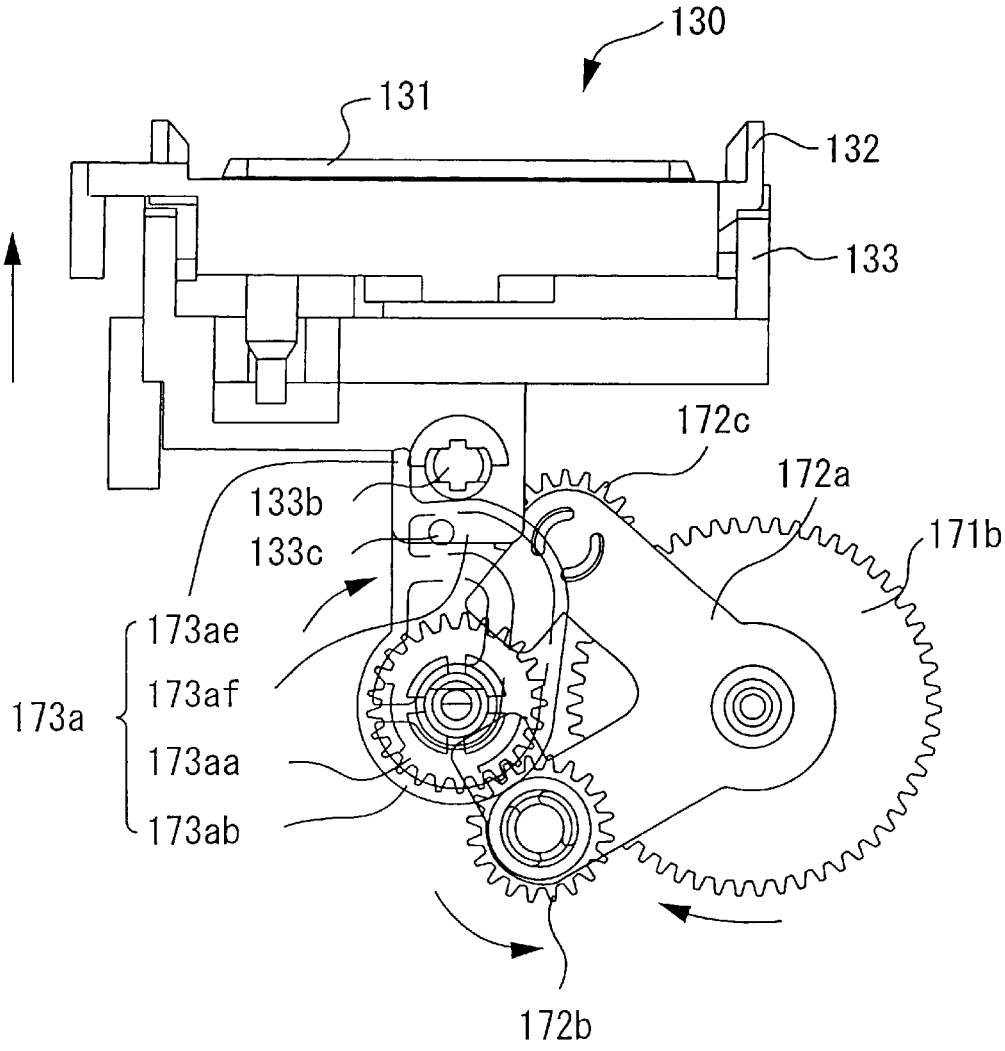
FIG. 37 is a fourth diagram showing the operation of the FIG. 21 capping device.

The operation of the capping device 130 will be described with reference to FIGS. 34 through 37. Of those figures, FIGS. 34 and 35, and FIGS. 36 and 37 respectively illustrate the same state of the operation from different points of view. Specifically, FIGS. 34 and 35 show a state that the storing of the cap 131 is completed. FIGS. 36 and 37 show a state allowing the cap 131 to cap the recording head therewith.

To start, in the state that the storing of the cap 131 is completed, as shown in FIGS. 34 and 35, the capping device 130 is positioned and fixed at the bottom end position. This positioning and fixing operations are performed in the following way. As shown in FIG. 34, the toothless gear part 173*aa* of the gear cam 173*a* is disposed such that by the rotation of the switch arm 172*a*, the normal rotation gear 172*b* and the reverse rotation gear 172*c* alternately mesh with the normal rotation gear 172*b* and the reverse rotation gear 172*c* at position shifted to the width direction of the toothless gear part 173*aa*. Two toothless parts 173*ac* and 173*ad* are respectively formed on the toothless gear part 173*aa* at positions shifted in the circumferential direction and the width direction.

As shown in FIGS. 34 and 35, the cam part 173*ab* (173*bb*) of the gear cam 173*a* (173*b*) is formed to have an almost oval shape. Stoppers 173*ae* and 173*be*, which may be brought in contact with the two separate guide pins 133*b* and 133*b* at both sides of the lower part of the second cap holder 133, are provided on the outer periphery of the cam part. Guide grooves 173*af* and 173*bf* for guiding other two separate guide pins 133*c* and 133*c* provided on the second cap holder 133 along the outer circumference are formed in the side surface.

When the capping device 130 is moved from the top end and reaches the bottom end, the guide grooves 173*af* and 173*bf* in the cam parts 173*ab* and 173*bb* each forming the gear cams 173*a* and 173*b* guide the two guide pins 133*c* of the second cap holder 133 to move, and the two guide pins 133*b* on both sides of the lower part of the second cap holder 133 are moved downward to the bottom end along the guide grooves 101*a* and 102*a* in the side frames 101 and 102.

Further, the reverse rotation gear 172*c* reaches the toothless part 173*ad* of the toothless gear part 173*aa* forming the gear cam 173*a*, and runs idle. As a result, the second cap holder 133 is positioned with respect to the gear cams 173*a* and 173*b* and the side frames 101 and 102, and accordingly, the capping device 130 is positioned and fixed at the bottom end position.

In the state that the capping of the recording head with the cap 131 is allowed, as shown in FIGS. 36 and 37, the capping device 130 is positioned and fixed at the top end position. This positioning and fixing operations are performed in the following way. When the capping device 130 is moved and reaches the top end position from the bottom end position, two guide pins 133*d* and 133*e* of the second cap holder 133 are respectively moved by the cam parts 173*ab* and 173*bb* of the gear cams 173*a* and 173*b*, and the two guide pins 133*b* on both sides of the lower part of the second cap holder 133 are moved upward to the top end position along the guide grooves 101*a* and 102*b* of the side frames 101 and 102 to thereby be brought into contact with the stoppers 173*ae* and 173*be*.

In this state, the normal rotation gear 172*b* is put on the toothless part 173*ac* of the toothless gear part 173*aa* forming the gear cam 173*a*, and runs idle. As a result, the second cap holder 133 is positioned with respect to the gear cams 173*a* and 173*b* and the side frames 101 and 102, and accordingly, the capping device 130 is positioned and fixed at the top end position.

Figure 38:
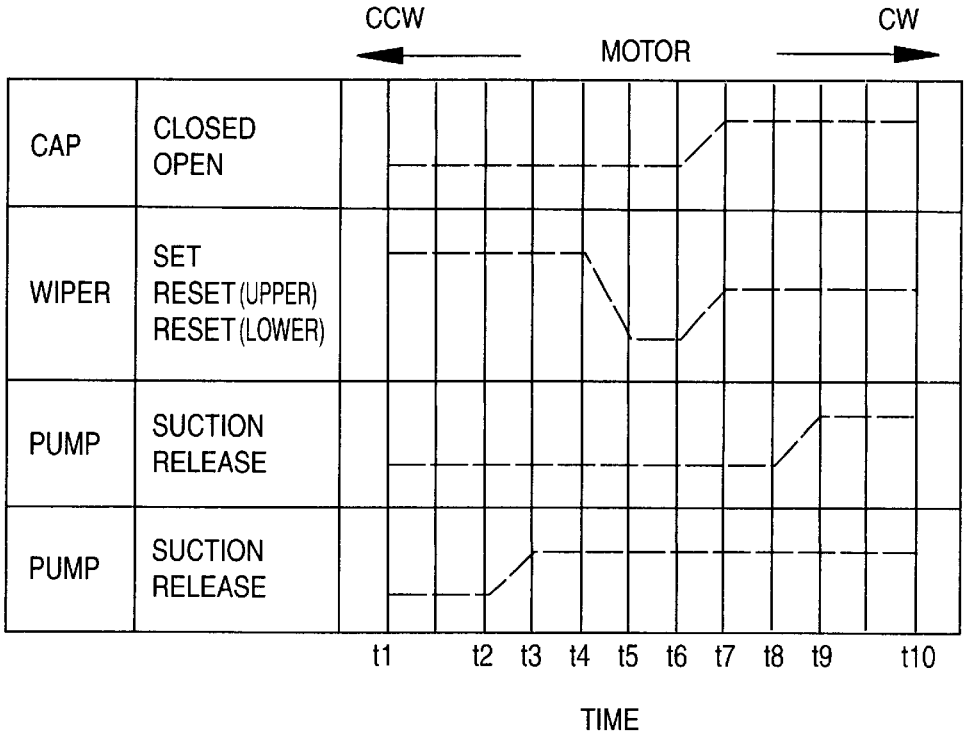
FIG. 38 is a time chart exemplarily showing the operation of the FIG. 18 head jetting property maintaining device.
Figure 39:
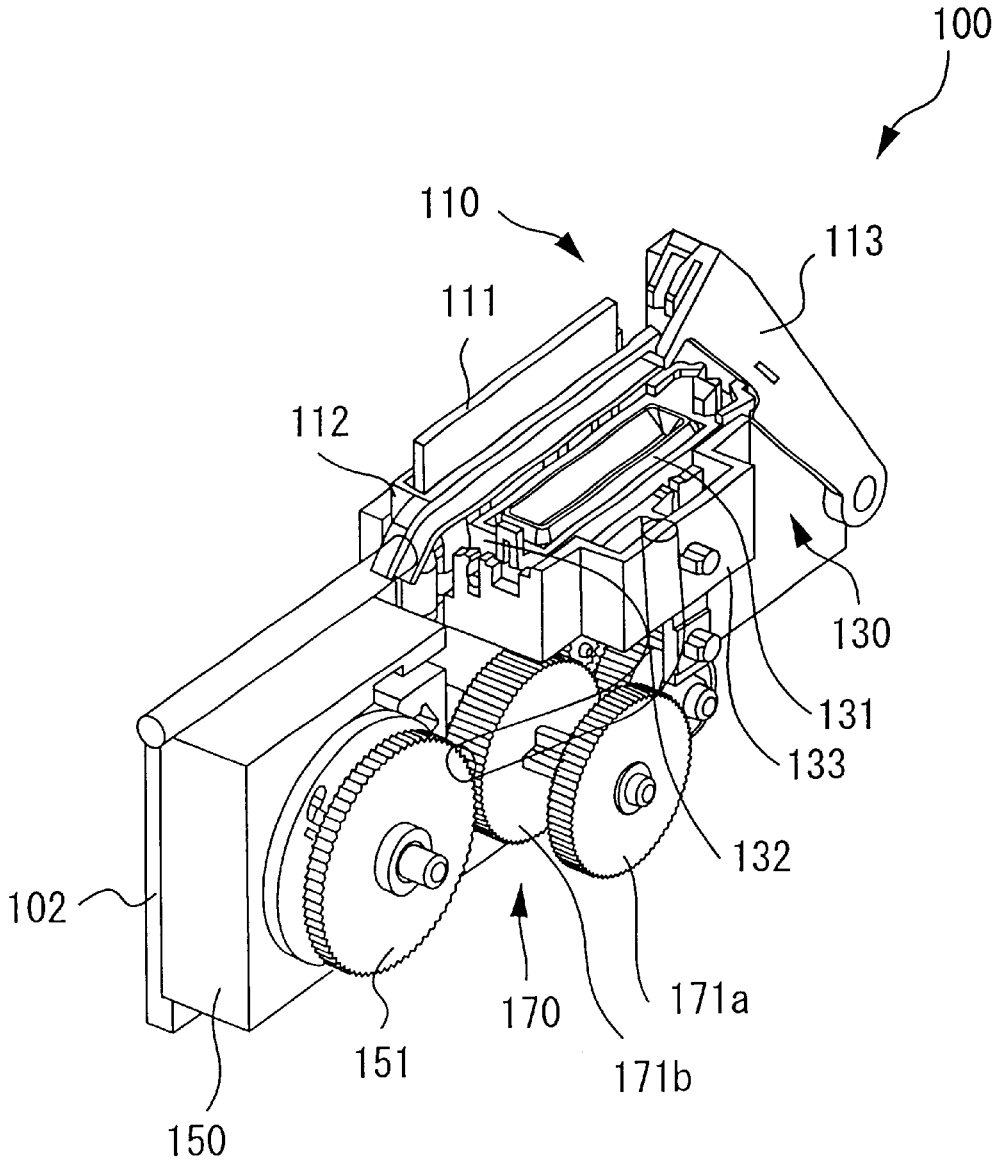
FIG. 39 is a first diagram showing the operation of the FIG. 18 head jetting property maintaining device.
Figure 40:
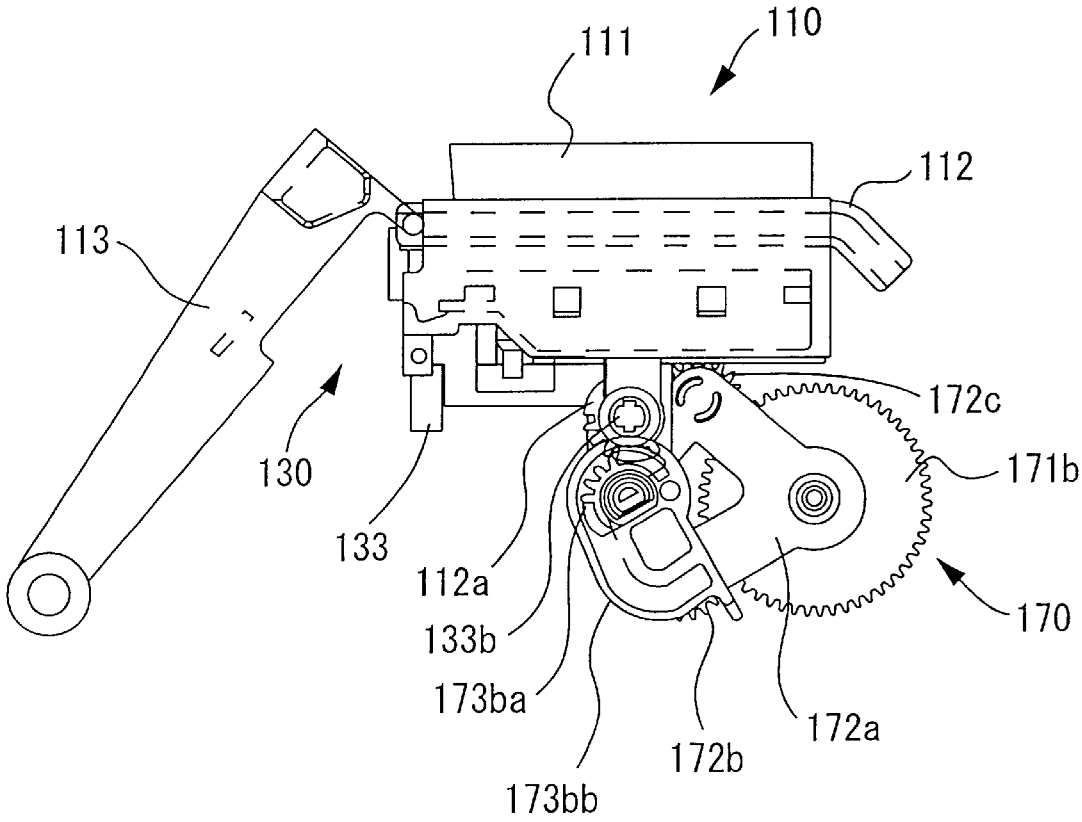
FIG. 40 is a second diagram showing the operation of the FIG. 18 head jetting property maintaining device.
Figure 41:
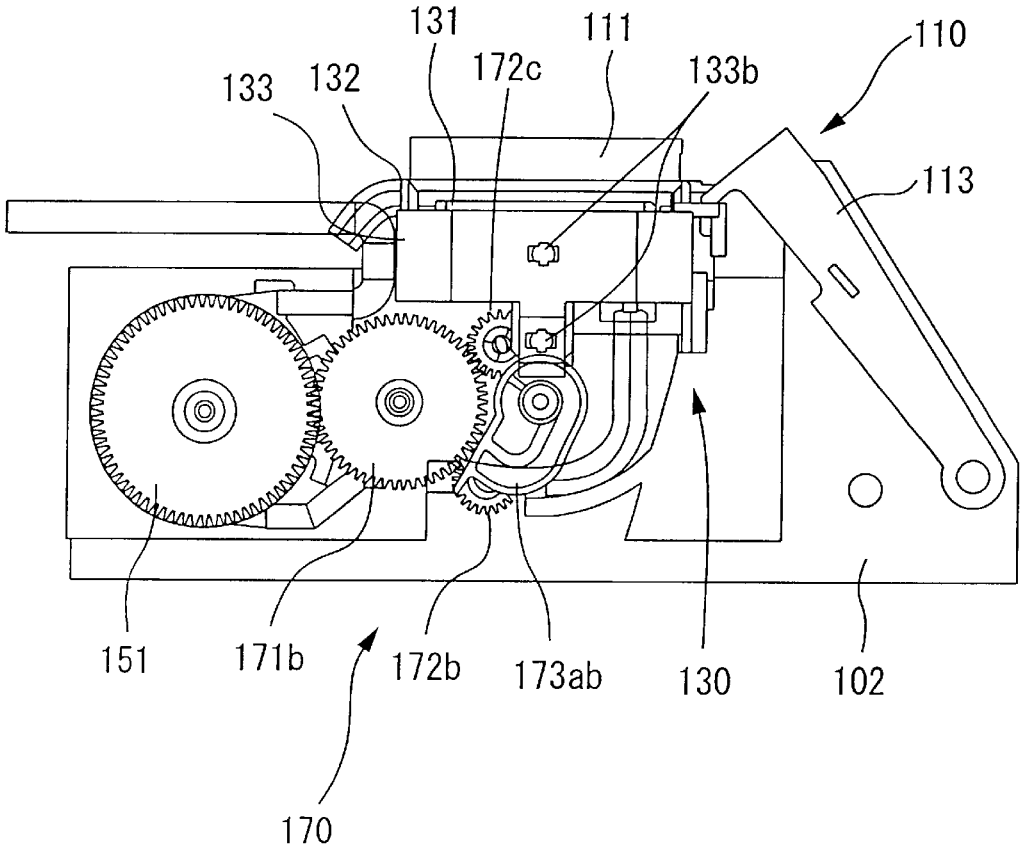
FIG. 41 is a third diagram showing the operation of the FIG. 18 head jetting property maintaining device.
Figure 42:
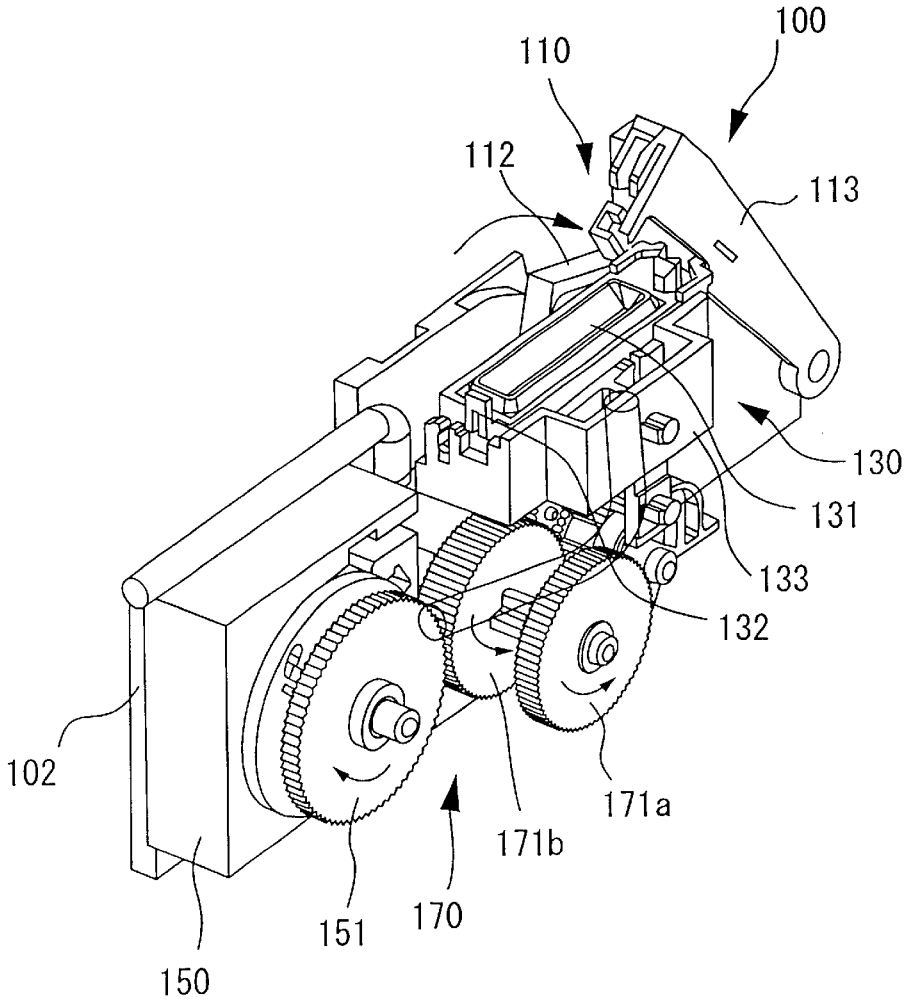
FIG. 42 is a fourth diagram showing the operation of the FIG. 18 head jetting property maintaining device.
Figure 43:
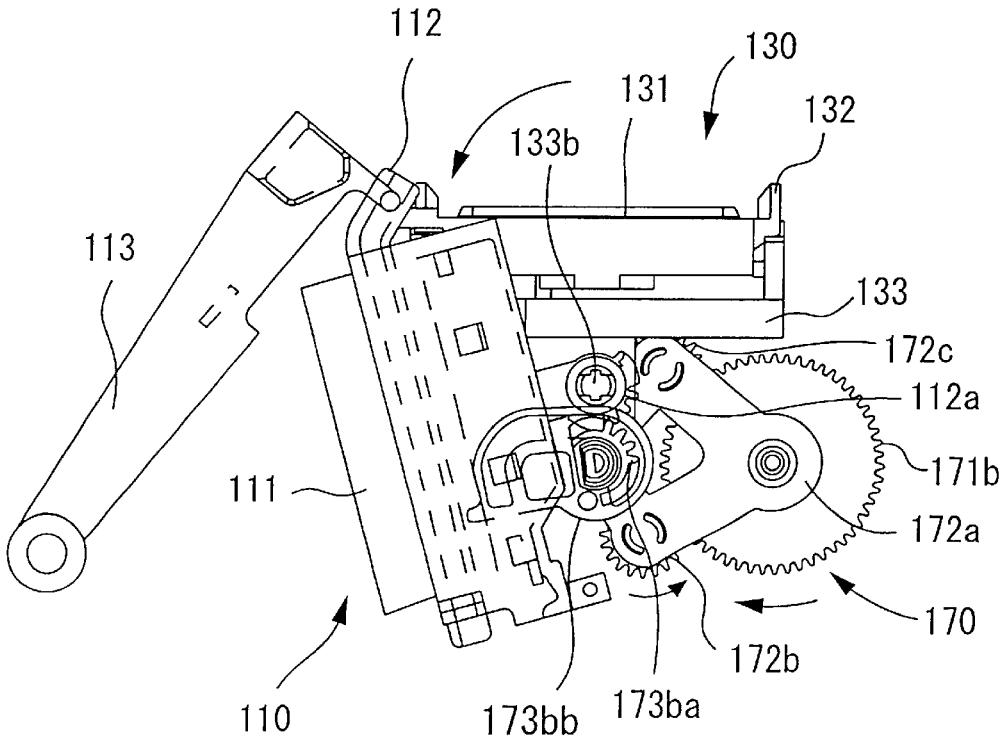
FIG. 43 is a fifth diagram showing the operation of the FIG. 18 head jetting property maintaining device.
Figure 44:
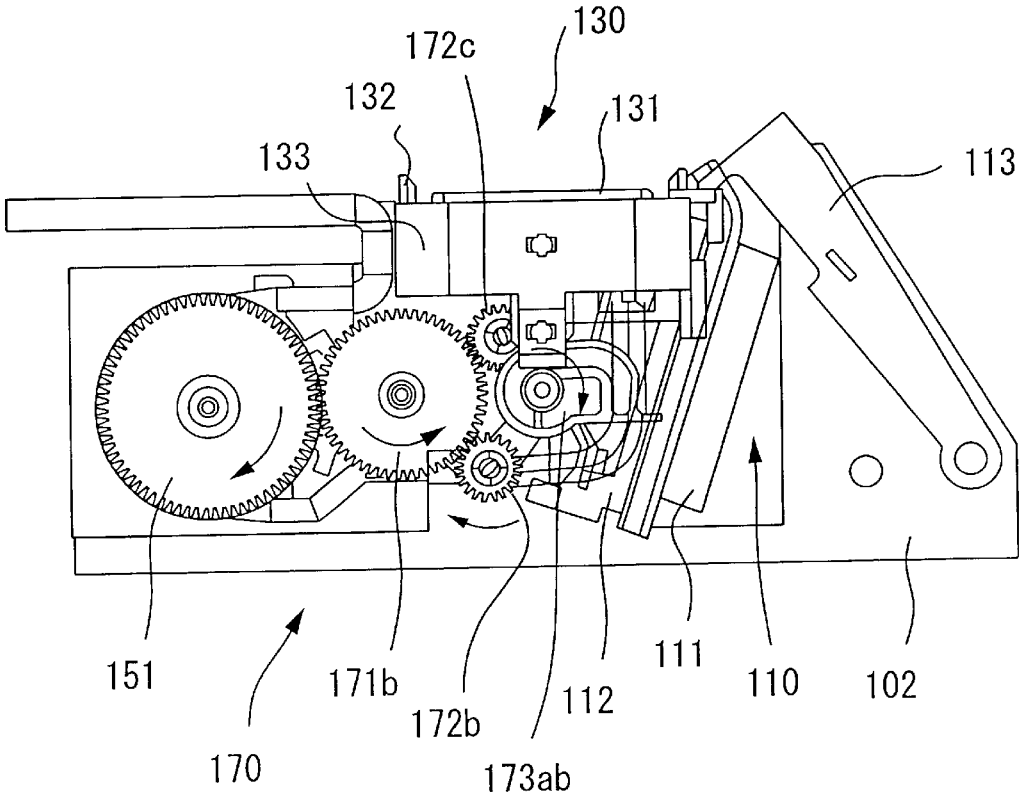
FIG. 44 is a sixth diagram showing the operation of the FIG. 18 head jetting property maintaining device.
Figure 45:
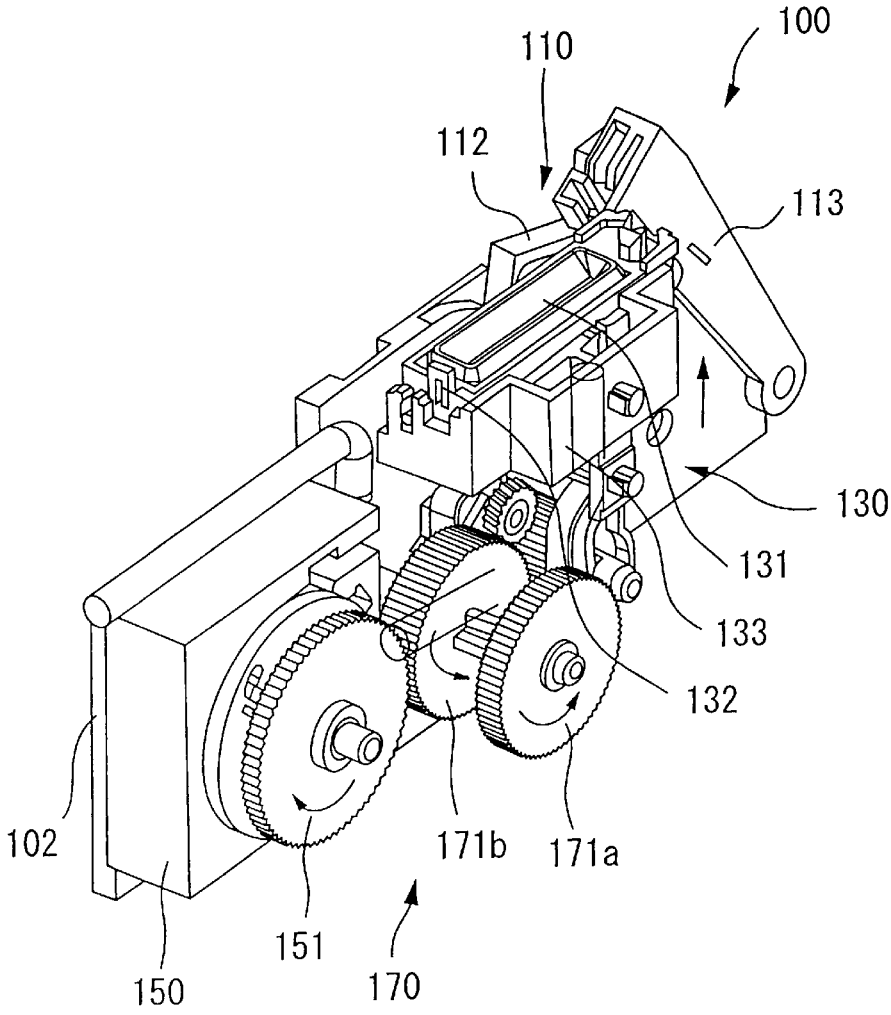
FIG. 45 is a seventh diagram showing the operation of the FIG. 18 head jetting property maintaining device.
Figure 46:
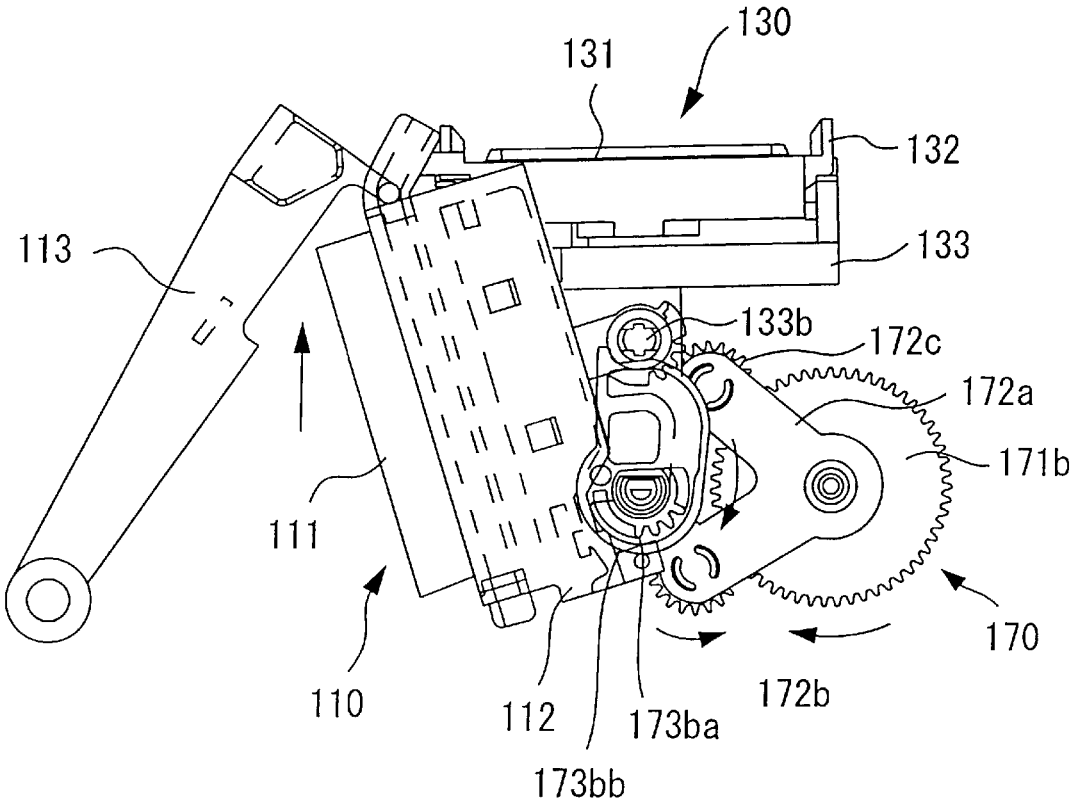
FIG. 46 is an eighth diagram showing the operation of the FIG. 18 head jetting property maintaining device.
Figure 47:
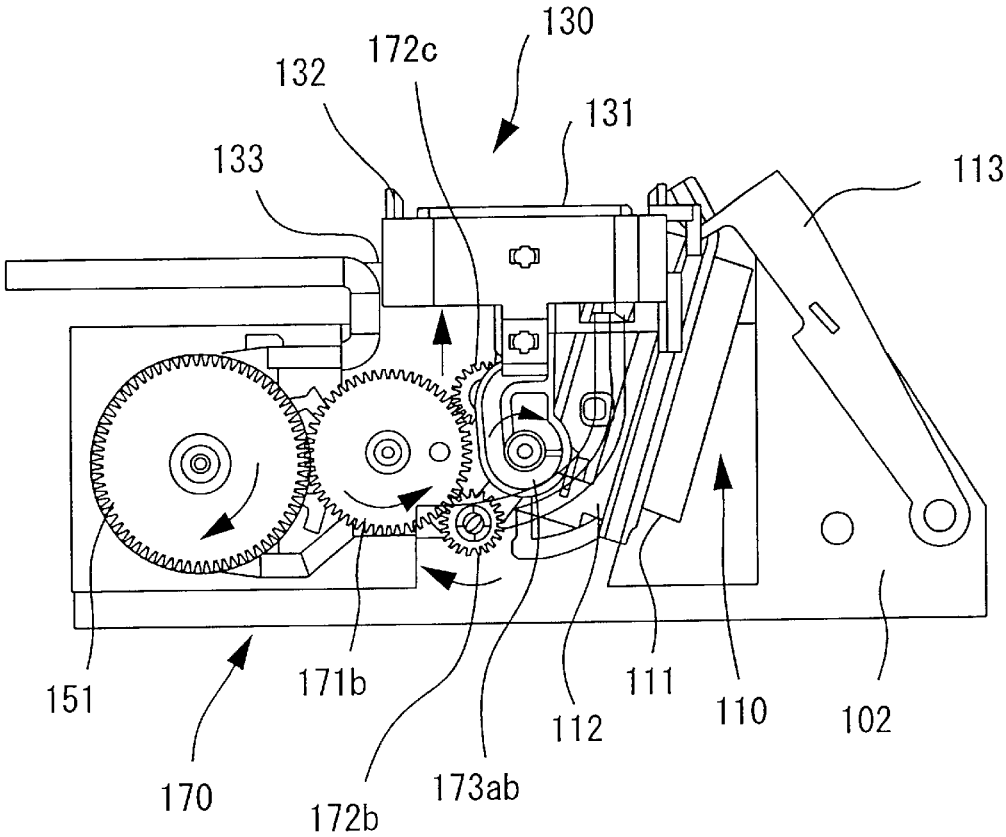
FIG. 47 is a ninth diagram showing the operation of the FIG. 18 head jetting property maintaining device.

An overall operation of the thus constructed head jetting property maintenance device 100, which includes the wiping device 110, the capping device 130, the sucking device 150 and the driving device 170, will be described with reference to FIGS. 38 through 47. Of those figures, FIG. 38 is a time chart showing an operation of the head jetting property maintenance device 100. FIGS. 39 to 41, FIGS. 42 to 44, and FIGS. 45 to 47 respectively illustrate the same operation state from different points of view. FIGS. 39 to 41 show a state that the wiping by the wiper 111 is allowed. FIGS. 42 to 44 show a state that the storing of the wiper 111 is completed. FIGS. 45 to 47 show a state that the capping of the recording head by the cap 131 is allowed.

In the "normal rotation" in FIG. 38, the capping device 130 is located at the bottom end position as shown in FIGS. 39 to 41, and the cap 131 is in an "open" state, viz., the printing head is not capped with the cap. Also in this state, the wiping device 110 is located at an upper position, and the wiper 111 is in a "set" state, viz., the wiping operation by the wiper is allowed. The roller of the pump as the sucking device 150 is in a "release" state to the tube, viz., in a non-suction state (start time point t1).

From this state, the motor rotates in the normal rotation direction to thereby turn the second gear 171*b* together with the first gear 171*a*, and then the switch arm 172*a* is turned and the normal rotation gear 172*b* meshes with the toothless gear part 173*aa* of the gear cam 173*a*. In turn, the rotational force of the second gear 171*b* is transmitted from the normal rotation gear 172*b* to the toothless gear part 173*aa* of the gear cam 173*a*, and the gear cams 17*a* and 173*b* are turned. Subsequently, the toothless gear part 173*ba* of the gear cam 173*b* fits together with the partially toothless gear 112*a* of the wiper holder 112, and the wiper holder 112 starts to turn (time point t4).

Further, the toothless gear part 173*ba* of the gear cam 173*b* is disengaged from the partially toothless gear 112*a* of the wiper holder 112, and the wiper holder 112 stops its turning At this time, as shown in FIGS. 42 to 44, the wiping device 110 is located at a lower position, and the wiper 111 is in a "reset state (lower)", viz., the wiper 111 is in a stored state (time point t5).

In turn, the gear cams 173*a* (173*b*) is turned, and the capping device 130, together with the wiping device 110, starts to move upwards with the aid of the cam part 173*ab* (173*bb*) of the gear cam 173*a* (173*b*) (time point t6). Then, the normal rotation gear 172*b* reaches the toothless part 173*ac* of the toothless gear part 173*aa* forming the gear cam 173*a*, and the normal rotation gear 172*b* runs idle. Accordingly, the capping device 130 and the wiping device 110 stop their upward movements.

In this state, as shown in FIGS. 45 to 47, the capping device 130 is located at the top end position, and the cap 131 is in a "close" state, viz., in a capping state. At this time, the wiping device 110 is positioned at a position higher than the previous position, and the wiper 111 is in the "reset (upper)" state, viz., the wiper 111 has moved upwards while being stored (time point 7).

From this state, the motor further rotates in the normal turn direction to thereby turn the second gear 171*b* together with the first gear 171*a*, and the sucking device 150 is operated. In this state, the roller of the pump is in a "pinching" state to the tube, viz., in a sucking state (time points 8 and 9). Thus, the drive force is not transmitted to the pump when the wiping device 110 and the capping device 130 are in operation.

In the "reverse rotation" in FIG. 38, the capping device 130 and the wiping device 110 are reversely moved by the reverse rotation gear 172*c* with respect to the above operation. The gear 151 shown in FIG. 18 makes half turn, and a pawl of a disc 152 is pushed with a pawl of the gear 151, and the disc 152 starts to turn. During this period, the wiping device 110 and the capping device 130 end their operation. The sucking device 150 returns to the "release" state at the time points t3 and t4.

As described above, the head jetting property maintenance device 100 of the embodiment includes guiding/fixing devices 112*a*, 112*b*, 113*a*, 173*a*, 173*b*, 112*c* and 102*b* for guiding, at the time of positioning of the wiping device 110, the positioning operation of the wiping device, and for positioning and fixing the wiping device, and guiding/fixing devices 133*b*, 101*a*, 102*a*, 173*a* and 173*b* for guiding, at the time of positioning of the capping device 130, the positioning operation of the capping device, and for positioning and fixing the capping device.

With this feature, the wiping device 110 and the capping device 130 may be held at a fixed position. Therefore, if the user touches the wiping device 110 and the capping device 130, there is no chance that the wiping device 110 and the capping device 130 are displaced. Accordingly, there is no need for the work to return the wiping device 110 and the capping device 130 to predetermined positions. Further, there is no chance that parts forming the wiping device 110 and the capping device 130 collide with each other. In this respect, the maintenance work is easy.

The wiping device 110 and the capping device 130 are always positioned highly accurately. Further, there is no need of making the phase adjustment of the parts forming the wiping device 110 and the capping device 130 in assembling the head jetting property maintenance device 100. Accordingly, the cost to manufacture the head jetting property maintenance device 100 is reduced.

Figure 48:
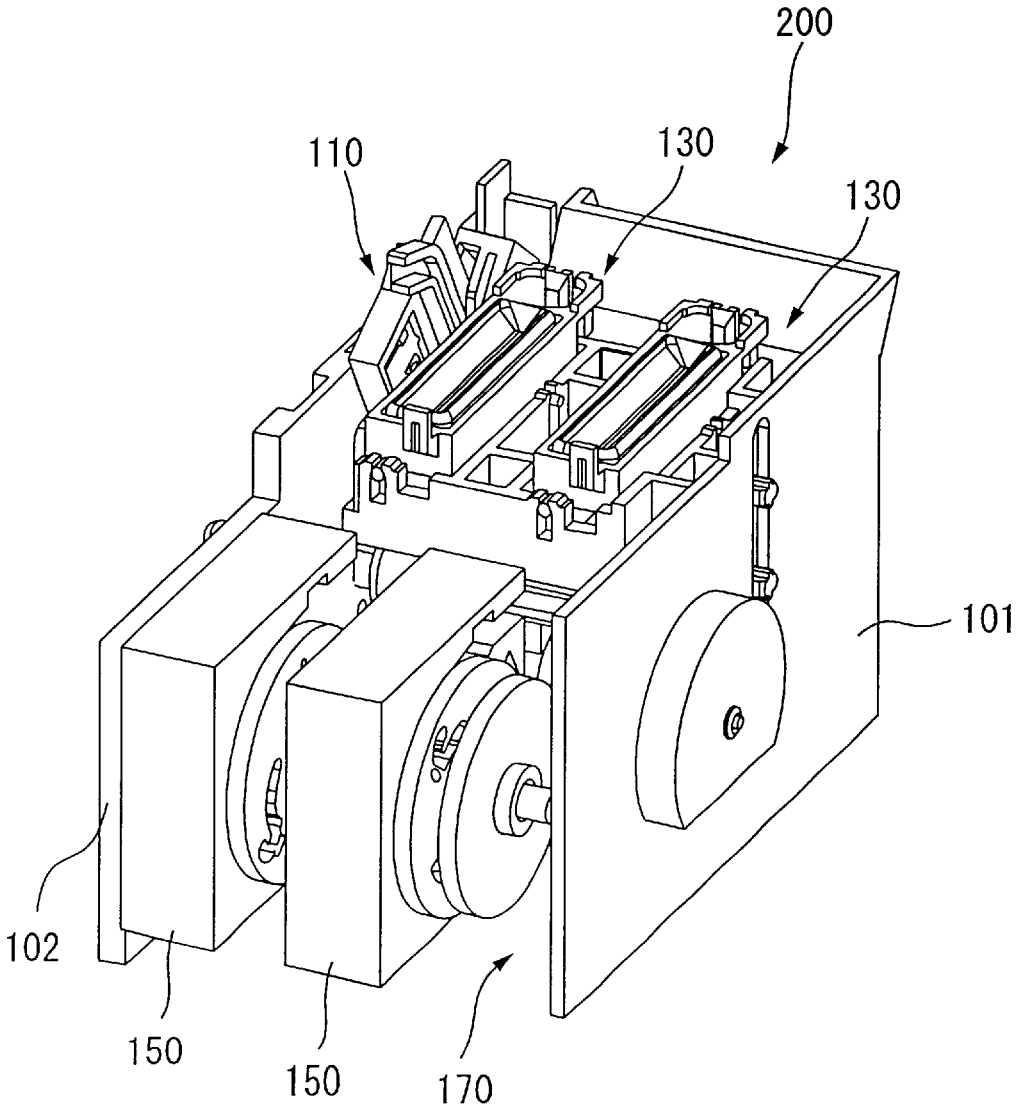
FIG. 48 is a perspective view showing another construction of a head jetting property maintenance device being assembled into a unit, which is an embodiment of the invention.

In the above embodiment, the description has been made on the head jetting property maintenance device 100 having one capping device 130 and one sucking device 150. It should be understood that the invention is not limited to such, but may be applied to a head jetting property maintenance device 200 having, for example, as shown in FIG. 48, two capping devices 130 and two sucking devices 150. If so constructed, similar useful effects are also produced.

In a case where the printing head 18 is disposed while inclining in the tuning direction of the wiper 111 as in the ink jet printer of the embodiment, the wiper 111 is also disposed while inclining. For this reason, when the wiper 111 has wiped the printing head 18, the ink wiped is not attached to the entire surface of the wiper 111, but gathers at the inclining lower end of the wiper 111, and is hanging therefrom.

Accordingly, when the wiper 111 is turned after the wiping operation ends, the ink gathered and hanging from the inclining lower end of the wiper 111, will fall off from the wiper 111 by the turning force of the wiper 111. Therefore, the head jetting property maintenance device, even if it does not have the wiper cleaner 113 for removing ink attaching to the wiper 111, may be applied to the ink jet printer in which the printing head 18 is disposed while inclining in the turning direction of the wiper 111.

To prevent the ink falling from the inclining lower end of the wiper 111 from staining the ink jet printer, an ink absorber 180 may be placed under the wiper 111 after turned, as shown in FIG. 30, for example. An open-cell foam made of synthetic resin, a fibrous aggregate such as non-woven fabric or the like may be used as the ink absorber 180. If the ink absorber 180 as mentioned above is used, the ink having fallen off from the wiper 111 may stably be contained within the ink absorber without leaking, and the replacement work of the same is easy.

As described above, in the head jetting property maintenance device of the embodiment and the ink jet printer with the same, the wiping device and the capping device may be held at a fixed position. Therefore, if the user touches the wiping device and the capping device, there is no chance that the wiping device and the capping device are displaced. Accordingly, there is no need for the work to return the wiping device and the capping device to predetermined positions. Further, there is no chance that parts forming the wiping device and the capping device are broken by colliding with each other. In this respect, the maintenance work is easy.

The wiping device and the capping device are always positioned highly accurately. Further, there is no need of making the phase adjustment of the parts forming the wiping device and the capping device in assembling the head jetting property maintenance device. Accordingly, the cost to manufacture the head jetting property maintenance device is reduced.

Figure 49:
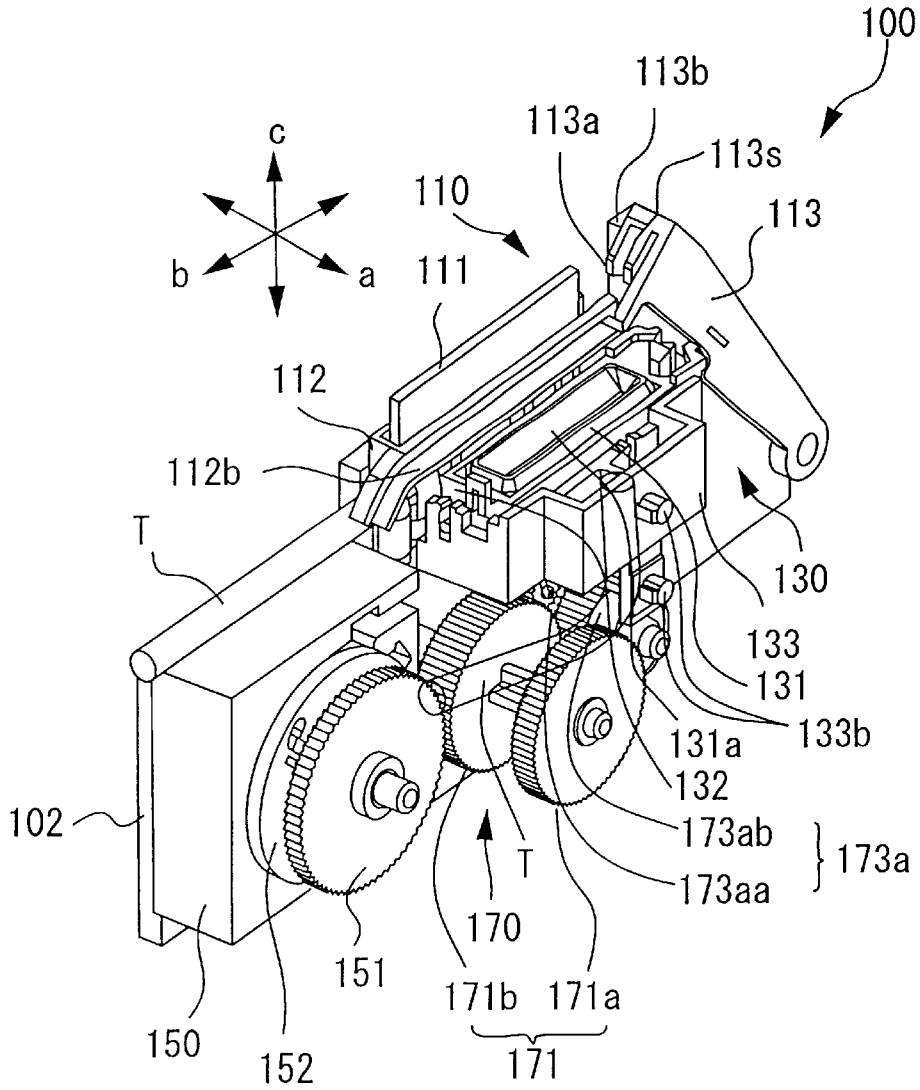
FIG. 49 is a perspective view showing a construction of a head jetting property maintenance device being assembled into a unit, which is a third embodiment of the invention.
Figure 50:
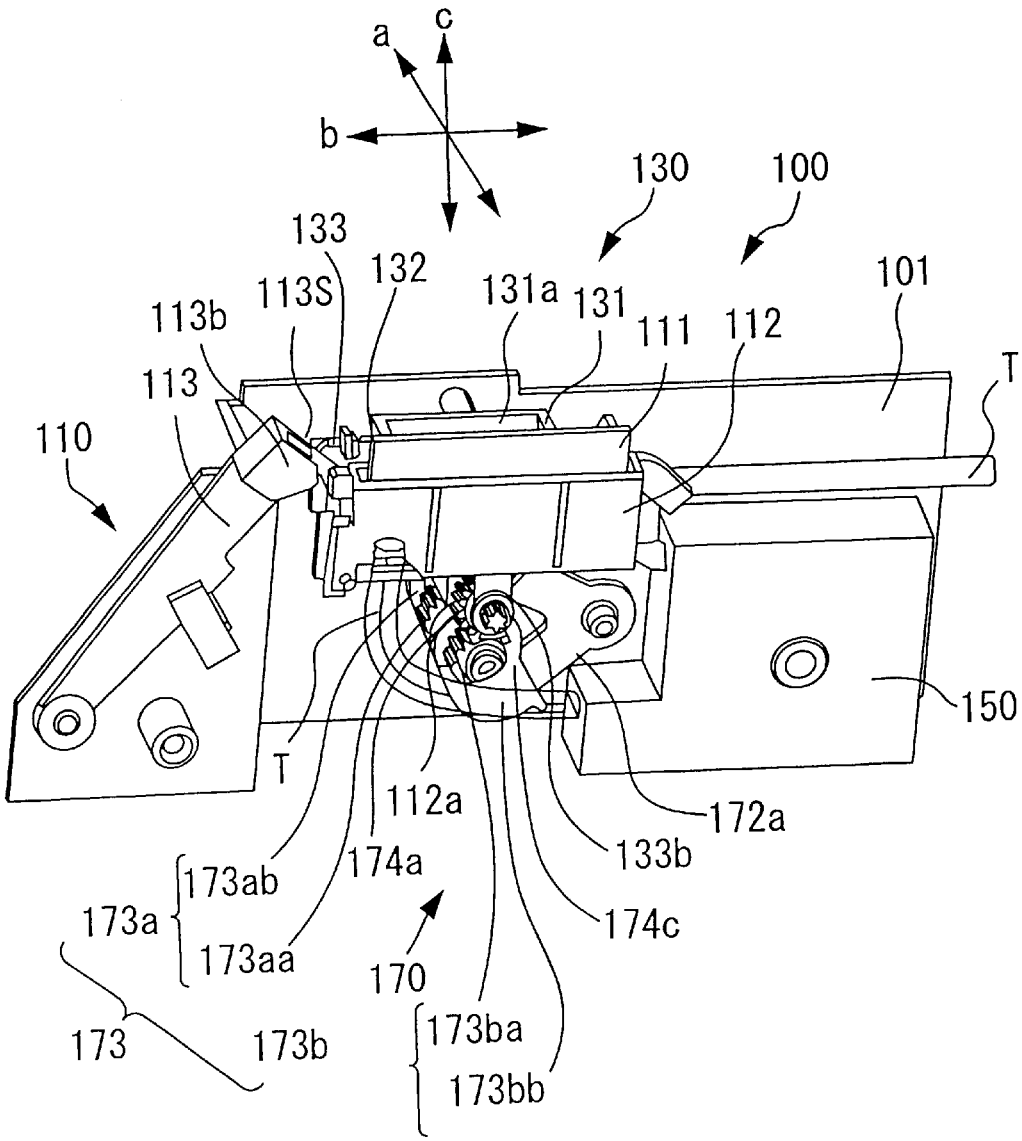
FIG. 50 is a perspective view showing the FIG. 49 head jetting property maintenance device as viewed from the opposite side.
Figure 51:
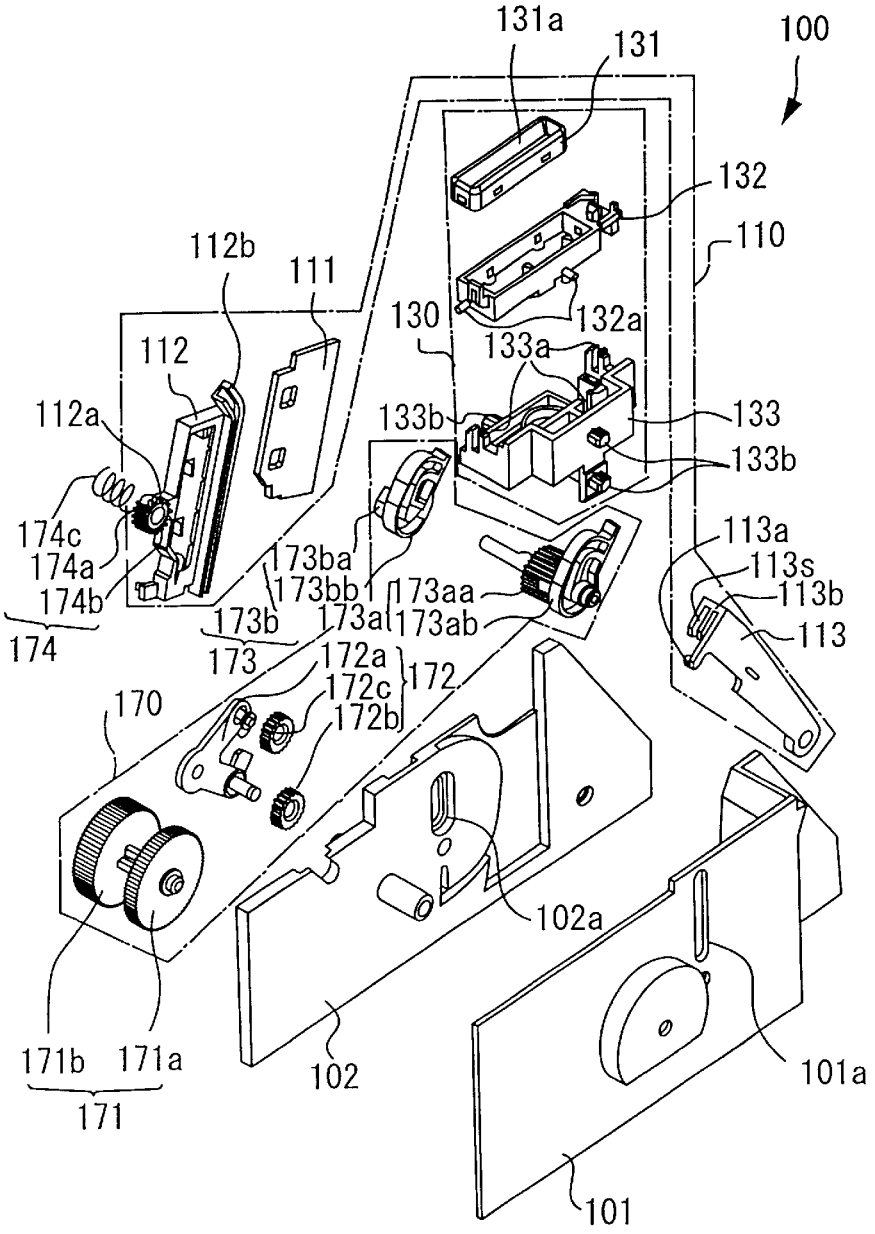
FIG. 51 is an exploded, perspective view showing the FIG. 49 head jetting property maintenance device.

FIG. 49 is a perspective view showing a construction of a head jetting property maintenance device being assembled into a unit, which is a third embodiment of the invention. FIG. 50 is a perspective view showing the FIG. 49 head jetting property maintenance device as viewed from the opposite side. FIG. 51 is an exploded, perspective view showing the FIG. 49 head jetting property maintenance device.

The head jetting property maintenance device 100 includes the wiping device 110, the capping device 130, sucking device 150 and the driving device 170 for driving those devices, as shown in FIGS. 49 to 51. In FIG. 49, one side frame 101 shown in FIG. 51 is omitted from the illustration to show an internal structure of the device. In FIG. 50, the other side frame 102 shown in FIG. 51 is omitted from the illustration to show the internal structure thereof. In FIG. 51, the sucking device 150 is omitted therefrom for the simplicity of the illustration.

The head jetting property maintenance device 100 is constituted by the wiping device 110 which wipes the nozzle forming surface according to the necessity in the main scan direction, i.e., lateral direction, of the printing head 18 as indicated by an arrow "a" in FIGS. 49 and 50; the capping device 130, which is pressed against the nozzle forming surface of the printing head 18 to seal the nozzle orifices in a non-print mode; the sucking device 150, which forcibly sucks ink and discharges it to remove the clogging of the nozzle orifices and air bubbles having entered into the ink; and the driving device 170 is provided for driving the wiping device 110 and the capping device 130 so as to position those devices at predetermined positions, and driving the sucking device 150. Those are disposed between two side frames 101 and 102 and assembled into a unit like a box.

The wiping device 110 and the capping device 130 are disposed side by side in the main scan direction of the printing head 18. The sucking device 150 is disposed on the side of the wiping device 110 and the capping device 130 as viewed in the sub-scan direction as indicated by an arrow "b" in FIGS. 49 and 50. The driving device 170 is disposed so as to allow the wiping device 110, the capping device 130 and the sucking device 150 to operate in an interlocking manner. Specifically, the driving device 170 turns the wiping device 110 in the sub-scan direction, and moves the capping device 130 together with the wiping device 110 in the vertical direction as indicated by an arrow "c" in FIGS. 49 and 50 to thereby operate the sucking device 150.

The wiping device 110 includes the wiper 111, the wiper holder 112 and the wiper cleaner 113 as shown in FIGS. 49 to 51. The wiper 111 is made of rubber and takes a shape of a substantially rectangular and flat plate. The tip end of the wiper rubs the nozzle forming surface of the printing head 18. With this arrangement, the wiper 111 wipes out ink attached to the nozzle forming surface. The wiper 111 may be made of felt or plastic depending on the kind of the ink used.

The wiper holder 112 is made of plastic and takes a substantially rectangular and flat plate shape. The wiper holder 112 holds the wiper 111 in a state that the tip end of the wiper protrudes from the upper end of the wiper holder. In this state, the wiper holder turns about a shaft support part 112*a* provided at the lower end thereof and rotatably supported by the second cap holder 133 of the capping device 130 to be described later, in the sub-scan direction. With this mechanical arrangement, the wiper holder 112 may put the wiper 111 at an upper position when it is used, and may put the same at a lower position when it is not used.

The wiper cleaner 113 is made of plastic and shaped like a blade. The wiper cleaner operates in a manner that the guide pin 113*a* provided at one end of the wiper cleaner is guided by the guide groove 112*b* formed in the wiper holder 112, and the wiper cleaner turns about the other end thereof rotatably supported by the side frame 101, and the ink scriber 113*b*, shaped like "U" in cross section, and provided on the one end thereof, rubs the wiper 111 while holding the wiper therebetween. Thus, the wiper cleaner 113 removes the ink attaching to the wiper 111.

The capping device 130 includes the cap 131, the first cap holder 132 and the second cap holder 133, as shown in FIGS. 49 to 51. The cap 131 is made of rubber and is substantially rectangular parallelepiped in shape. The recess 131*a* formed in an upper part of the cap is pressed against the nozzle forming surface of the printing head 18. With this mechanical arrangement, the capping device 130 seals the nozzle orifices.

The first cap holder 132 is made of plastic and is substantially rectangular parallelepiped in shape. The first cap holder 132 holds the cap 131 in a state that the upper edge of the cap protrudes from the upper surface of the cap holder. A spring (not shown) is interposed between the first cap holder 132 and the second cap holder 133. The projections 132*a* provided on the side surfaces of the first cap holder are engaged with the pawls 133*a* of the second cap holder 133 and stopped. In this state, the first cap holder 132 is minutely movable in all directions. With this mechanical arrangement, the first cap holder 132 is able to press the cap 131 against the nozzle forming surface of the printing head 18 such that the upper edge of the cap is aligned with the nozzle forming surface. As a result, those are made to be in close contact with each other.

The second cap holder 133 is made of plastic and is substantially rectangular parallelepiped in shape. The second cap holder 133 operates such that it holds the first cap holder 132 on the upper end face thereof, guide pins 133*b* provided on the side faces of the second cap holder are guided by the guide grooves 101*a* and 102*a* respectively formed in the side frames 101 and 102, and the second cap holder vertically moves, together with the wiper 111 and the wiper holder 112. With this arrangement, the cap 131 is positioned and fixed at an upper position when it is in use, and positioned and fixed at a lower position when it is not in use with the movement of the second cap holder 133.

The sucking device 150 is a normal pulsation pump, and successively presses over a predetermined range of the tube T connected to the cap 131, by a plurality of rollers arrayed at fixed intervals in a rotational direction thereof to thereby force the air out of the tube. In this way, the sucking device forcibly sucks the ink in the printing head 18 and discharges it outside. By so constructed, the sucking device 150 removes the clogging of the nozzle orifices and air bubbles having entered into the ink.

The driving device 170, as shown in FIGS. 49 to 51, includes the drive force transmission device 171, the normal/reverse rotation switching device 172, a rotation/vertical-movement device 173 and a friction clutch mechanism 174. The drive force transmission device 171 includes the first gear 171*a* disposed protruding from the side frame 101, and the second gear 171*b*, which is disposed coaxially with the first gear 171*a* and disposed between the side frames 101 and 102. The first gear 171*a* is coupled to a motor (not shown) disposed outside the side frame 101. The second gear 171*b* is in mesh with the gear 151 of the sucking device 150 shown in FIG. 2.

The normal/reverse rotation switching device 172 includes the switch arm 172*a* shaped like "L", the normal rotation gear 172*b* and the reverse rotation gear 172*c* rotatably mounted on both the ends of the switch arm. The switch arm 172*a* is fit, at the central part, to the shaft of the second gear 171*b* and pressed against the second gear 171*b* by a spring (not shown). Either the normal rotation gear 172*b* or the reverse rotation gear 172*c* meshes with the second gear 171*b* depending on the rotational direction of the second gear 171*b*, and both the rotation gears alternately mesh with the toothless gear part 173*aa* of the gear cam 173*a* forming the rotation/vertical-movement device 173 to be further described.

The rotation/vertical-movement device 173 includes the two gear cams 173*a* and 173*b*, which are respectively mounted on both ends of one shaft. The gear cams 173*a* and 173*b* are constituted so that toothless gear parts 173*aa* and 173*ba* are integrated with the cam part 173*ab* and 173*bb*, respectively. The toothless gear part 173*aa*, as described above, is disposed so as to mesh alternately with the normal rotation gear 172*b* and the reverse rotation gear 172*c* of the normal/reverse rotation switching device 172. The toothless gear part 173*ba* is disposed so as to fit together with a partially toothless gear 174*a* of the friction clutch mechanism 174. The cam parts 173*ab* and 173*bb* are respectively disposed so as to be in contact with the lower parts of the two guide pins 133*b* provided on both sides of the lower part of the second cap holder 133.

The friction clutch mechanism 174 includes the partially toothless gear 174*a* disposed on one gear cam 173*b* side, a normal gear 174*b* and a compression spring 174*c* by which the partially toothless gear 174*a* and the normal gear 174*b* are mutually pressed. The partially toothless gear 174*a* is integrally formed on the shaft support part 112*a* of the wiper holder 112. The normal gear 174*b* is disposed coaxially with the partially toothless gear 174*a* and in close contact therewith. The partially toothless gear 174*a* and the normal gear 174*b* are disposed so as to mesh with the toothless gear part 173*ba* of the gear cam 173*b*. The compression spring 174*c* is disposed so as to press the partially toothless gear 174*a* against the normal gear 174*b* and vice versa in the axial direction.

The friction clutch mechanism 174 discussed and illustrated are provided with the partially toothless gear 174*a*, the normal gear 174 band the compression spring 174*c*. It should be understood that the present invention is not limited to such, but may be applied to the friction clutch mechanism having two drive force transmission devices and a pressing means for pressing the drive force transmission devices one against the other. That is, a friction clutch mechanism which transmits the drive force when the wiping device 110 is driven to start its turn, and releases the drive force when the wiping device is stopped in turn, may be used.

With this mechanical arrangement, the drive force of the motor is transmitted to the wiping device 110 by a rout of the first gear 171*a* and the second gear 171*b*, and a further route starting from the normal rotation gear 172*b* or the reverse rotation gear 172*c*, switched by the turning of the switch arm 172 and subsequently including the toothless gear part 173*aa* of the gear cam 173*a*, the toothless gear part 173*ba* of the gear cam 173*b*, and the partially toothless gear 174*a* and the normal gear 174*b*.

The drive force is further transmitted to the wiping device 110 and the capping device 130, through the cam part 173*ab* of the gear cam 173*a* and the cam part 173*bb* of the gear cam 173*b*. The drive force is also transmitted through the gear 151 to the sucking device 150. As a result, the wiping device 110 is turned, the capping device 130 is moved, together with the wiping device 110, in the vertical direction, and the sucking device 150 is operated.

Figure 52:
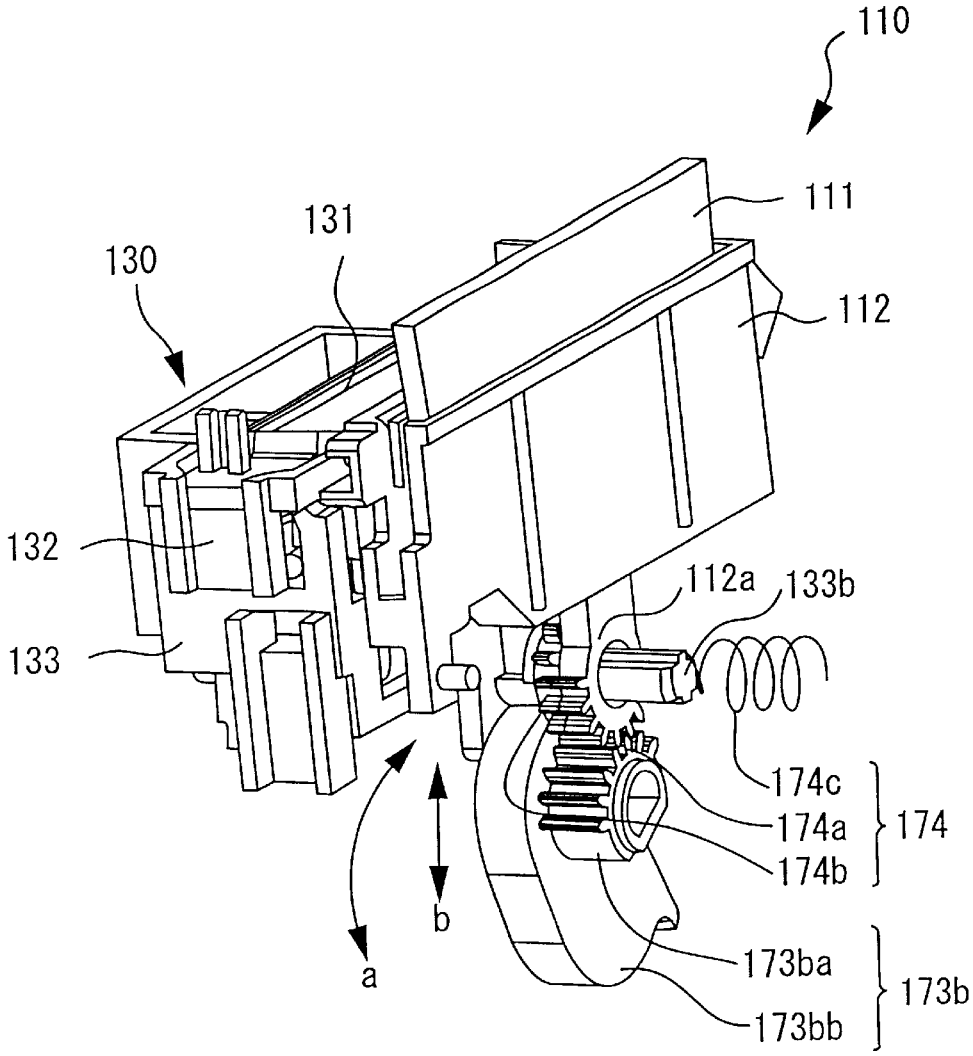
FIG. 52 is a perspective view showing a disposing relationship between a key portion of the wiping device of the FIG. 49 head jetting property maintaining device and the capping device and the gear cam.

A disposing relationship between a key portion of the wiping device 110 thus constructed and the capping device 130 and the gear cam 173*b* and the friction clutch mechanism 174 will be described in detail with reference to FIG. 52. Subsequently, the operations of the devices 110 and 130 will be described with reference to FIGS. 53 through 68. As shown in FIG. 52, the guide pin 133*b* provided on the second cap holder 133 of the capping device 130 is inserted into a shaft hole of the shaft support part 112*a* provided on the wiper holder 112 of the wiping device 110.

The gear cam 173*b* is disposed such that the toothless gear part 173*ba* meshes with the partially toothless gear 174*a* of the friction clutch mechanism 174 formed on the shaft support part 112*a* and the normal gear 174*b* being in close contact with the partially toothless gear 174*a*, and the cam part 173*bb* meshes with the guide pin 133*b* formed on the second cap holder 133. With this arrangement, the wiping device 110 is turned in the direction of the arrow "a" in the figure, and the capping device 130 is vertically moved together with the wiping device 110 in the direction of the arrow "b" in the figure.

Figure 57:
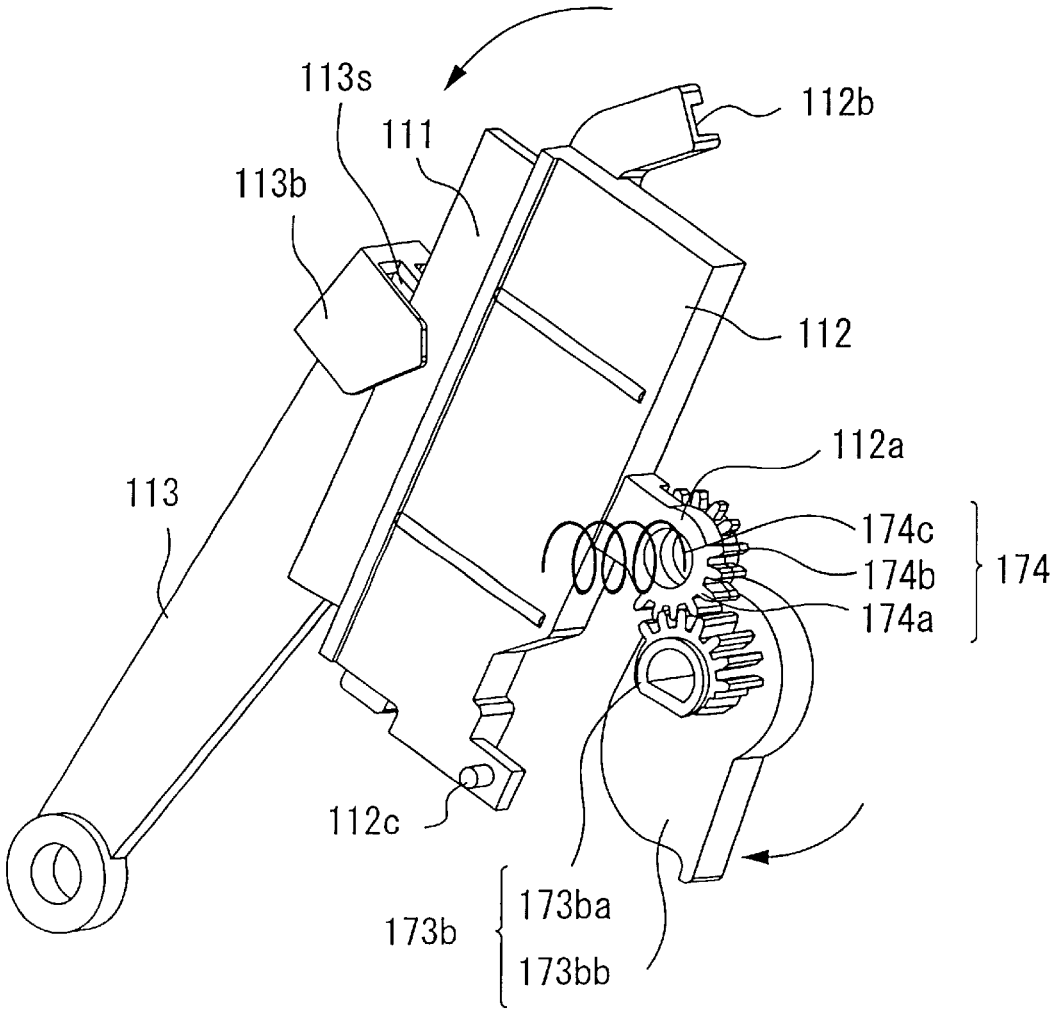
FIG. 57 is a fifth diagram showing the operation of the FIG. 52 wiping device.
Figure 58:
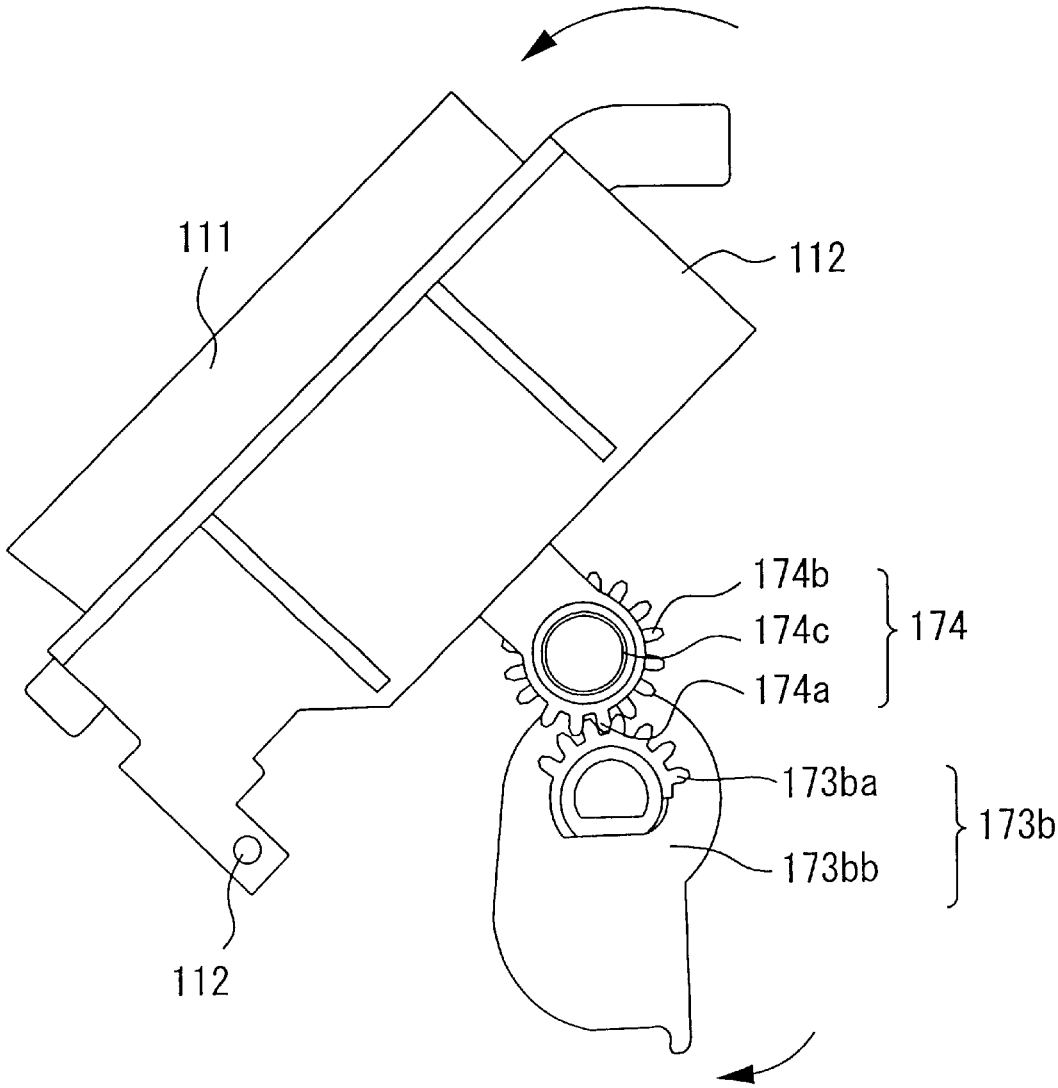
FIG. 58 is a sixth diagram showing the operation of the FIG. 52 wiping device.
Figure 59:
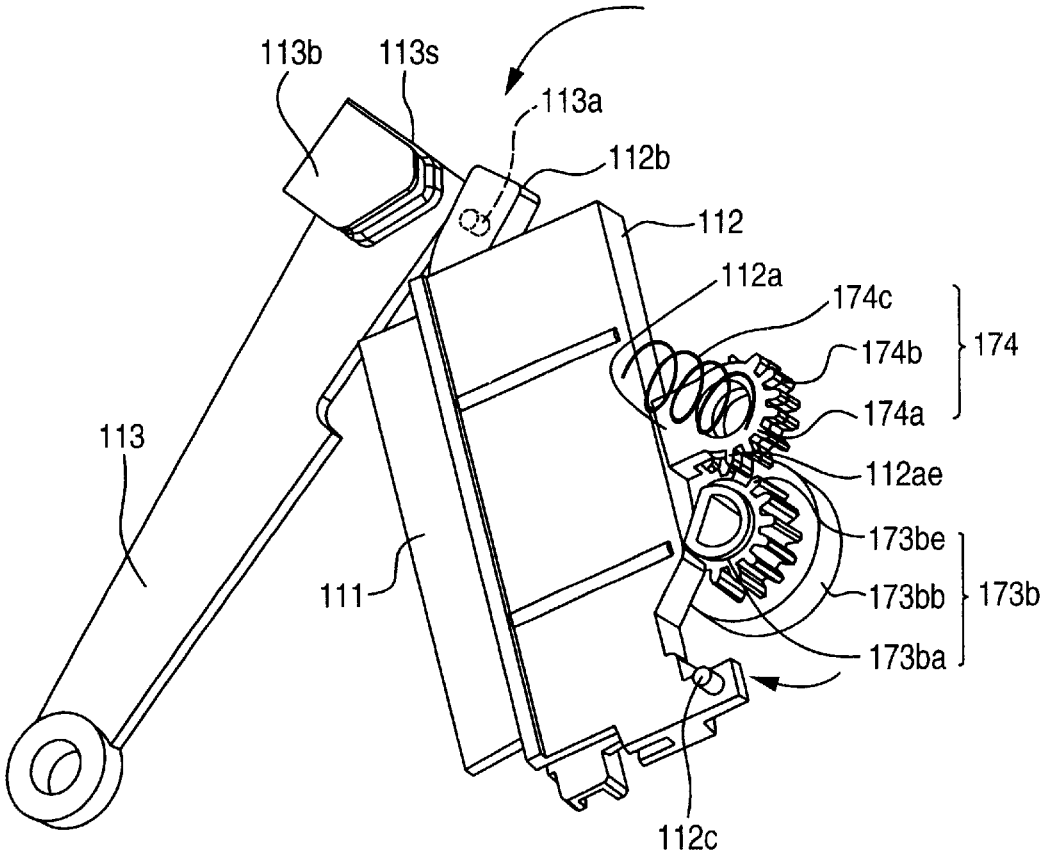
FIG. 59 is a seventh diagram showing the operation of the FIG. 52 wiping device.
Figure 60:
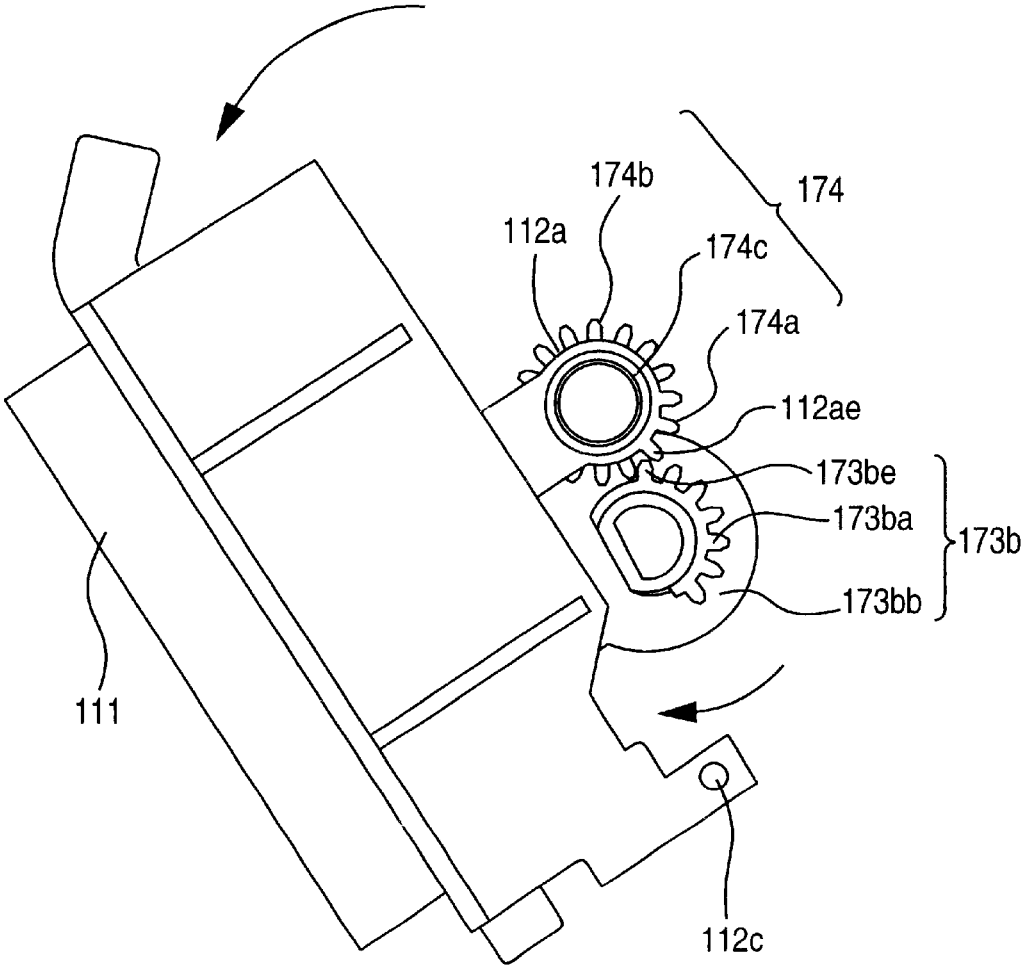
FIG. 60 is an eighth diagram showing the operation of the FIG. 52 wiping device.
Figure 61:
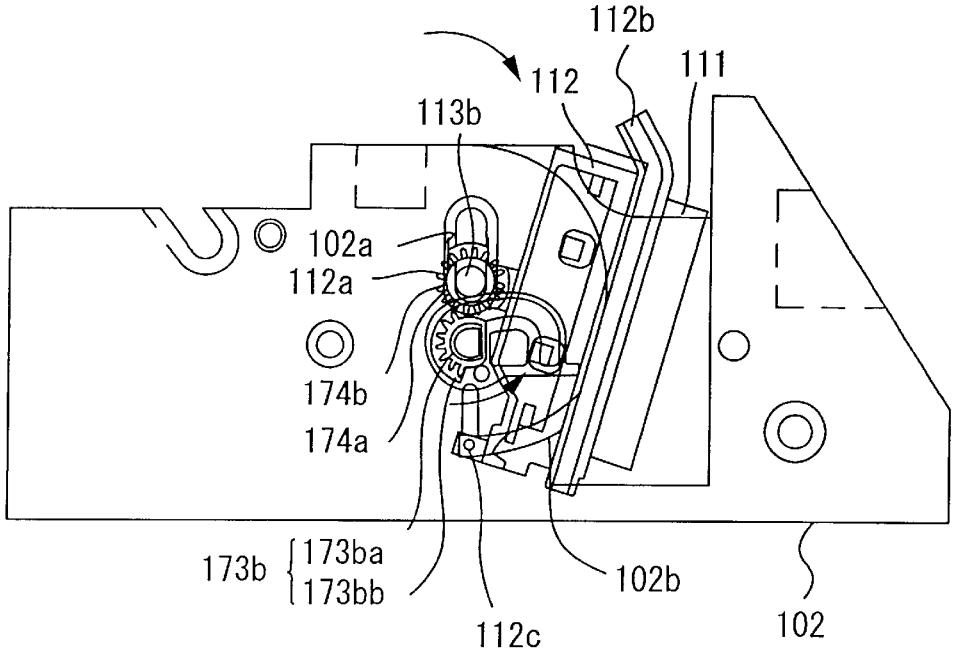
FIG. 61 is a ninth diagram showing the operation of the FIG. 52 wiping device.
Figure 62:
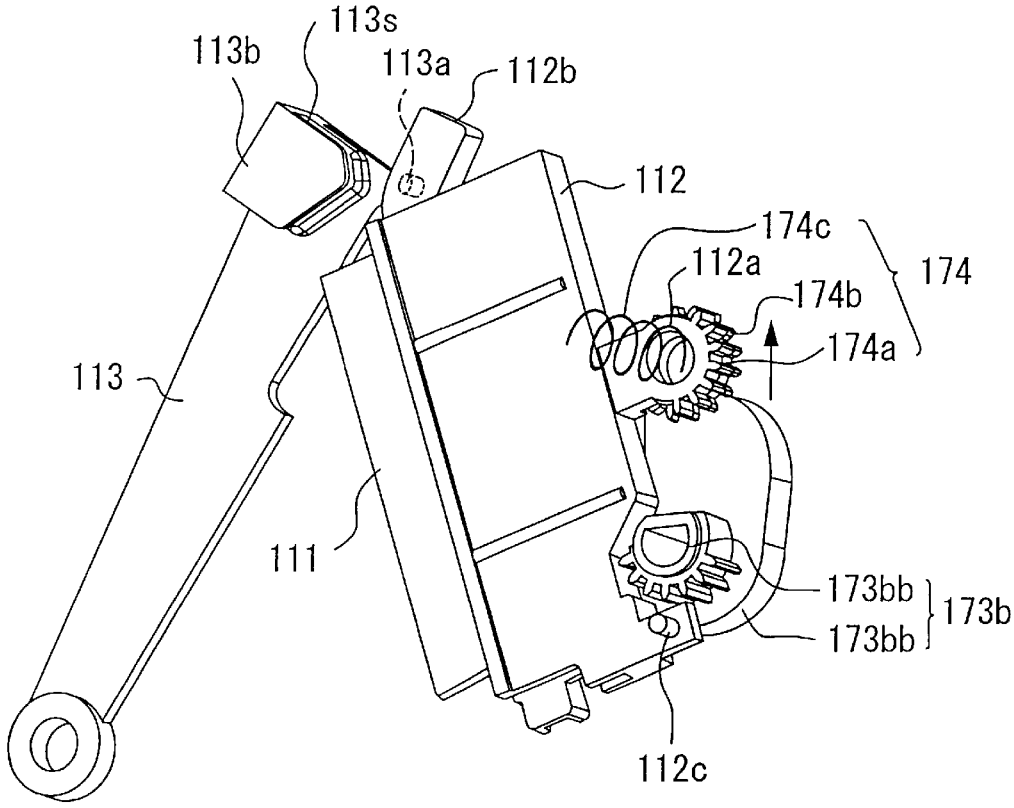
FIG. 62 is a tenth diagram showing the operation of the FIG. 52 wiping device.
Figure 63:
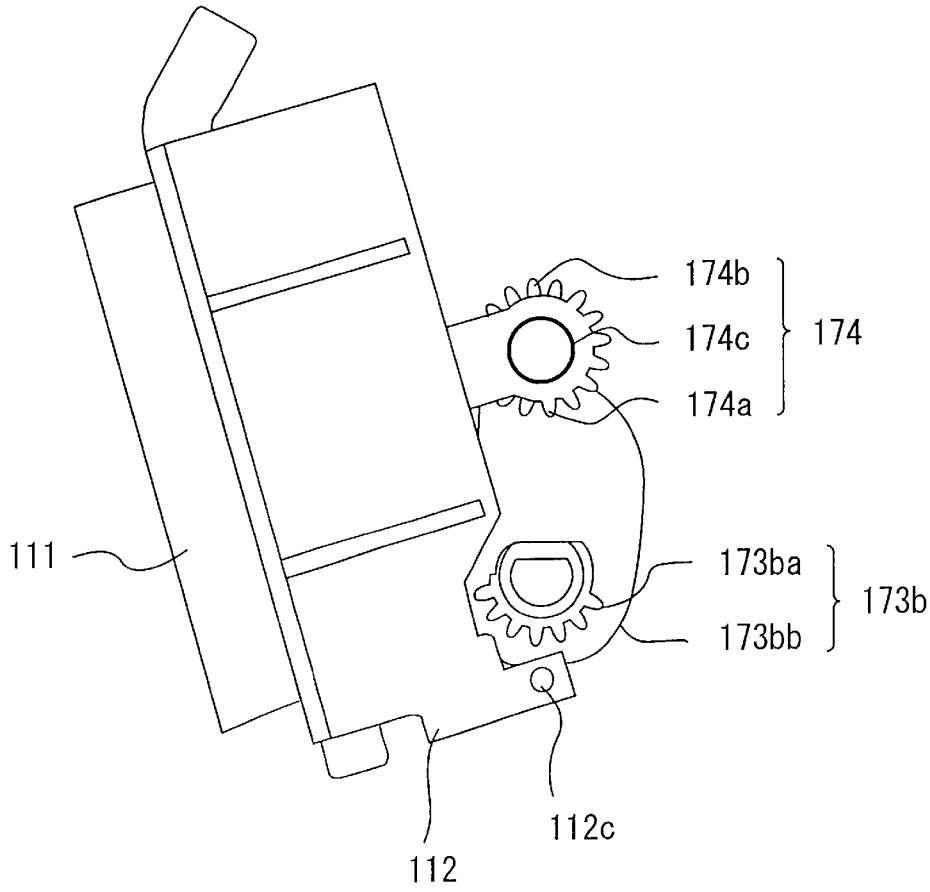
FIG. 63 is an eleventh diagram showing the operation of the FIG. 52 wiping device.
Figure 64:
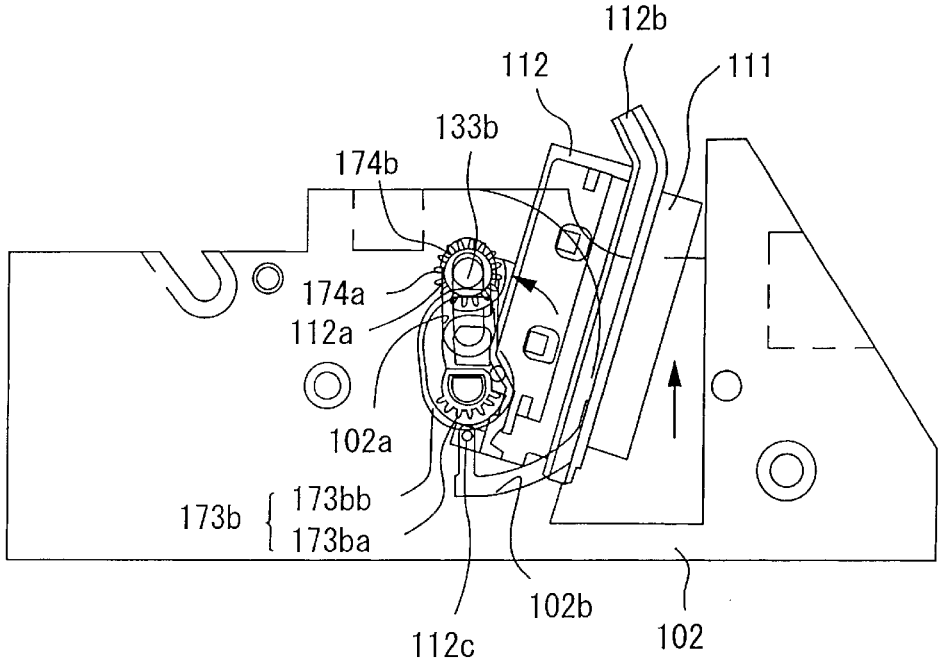
FIG. 64 is a twelfth diagram showing the operation of the FIG. 52 wiping device.

The operation of the wiping device 110 will be described with reference to FIGS. 53 through 64. Of those figures, FIGS. 53 to 56, FIGS. 57 and 58, FIGS. 59 to 61 and FIGS. 62 to 64 respectively illustrate the same operation state from different points of views. Specifically, FIGS. 53 to 56 show a state allowing the wiper 111 to perform the wiping operation. FIGS. 57 and 58 show a state that the wiper 111 is on the way of being stored. FIGS. 59 to 61 show a state that the storing of the wiper 111 is completed. FIGS. 62 to 64 show a state that the wiping device 110 has risen together with the capping device 130.

Figure 53:
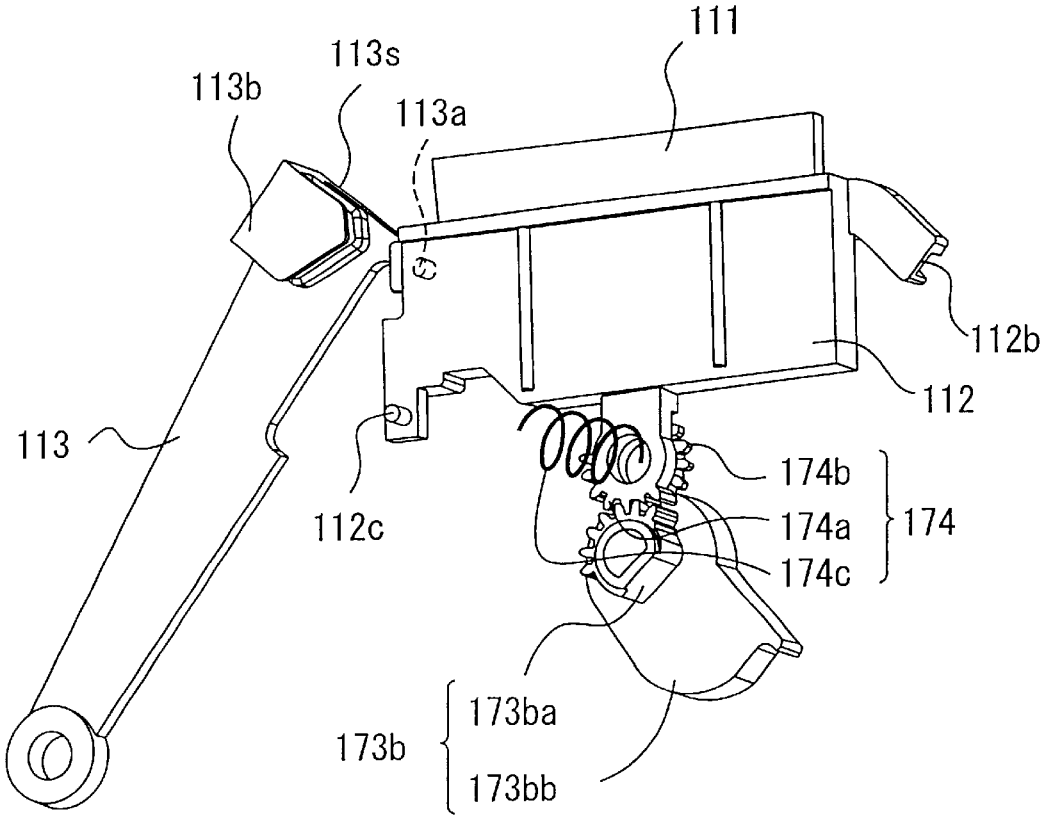
FIG. 53 is a first diagram showing the operation of the FIG. 52 wiping device.

To start with, in the state allowing the wiper 111 to perform the wiping operation, as shown in FIG. 53, the wiper 111 is positioned and fixed while being directed upward, and the wiper cleaner 113 is positioned and fixed at one end of the wiper holder 112. Those are positioned and fixed in the following way.

Figure 55:
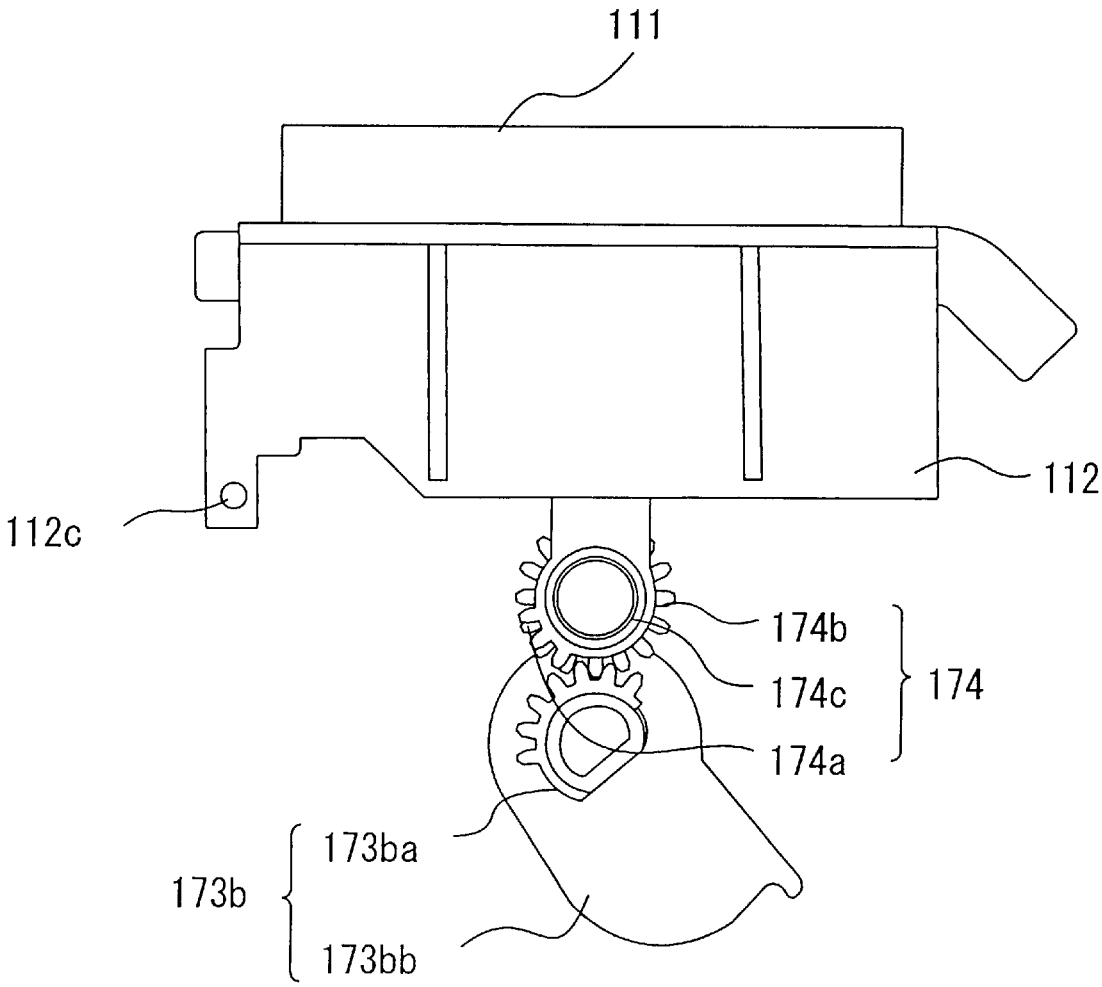
FIG. 55 is a third diagram showing the operation of the FIG. 52 wiping device.

As shown in FIGS. 53 and 55, the toothless gear part 173*ba* formed on the gear cam 173*b* is not in mesh with the partially toothless gear 174*a* of the friction clutch mechanism 174, but it meshes with only the normal gear 174*b*. For this reason, the drive force transmitted from the toothless gear part 173*ba* is transmitted only to the partially toothless gear 174*a*, not to the partially toothless gear 174*a*. Accordingly, the partially toothless gear 174*a* runs idle. Therefore, the wiper holder 112 integral with the partially toothless gear 174*a* does not turn, and the wiper 111 is positioned and fixed while being directed upward.

Figure 54:
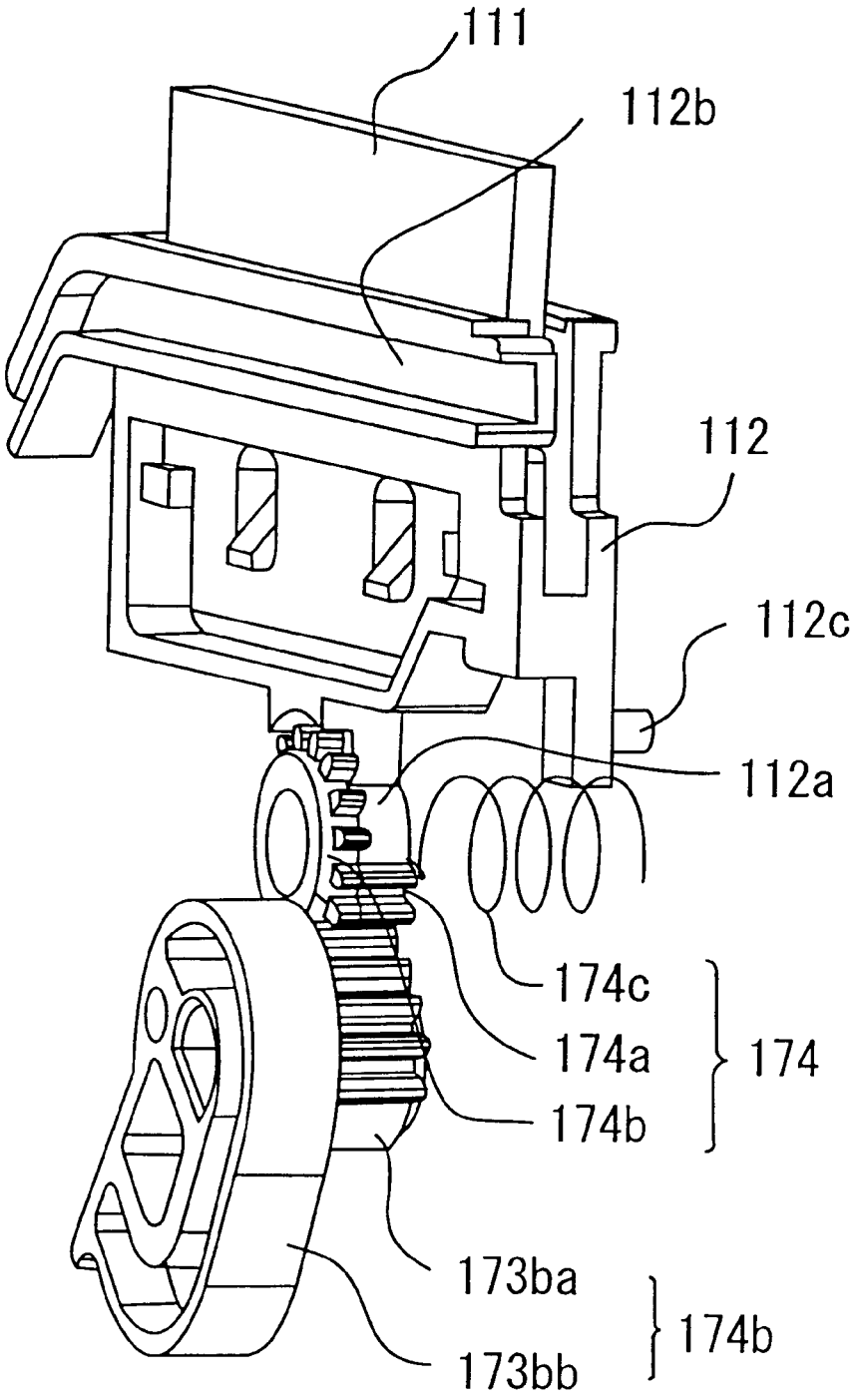
FIG. 54 is a second diagram showing the operation of the FIG. 52 wiping device.

As shown in FIG. 53, the guide pin 113*a* of the wiper cleaner 113 is inserted into the guide groove 112*b* formed in the wiper holder 112 shown in FIGS. 53 and 54. With this, the wiper cleaner 113 is positioned to the wiper holder 112, whereby the wiper cleaner 113 is positioned and fixed to the end side of the wiper holder 112.

Figure 56:
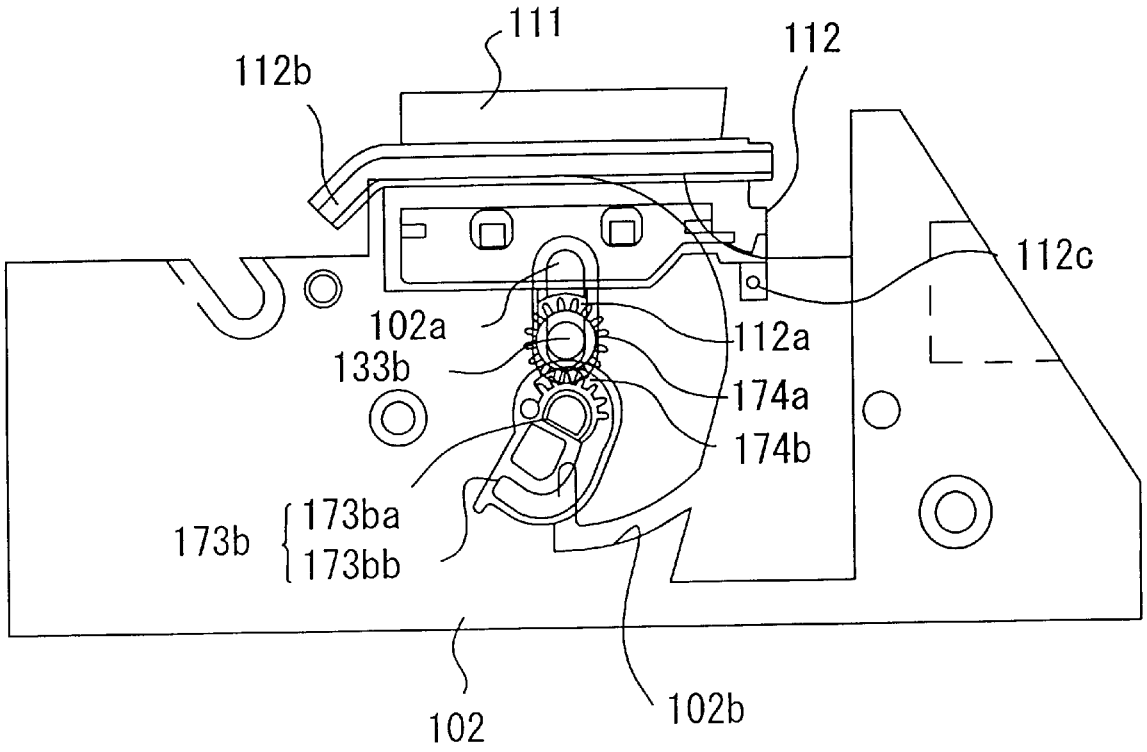
FIG. 56 is a fourth diagram showing the operation of the FIG. 52 wiping device.

FIG. 56 is a diagram showing a layout of the guide pin 112*c* formed on the wiper holder 112 serving as a guide when the wiper holder 112 rotates, and the guide groove 102*b* formed in the side frame 102. In this state, viz., a state that the wiping by the wiper 111 is allowed, those are separated from each other and are nonfunctional.

In the state that the wiper 111 is on the way of being stored, as shown in FIG. 57, the wiper holder 112 is inclined, and the wiper 111 is put in the ink scriber 113*b* of the wiper cleaner 113. This is performed in the following way. The gear cam 173*b* starts to turn. Then, the toothless gear part 173*ba* of the gear cam 173*b* turns the normal gear 174*b* of the friction clutch mechanism 174, and at the same time, turns the partially toothless gear 174*a*, which is pressed by the compression spring 174*c*, by the frictional force.

Subsequently, the toothless gear part 173*ba* meshes with the gear 174*b* and the partially toothless gear 174*a* at the same instant, as shown in FIGS. 57 and 58. With this mechanism, when a large load which cannot be handled with the frictional clutch acts thereon, the wiper holder 112 may smoothly be turned. Further at the same instant, the guide pin 113*a* of the wiper cleaner 113 is guided by the guide groove 112*b* in the wiper holder 112. In this state, the ink scriber 113*b* of the wiper cleaner 113 rubs the wiper 111 while holding the wiper therebetween. Accordingly, the wiper 111 is stored while scribing the ink sticking thereto.

In the state that the storing of the wiper 111 is completed, as shown in FIG. 59, the wiper 111 is positioned and fixed while being directed obliquely downwards, and the wiper cleaner 113 is positioned and fixed at the other end side of the wiper holder 112. This positioning and fixing operation is performed in the following way.

As shown in FIGS. 59 and 60, when one move the wiper 111 in a set direction, the tooth 112*ae* at the end of the partially toothless gear 112*a* is abutted against the other arcuate part 173*bd* of the toothless gear part 173*ba* forming the gear cam 173*b*. Accordingly, it is impossible to further move the wiper 111 in the set direction.

On other hand, as shown in FIG. 61, when one moves the wiper 111 in a reset direction, the guide pin 112*c* of the wiper holder 112 hits the left wall of the guide groove 102*a* in the side frame 102. Accordingly, it is impossible to further move the wiper 111 in the reset direction. As a result, the wiper holder 112 is positioned to the gear cam 173*b* and the side frame 102, and the wiper 111 may be positioned and fixed while being directed obliquely downwards.

As shown in FIG. 59, the guide pin 113*a* of the wiper cleaner 113 has relatively moved to the other end of the wiper holder 112 along the guide groove 112*b* of the wiper holder 112. As a result, the wiper cleaner 113 is positioned to the wiper holder 112, and accordingly, the wiper cleaner 113 may be positioned and fixed at a position close to the end-most part of the other end of the wiper holder 112.

Finally, in a state that the wiping device 110 rises together with the capping device 130, as shown in FIGS. 62 to 63, the wiper 111 separates from the gear cam 173*b* while being directed obliquely downward, and positioned and fixed, and the wiper cleaner 113 is positioned and fixed at the other end side of the wiper holder 112. The positioning and fixing operations of them are performed in the following way.

Specifically, as shown in FIG. 64, the cam parts 173*ab* and 173*bb* of the gear cams 173*a* and 173*b* push upward the guide pins 133*b* of the second cap holder 133 along the guide grooves 101*a* and 102*a* of both side frames 101 and 102.

As shown in FIG. 64, the guide pin 112*c* of the wiper holder 112 is inserted into the vertical part of the guide groove 102*a* in the side frame 102. As a result, the wiper holder 112 is positioned to the gear cams 173*a* and 173*b* and the side frame 102. Accordingly, the wiper 111 separates from the gear cams 173*a* and 173*b* while being directed obliquely downwardly, and are positioned and fixed.

Further, as shown in FIG. 62, the guide pin 113*a* of the wiper cleaner 113 is relatively moved to a position close to the end-most part of the other end of the wiper holder 112 along the guide groove 112*b* of the wiper holder 112. As a result, the wiper cleaner 113 is positioned to the wiper holder 112, so that the wiper cleaner 113 may be positioned and fixed at a position close to the end-most part of the other end of the wiper holder 112.

Figure 65:
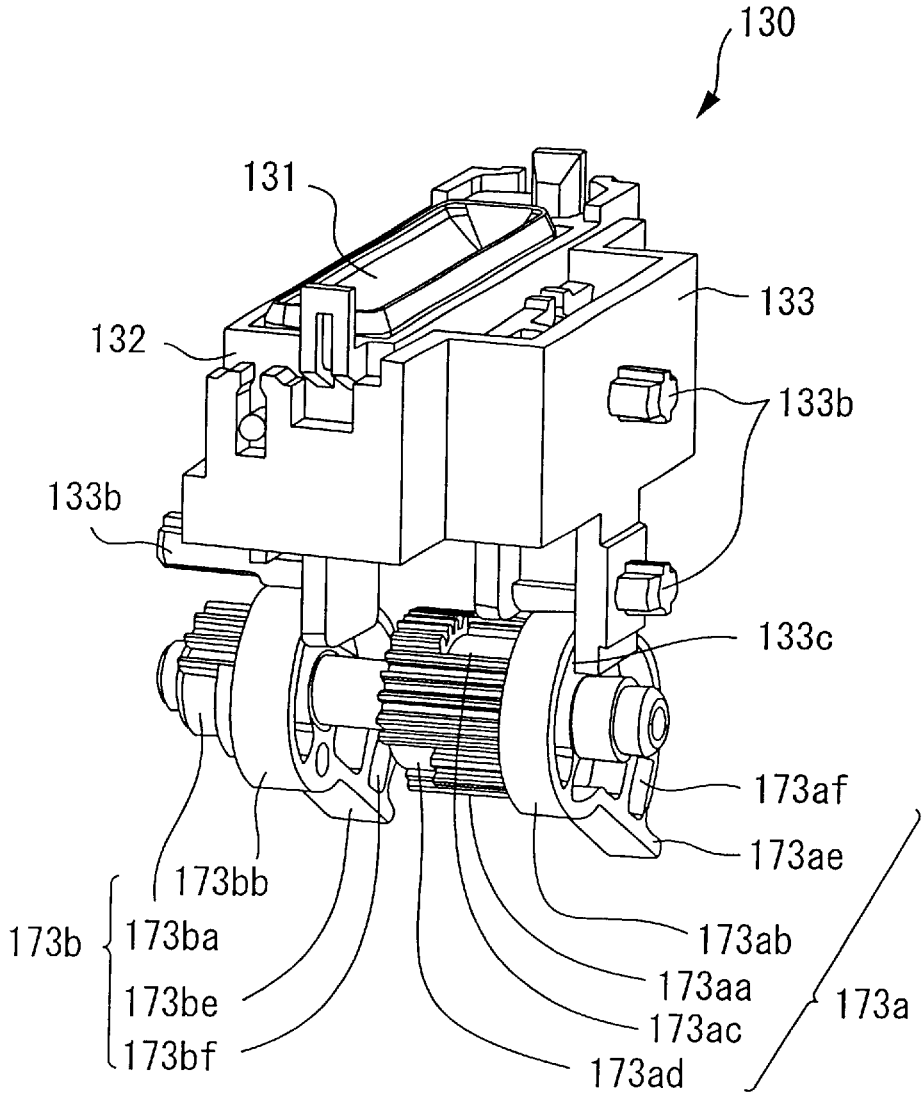
FIG. 65 is a first diagram showing the operation of the FIG. 52 capping device.
Figure 66:
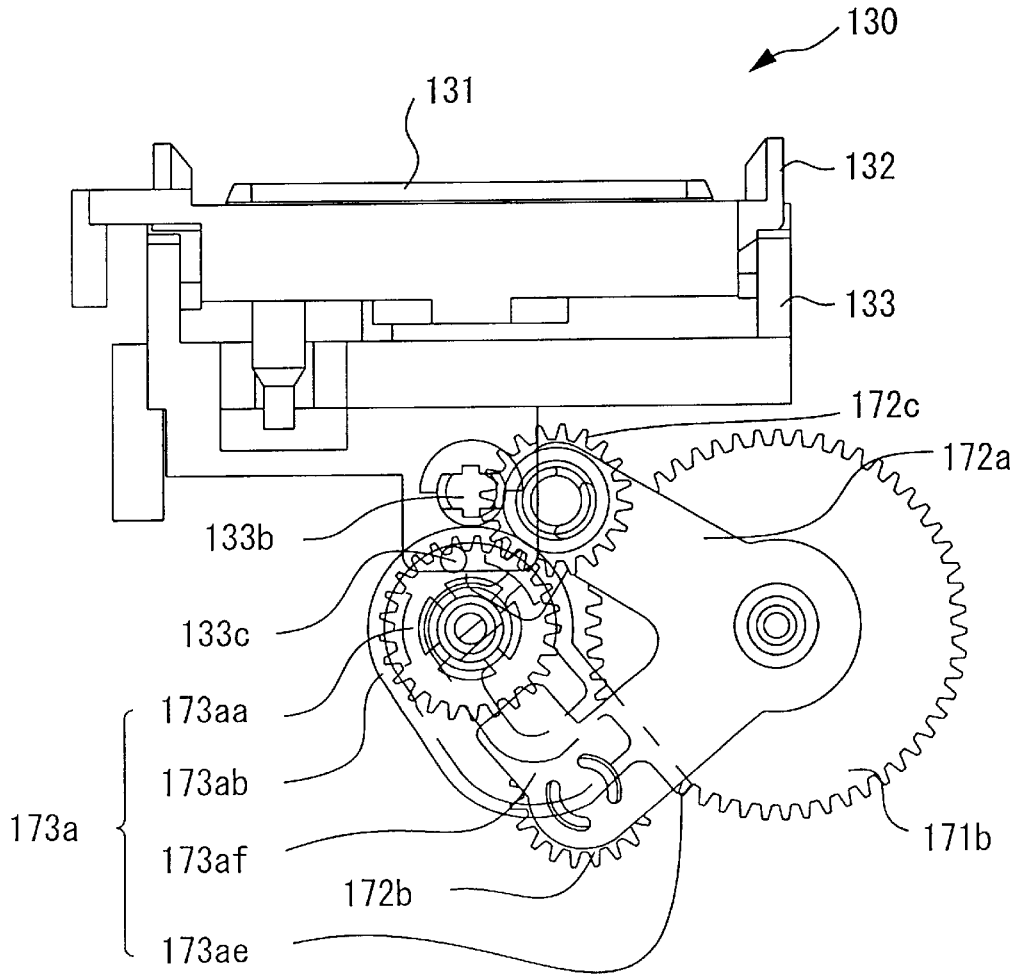
FIG. 66 is a second diagram showing the operation of the FIG. 52 capping device.
Figure 67:
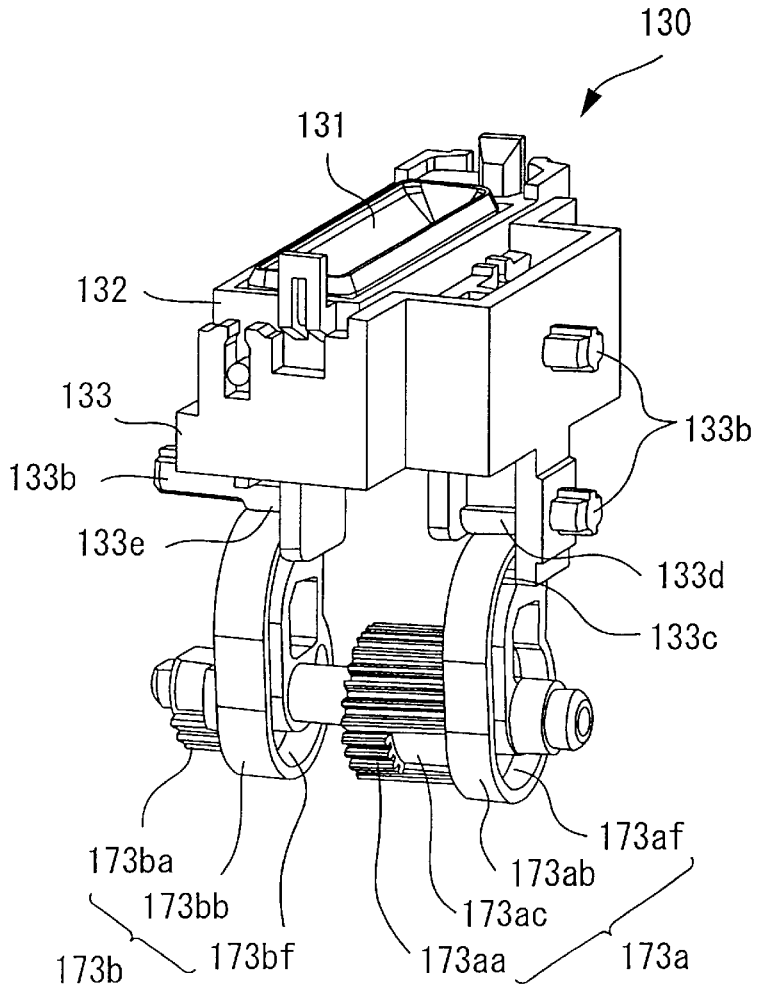
FIG. 67 is a third diagram showing the operation of the FIG. 52 capping device.
Figure 68:
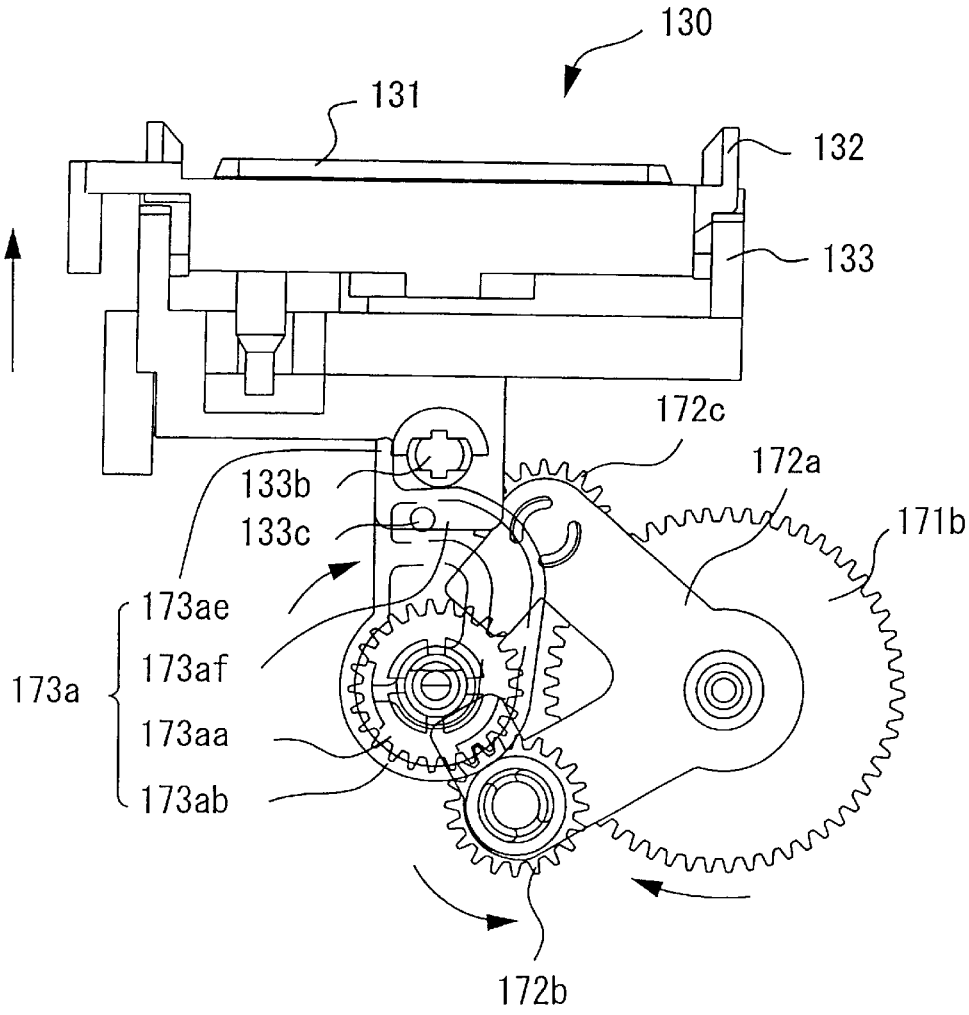
FIG. 68 is a fourth diagram showing the operation of the FIG. 52 capping device.

The operation of the capping device 130 will be described with reference to FIGS. 65 through 68. Of those figures, FIGS. 65 and 66, and FIGS. 67 and 68 respectively illustrate the same state of the operation from different points of view. Specifically, FIGS. 65 and 66 show a state that the storing of the cap 131 is completed. FIG. 67 to FIG. 68 show a state allowing the cap 131 to cap the recording head therewith.

To start, in the state that the storing of the cap 131 is completed, as shown in FIGS. 65 and 66, the capping device 130 is positioned and fixed at the lower-most end position. This positioning and fixing operations are performed in the following way. As shown in FIG. 65, the toothless gear part 173*aa* of the gear cam 173*a* is disposed such that through the rotation of the switch arm 172*a*, the normal rotation gear 172*b* and the reverse rotation gear 172*c* alternately mesh with the normal rotation gear 172*b* and the reverse rotation gear 172*c* at position shifted to the width direction of the toothless gear part 173*aa*. Two toothless parts 173*ac* and 173*ad* are respectively formed on the toothless gear part 173*aa* at positions shifted in the circumferential direction and the width direction.

As shown in FIGS. 65 and 66, the cam part 173*ab* (173*bb*) of the gear cam 173*a* (173*b*) is formed to have an almost oval shape. Stoppers 173*ae* and 173*be*, which may be brought in contact with the two guide pins 133*b* and 133*b* at both sides of the lower part of the second cap holder 133, are provided on the outer periphery of the cam part. Guide grooves 173*af* and 173*bf* for guiding other guide pins 133*c* and 133*c* provided on the second cap holder 133 along the outer circumference are formed in the side surface.

When the capping device 130 is moved from the top end and reaches the bottom end, the guide grooves 173*af* and 173*bf* in the cam parts 173*ab* and 173*bb* each forming the gear cams 173*a* and 173*b* guide the two guide pins 133*c* of the second cap holder 133 to move, and the two guide pins 133*b* on both sides of the lower part of the second cap holder 133 are moved downward to the bottom end along the guide grooves 101*a* and 102*a* in the side frames 101 and 102.

Further, the reverse rotation gear 172*c* reaches the toothless part 173*ad* of the toothless gear part 173*aa* forming the gear cam 173*a*, and runs idle. As a result, the second cap holder 133 is positioned with respect to the gear cams 173*a* and 173*b* and the side frames 101 and 102, and accordingly, the capping device 130 is positioned and fixed at the bottom end position.

In the state that the capping of the recording head with the cap 131 is allowed, as shown in FIGS. 67 and 68, the capping device 130 is positioned and fixed at the top end position. This positioning and fixing operations are performed in the following way. When the capping device 130 is moved and reaches the top end position from the bottom end position, two guide pins 133*d* and 133*e* of the second cap holder 133 are respectively moved by the cam parts 173*ab* and 173*bb* of the gear cams 173*a* and 173*b*, and the two guide pins 133*b* on both sides of the lower part of the second cap holder 133 are moved upward to the top end position along the guide grooves 101*a* and 102*b* of the side frames 101 and 102 to thereby be brought into contact with the stoppers 173*ae* and 173*be*.

In this state, the normal rotation gear 172*b* is put on the toothless part 173*ac* of the toothless gear part 173*aa* forming the gear cam 173*a*, and runs idle. As a result, the second cap holder 133 is positioned with respect to the gear cams 173*a* and 173*b* and the side frames 101 and 102, and accordingly, the capping device 130 is positioned and fixed at the top end position.

Figure 69:
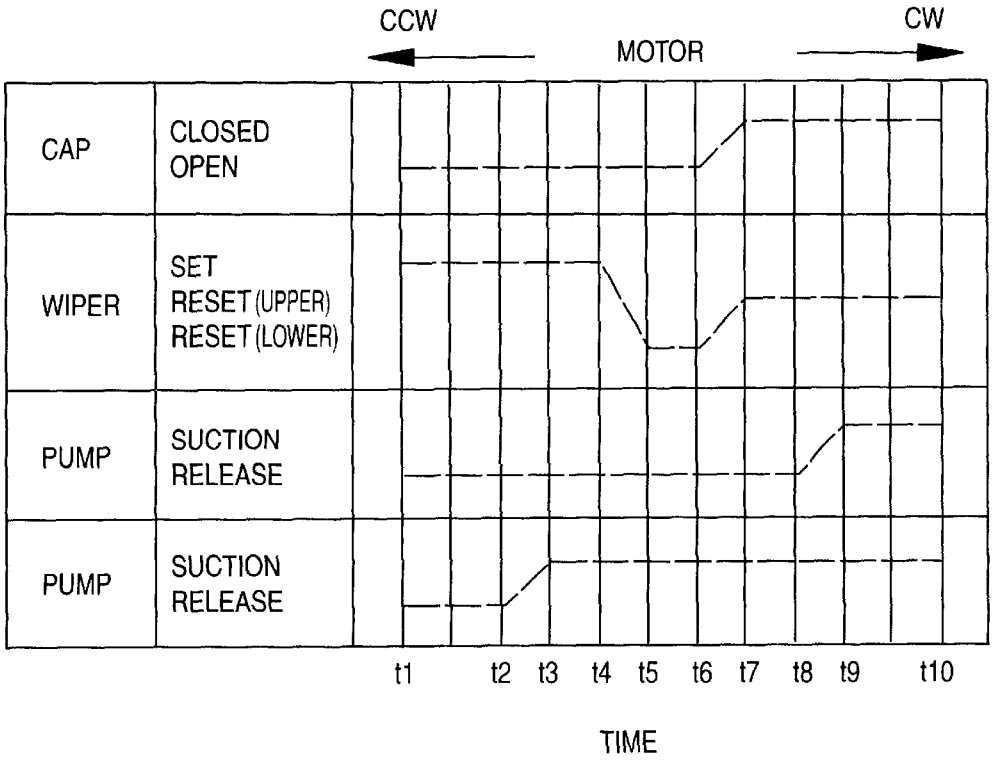
FIG. 69 is a time chart exemplarily showing the operation of the FIG. 49 head jetting characteristic maintaining device.
Figure 70:
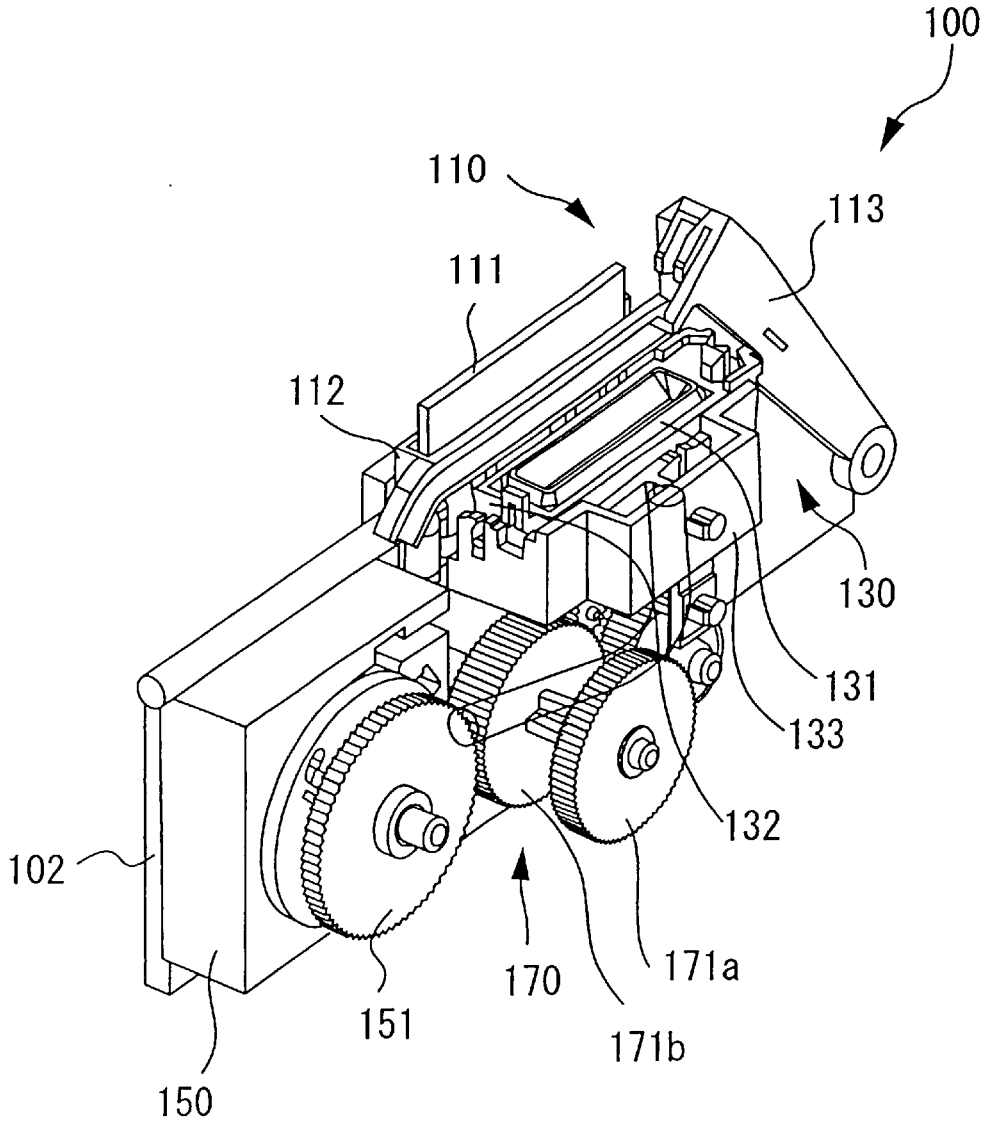
FIG. 70 is a first diagram showing the operation of the FIG. 49 head jetting characteristic maintaining device.
Figure 71:
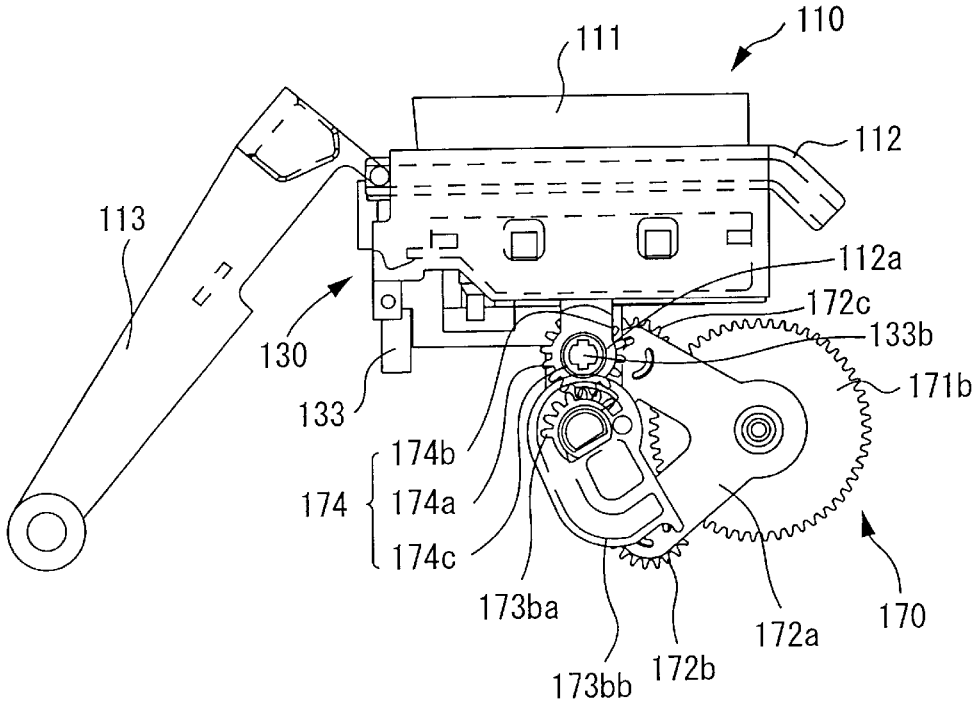
FIG. 71 is a second diagram showing the operation of the FIG. 49 head jetting characteristic maintaining device.
Figure 72:
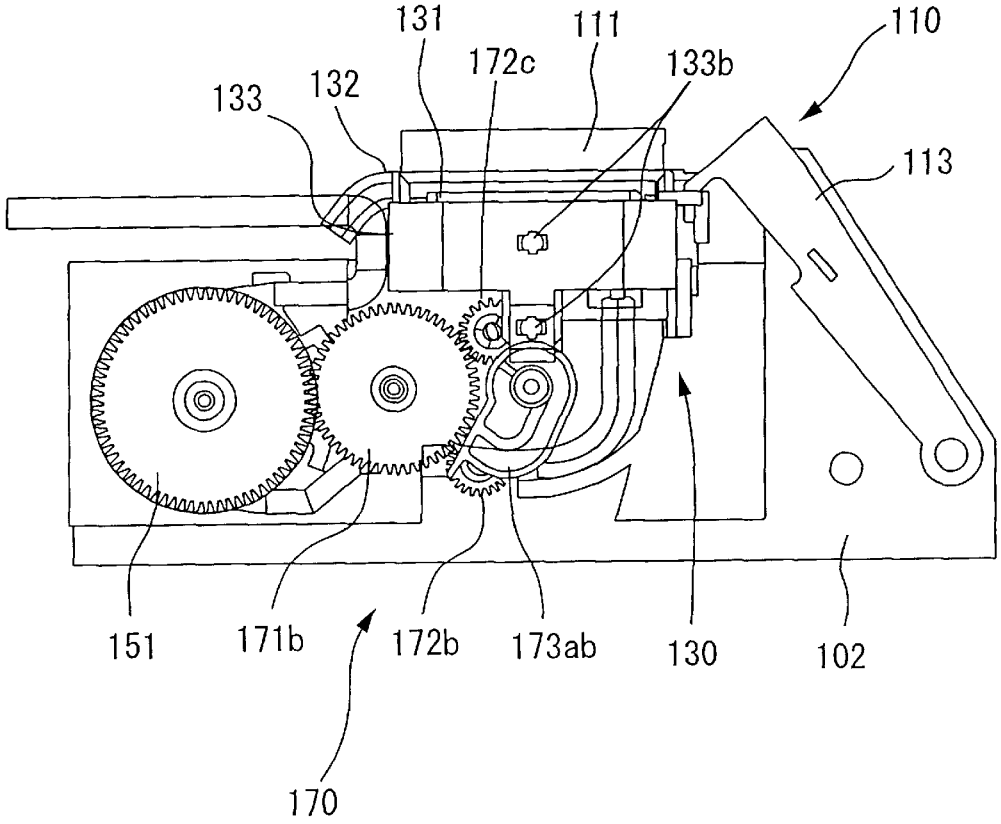
FIG. 72 is a third diagram showing the operation of the FIG. 49 head jetting characteristic maintaining device.
Figure 73:
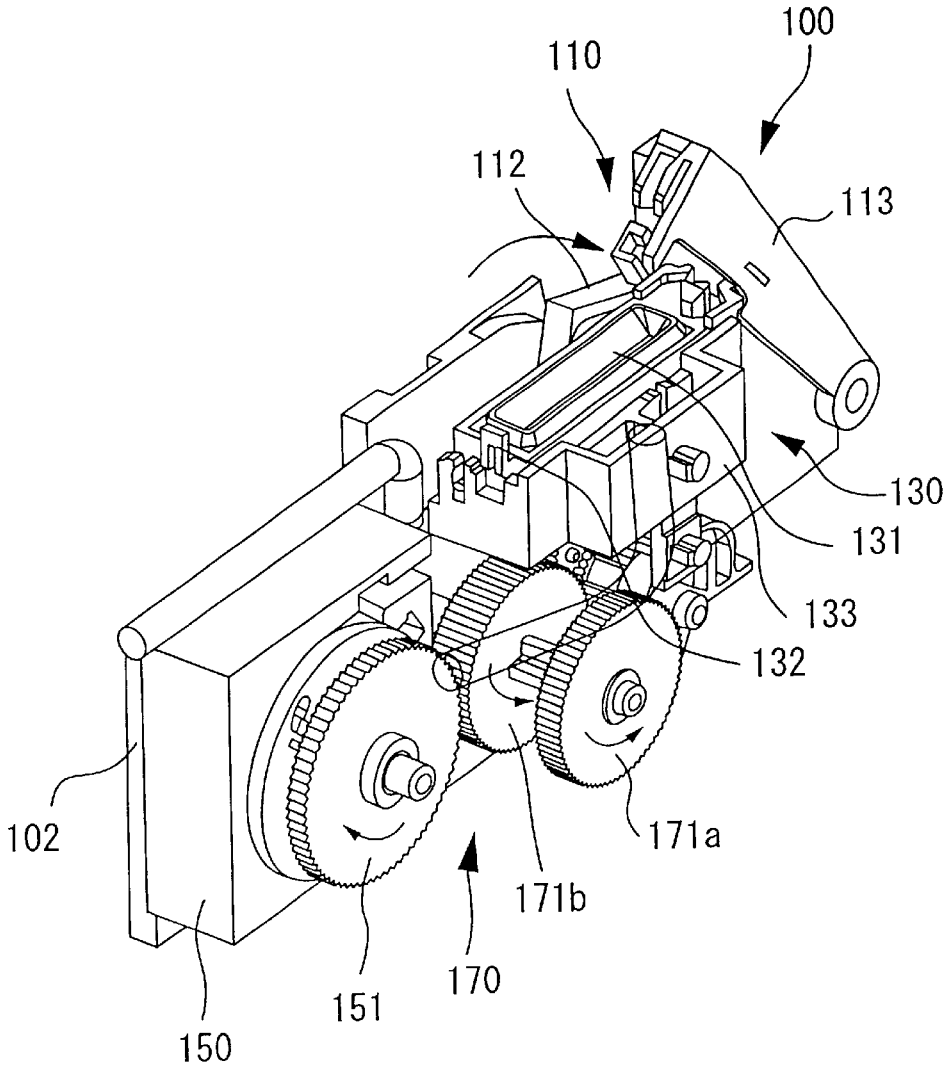
FIG. 73 is a fourth diagram showing the operation of the FIG. 49 head jetting characteristic maintaining device.
Figure 74:
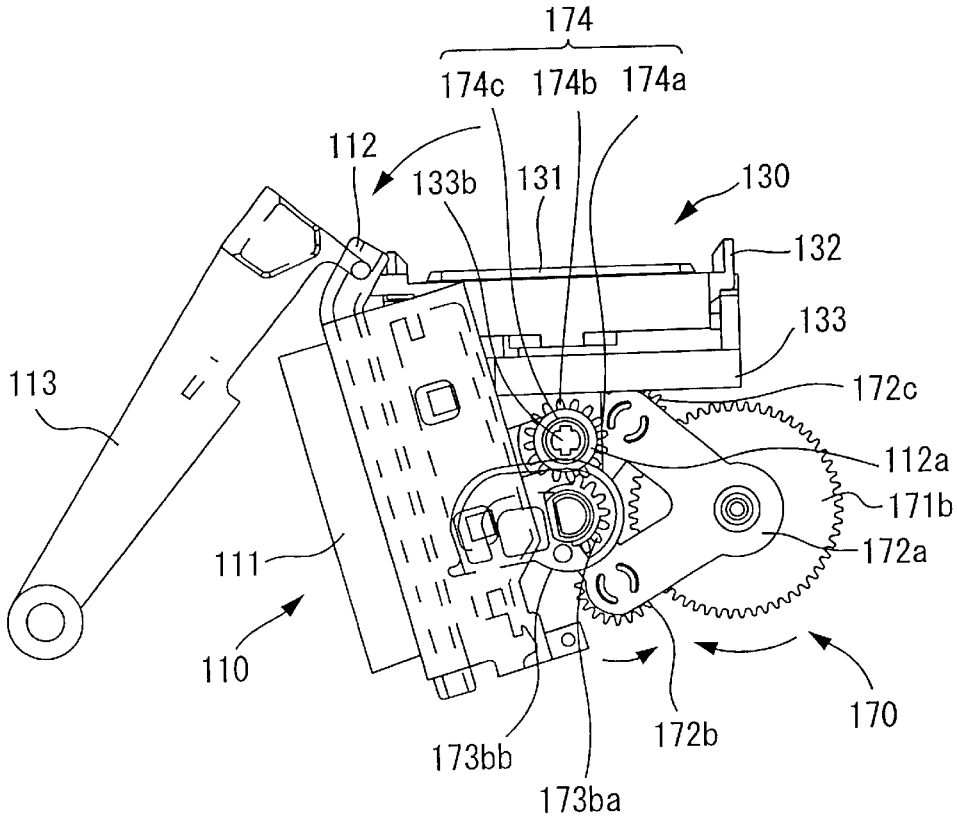
FIG. 74 is a fifth diagram showing the operation of the FIG. 49 head jetting characteristic maintaining device.
Figure 75:
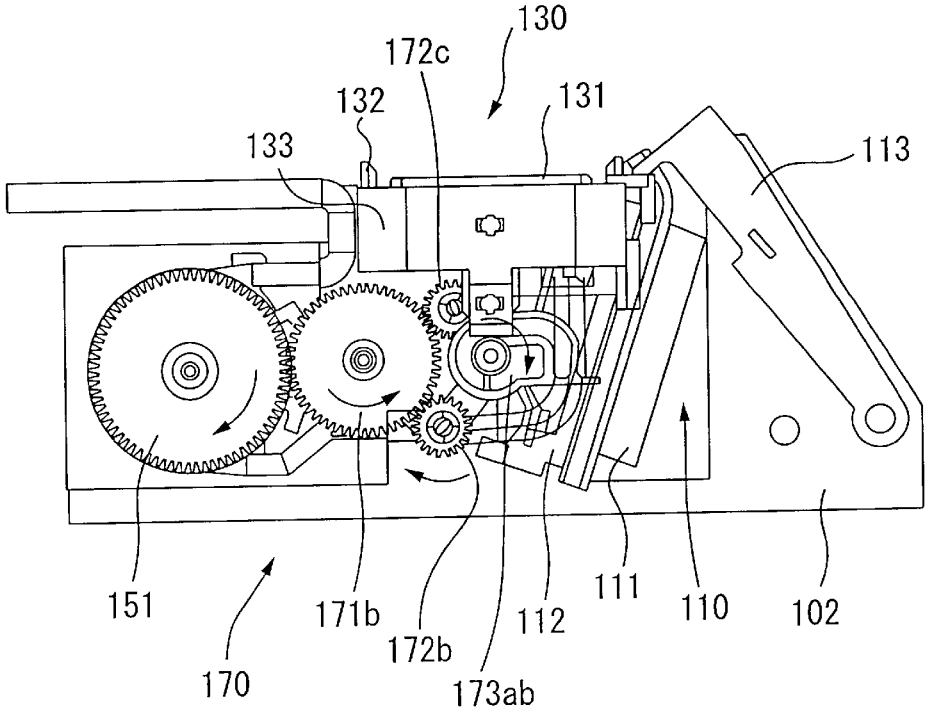
FIG. 75 is a sixth diagram showing the operation of the FIG. 49 head jetting characteristic maintaining device.
Figure 76:
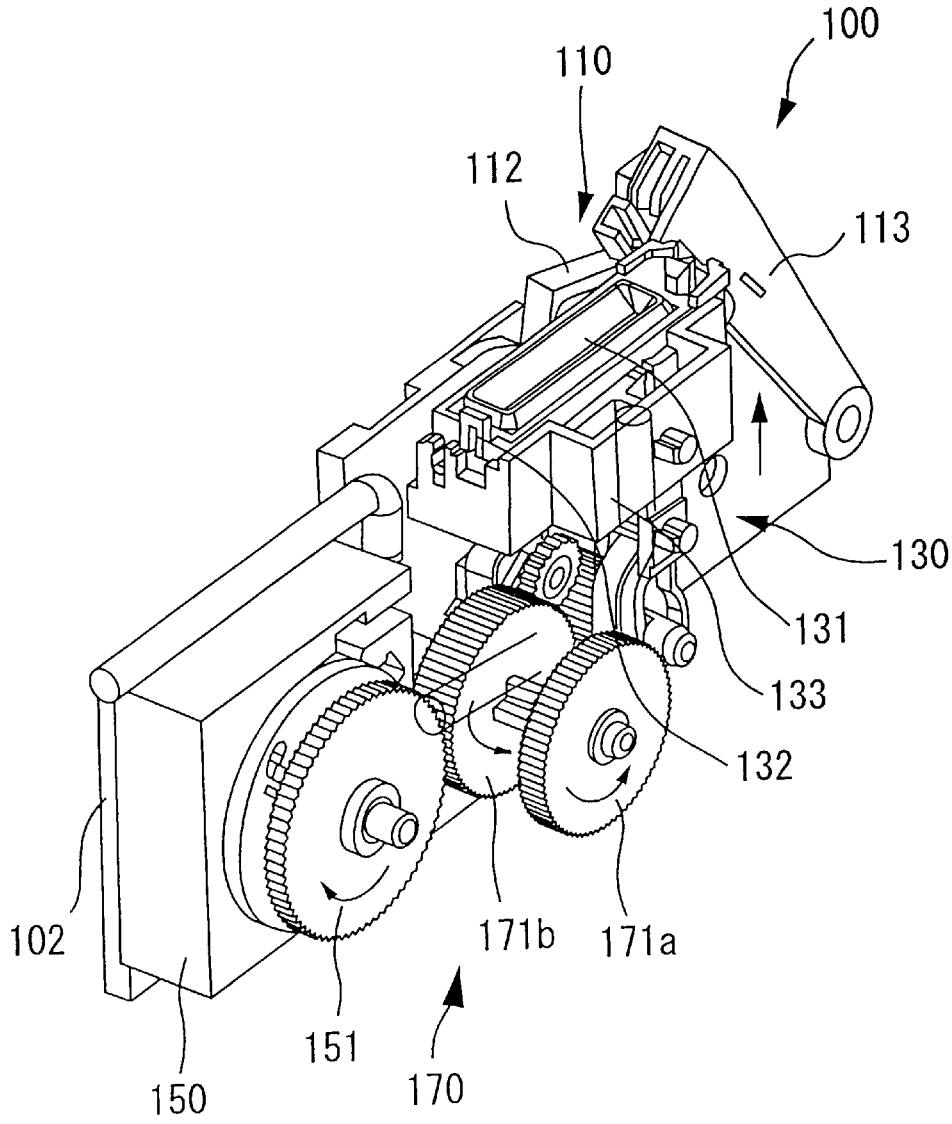
FIG. 76 is a seventh diagram showing the operation of the FIG. 49 head jetting characteristic maintaining device.
Figure 77:
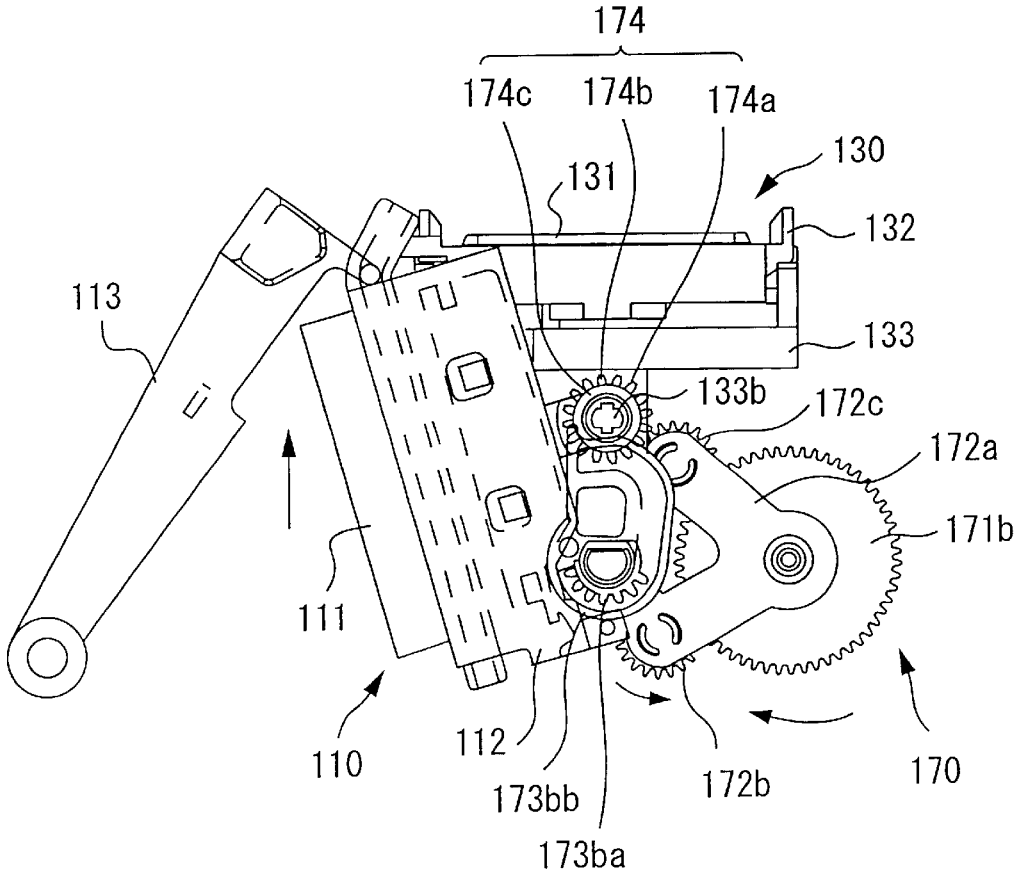
FIG. 77 is an eighth diagram showing the operation of the FIG. 49 head jetting characteristic maintaining device.
Figure 78:
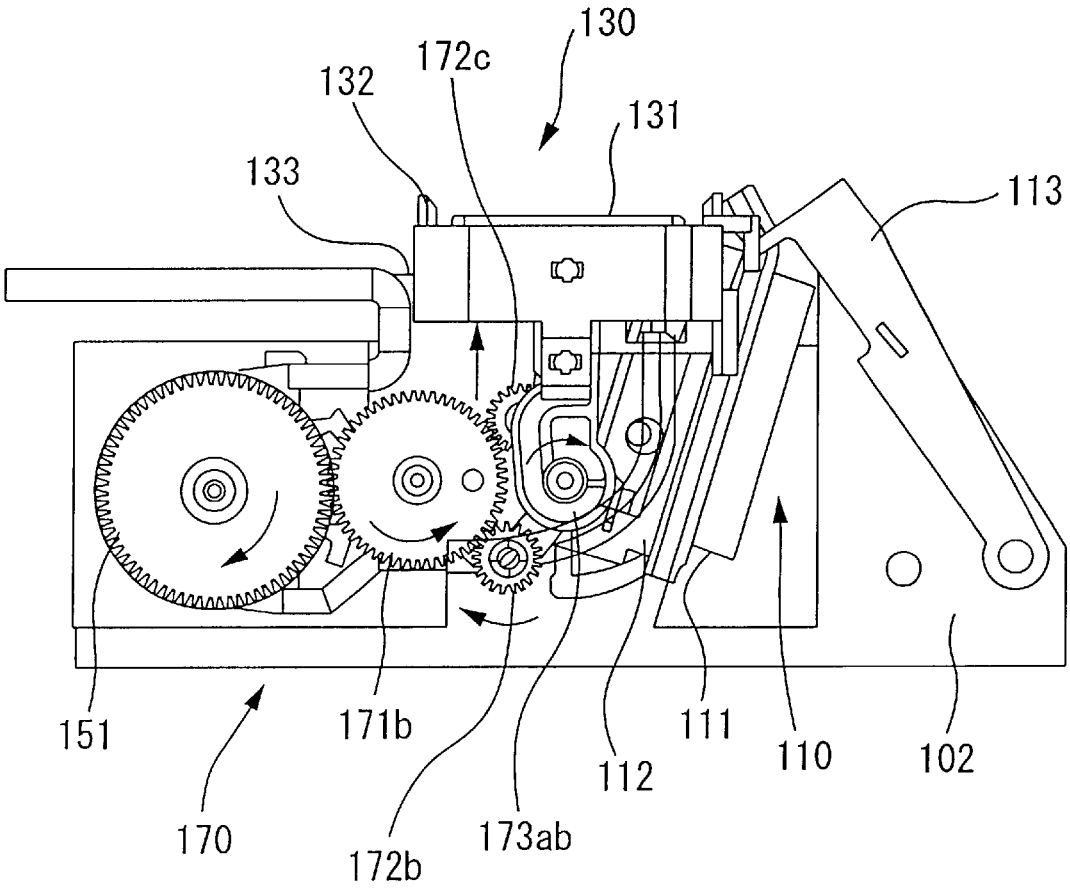
FIG. 78 is a ninth diagram showing the operation of the FIG. 49 head jetting characteristic maintaining device.

An overall operation of the thus constructed head jetting property maintenance device 100, which includes the wiping device 110, the capping device 130, the sucking device 150 and the driving device 170, will be described with reference to FIGS. 69 through 78. Of those figures, FIG. 69 is a time chart showing an operation of the head jetting property maintenance device 100. FIGS. 70 to 72, FIGS. 73 to 75, and FIGS. 76 to 78 respectively illustrate the same operation state from different points of view. FIGS. 70 to 72 show a state that the wiping by the wiper 111 is allowed. FIGS. 73 to 75 show a state that the storing of the wiper 111 is completed. FIGS. 76 to 78 show a state that the capping of the recording head by the cap 131 is allowed.

In the "normal rotation" in FIG. 69, the capping device 130 is located at the bottom end position as shown in FIGS. 70 to 72, and the cap 131 is in an "open" state, viz., the printing head is not capped with the cap 131. Also in this state, the wiping device 110 is located at an upper position, and the wiper 111 is in a "set" state, viz., the wiping operation by the wiper is allowed. The roller of the pump as the sucking device 150 is in a "release" state to the tube, viz., in a non-suction state (start time point t1).

From this state, the motor rotates in the normal rotation direction to thereby turn the second gear 171*b* together with the first gear 171*a*, and then the switch arm 172*a* is turned and the normal rotation gear 172*b* meshes with the toothless gear part 173*aa* of the gear cam 173*a*. In turn, the rotational force of the second gear 171*b* is transmitted from the normal rotation gear 172*b* to the toothless gear part 173*aa* of the gear cam 173*a*, and the gear cams 173*a* and 173*b* are turned. Subsequently, the toothless gear part 173*ba* of the gear cam 173*b* rotates the gear 174*b* of the friction clutch mechanism 174. At the same time, the partially toothless gear 174*a* under pressure of the compression spring 174*c* is also rotated by friction force and the wiper holder 112 starts to turn (time point t4).

Further, the toothless gear part 173*b* of the gear cam 173*b* is disengaged from the partially toothless gear 174*a* of the friction clutch mechanism 174. The toothless gear 174*a* runs idle and the wiper holder 112 stops its turning. At this time, as shown in FIGS. 73 to 75, the wiping device 110 is located at a lower position, and the wiper 111 is in a "reset state (lower)", viz., the wiper 111 is in a stored state (time point t5).

In turn, the gear cams 173*a* (173*b*) is turned, and the capping device 130, together with the wiping device 110, starts to move upwards with the aid of the cam part 173*ab* (173*bb*) of the gear cam 173*a* (173*b*) (time point t6). Then, the normal rotation gear 172*b* reaches the toothless part 173*ac* of the toothless gear part 173*aa* forming the gear cam 173*a*, and the normal rotation gear 172*b* runs idle. Accordingly, the capping device 130 and the wiping device 110 stop their upward movements.

In this state, as shown in FIGS. 76 to 78, the capping device 130 is located at the top end position, and the cap 131 is in a "close" state, viz., in a capping state. At this time, the wiping device 110 is positioned at a position higher than the previous position, and the wiper 111 is in the "reset (upper)" state, viz., the wiper 111 has moved upwards while being stored (time point 7).

From this state, the motor further rotates in the normal turn direction to thereby turn the second gear 171*b* together with the second gear 171*b*, and the sucking device 150 is operated. In this state, the roller of the pump is in a "pinching" state to the tube, viz., in a sucking state (time points 8 and 9). Thus, the drive force is not transmitted to the pump when the wiping device 110 and the capping device 130 are in operation.

In the "reverse rotation" in FIG. 69, the capping device 130 and the wiping device 110 are reversely moved by the reverse rotation gear 172*c* as compared to the above operation. The gear 151 shown in FIG. 49 makes half turn, and a pawl of a disc 152 is pushed with a pawl of the gear 151, and the disc 152 starts to turn. During this period, the wiping device 110 and the capping device 130 end their operation. The sucking device 150 returns to the "release" state at the time points t3 and t4.

As described above, in the head jetting property maintenance device 100 of the instant embodiment, the capping device 130 is not rotated. Therefore, spatial efficiency is increased. As a result, the head jetting property maintenance device into which the head jetting property maintenance device is incorporated may be reduced in size. The position precision of the capping device 130 and the recording head 18 may be improved, and a reliable capping operation is secured.

Through the operation of the friction clutch mechanism 174, the wiping device 110 and the capping device 130 may be held at a fixed position. Therefore, if the user touches the wiping device 110 and the capping device 130, there is no chance that the wiping device 110 and the capping device 130 are displaced. Accordingly, there is no need for the work to return the wiping device 110 and the capping device 130 to predetermined positions. Further, there is no chance that parts forming the wiping device 110 and the capping device 130 collide with each other. In this respect, the maintenance work is easy.

The wiping device 110 and the capping device 130 are always positioned highly accurately. Further, there is no need of making the phase adjustment of the parts forming the wiping device 110 and the capping device 130 in assembling the head jetting property maintenance device 100. Accordingly, the cost to manufacture the head jetting property maintenance device 100 is reduced.

Figure 79:
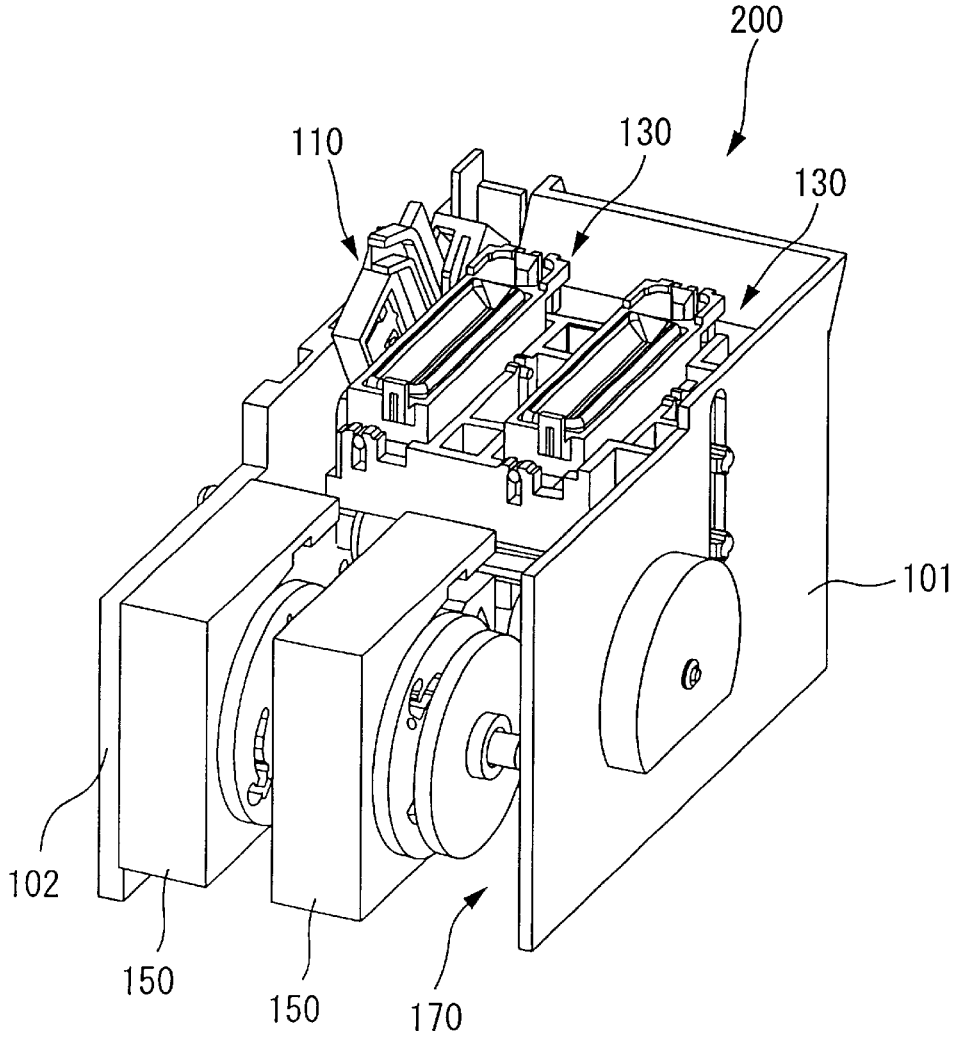
FIG. 79 is a perspective view showing another construction of a head jetting property maintenance device being assembled into a unit, which is an embodiment of the invention.
Figure 80:
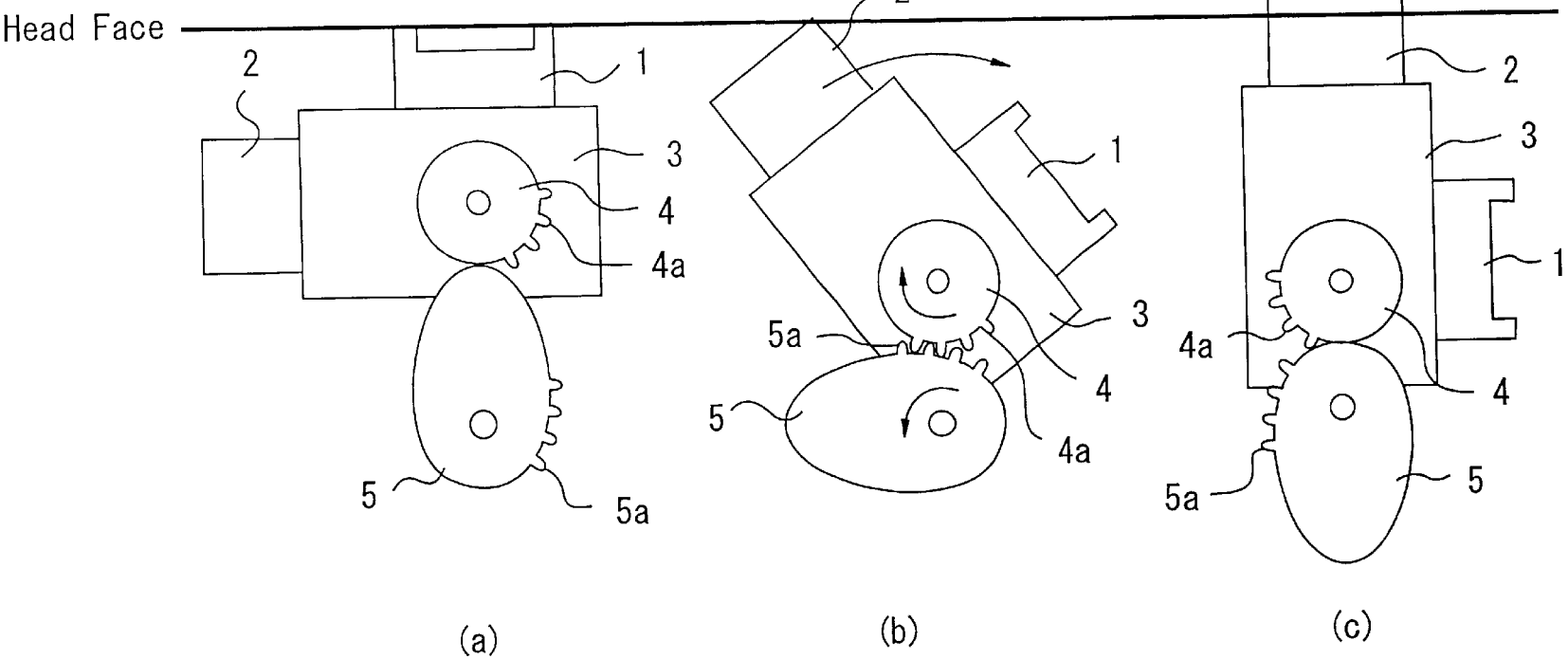
FIG. 80 is a plan view exemplarily showing the operations of conventional head jetting property maintaining device.

In the above embodiment, the description has been made on the head jetting property maintenance device 100 having one capping device 130 and one sucking device 150. It should be understood that the invention is not limited to such, but may be applied to a head jetting property maintenance device having, for example, two capping devices 130 and two sucking devices 150, as shown in FIG. 79. If so constructed, similar useful effects are also produced.

As seen from the foregoing description, in a head jetting property maintenance device and an ink jet printer with the same, which are constructed according to the present invention, there is no need of rotating the capping device, and therefore of providing a space allowing the device to rotate around the device. The result is to realize the size reduction of the ink jet printer into which the head jetting property maintenance device is incorporated, and maintain the position precision of the capping device and the recording head in high level. After the wiping device is rotated upward or downward, the friction clutch mechanism may be made to run idle. Therefore, the wiping device may always be positioned at a fixed position. Accordingly, the initializing and assembling of the wiping device are easy.

What is claimed is:

1. A head jetting property maintenance device for maintaining an ink jetting property of a recording head for jetting ink droplets to a recording medium, said head jetting property maintenance device comprising:

a wiping device for wiping said recording head;

a capping device for sealing said recording head; and a driving device including two planet gears for transmitting a drive force to said wiping device and said capping device and a rotary device for rotating said planet gears, wherein said driving device is configured to drive said wiping device and said capping device in a normal rotation direction of said rotary device via a drive force transmitted by one of the planet gears and in a reverse rotation direction of said rotary device via a drive force transmitted by the other of the planet gears.

2. A head jetting property maintenance device according to claim 1, wherein said driving device further includes a sun gear being coupled to said rotary device and in mesh with said planet gears, and a partially toothless gear being coupled to said wiping device and said capping device and in mesh with said planet gears, and said driving device is disconnected from said wiping device and said capping device after driving said wiping device and said capping device.

3. A head jetting property maintenance device according to claim 2, wherein said partially toothless gear is formed of a gear train including four partially toothless gears, which are in mesh with a wiper gear for driving said wiping device, a cap gear for driving said capping device, and said planet gears, respectively.

4. A head jetting property maintenance device according to clam 3, wherein said wiper gear includes a lever and a cam mechanism for horizontally moving said wiping device to said recording head, and said cap gear includes a cam mechanism for vertically moving said capping device with respect to said recording head.

5. A head jetting property maintenance device according to claim 1, further comprising a suction device for sucking a space within a cap of said capping device sealing said recording head, said suction device being driven by said driving device after said wiping device and said capping device have been driven.

6. An ink jet printer having a recording head for jetting ink droplets to a recording medium, said printer being characterized by a head jetting property maintenance device defined in claim 1.

7. A head jetting property maintenance device for maintaining an ink jetting property of a recording head for jetting ink droplets to a recording medium, said head jetting property maintenance device comprising:

a wiping device for wiping said recording head;

a capping device for sealing said recording head;

a driving device for positioning said wiping device and said capping device at predetermined positions;

a first guiding/fixing device for guiding, at the time of positioning of said wiping device, a positioning operation of said wiping device that includes a rotational movement of said wiping device relative to said capping device, and for positioning and fixing said wiping device; and a second guiding/fixing device for guiding, at the time of positioning of said capping device, a positioning operation of said capping device, and for positioning and fixing said capping device.

8. A head jetting property maintenance device according to claim 7, wherein when said wiping device wipes said recording head, said driving device turns said wiping device upward, while at the same time moves downward and positions said capping device, and when said capping device seals said recording head and sucks ink from said recording head, said driving device turns downward said wiping device, while at same time moves upward and positions said wiping device.

9. A head jetting property maintenance device according to claim 8, wherein said wiping device is rotatably mounted on said capping device.

10. A head jetting property maintenance device according to claim 8, wherein said wiping device includes a rotatable wiper for wiping said recording head, and a wiper cleaner for wiping out materials sticking onto said wiper in a manner that said wiper cleaner rubs with said wiper when said wiper rotates.

11. A head jetting property maintenance device according to claim 8, wherein said driving device includes a first cam provided with a gear for transmitting a drive force for rotating said wiping device, and a cam part for transmitting a drive force for moving said capping device vertically.

12. A head jetting property maintenance device according to claim 11, wherein said driving device includes a normal rotation gear for normal rotation and a reverse rotation gear for reverse rotation, which alternately come into engagement with a partially toothless gear of a second cam.

13. A head jetting property maintenance device according to claim 7, further comprising a suction device for sucking inside the cap of said capping device, and wherein said driving device drives said suction device.

14. A head jetting property maintenance device according to claim 7, wherein said driving device drives said respective devices independently.

15. A head jetting property maintenance device according to claim 7, wherein said wiping device and said capping device are able to return to their initial positions from any positions without use of sensing devices.

16. A head jetting property maintenance device according to claim 7, wherein a driving side and a driven side of said wiping device in said driving device are provided with partially toothless gears, respectively.

17. An ink jet printer having a recording head for jetting ink droplets to a recording medium, said printer being characterized by a head jetting property maintenance device defined in claim 7.

18. A head jetting property maintenance device for maintaining an ink jetting property of a recording head for jetting ink droplets to a recording medium, said head jetting property maintenance device comprising:

a wiping device for wiping said recording head;

a capping device for sealing said recording head, and a driving device operating such that when said wiping device wipes said recording head, said driving device turns said wiping device upward and moves downward and positions said capping device, and when said capping device seals said recording head to suck ink therefrom, said driving device turns downward said wiping device and moves upward and positions said capping device, wherein said driving device includes a friction clutch mechanism that transmits a drive force when said wiping device is driven to start its turn, and releases the drive force when said wiping device is stopped in turn.

19. A head jetting property maintenance device according to claim 18, further comprising a suction device for sucking inside a cap of said capping device, and wherein said driving device drives said suction device.

20. A head jetting property maintenance device according to claim 18, wherein a gear drive mechanism using a partially toothless gear is used for an intermediate power transmission mechanism of said friction clutch mechanism.

21. A head jetting property maintenance device according to claim 18, wherein said wiping device and said capping device are returnable to their initial positions from any positions without use of sensing devices.

22. A head jetting property maintenance device according to claim 18, wherein said friction clutch mechanism includes two drive force transmission devices, and a pressing device for pressing said drive force transmission devices with each other, and said drive force transmission devices are integrally coupled to said wiping device.

23. A head jetting property maintenance device according to claim 22, wherein said pressing device is a compression gear for pressing a normal gear against a partially toothless gear.

24. A head jetting property maintenance device according to claim 18, wherein said wiping device is rotatably mounted on said capping device.

25. A head jetting property maintenance device according to claim 18, wherein said driving device includes a cam having a partially toothless gear which transmits a drive force during the rotation of said wiping device through said two drive force transmission devices, and which transmits a drive force when said capping device vertically moves.

26. An ink jet printer having a recording head for jetting ink droplets to a recording medium, said printer being characterized by a head jetting property maintenance device defined in claim 18.

* * * * *